US006802155B1

(12) United States Patent
Kawabata et al.

(10) Patent No.: US 6,802,155 B1
(45) Date of Patent: Oct. 12, 2004

(54) DOOR OPENING AND CLOSING MECHANISM WITH DUAL PIVOT AXIS FOR A DOOR

(75) Inventors: Masuo Kawabata, Ikoma (JP); Takashi Yoshikawa, Izumi (JP); Hiroshi Yoshimura, Tondabayashi (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/695,054

(22) Filed: Oct. 25, 2000

(30) Foreign Application Priority Data

| | | |
|---|---|---|
| Oct. 25, 1999 | (JP) | H11-302434 |
| Nov. 19, 1999 | (JP) | H11-329193 |
| Dec. 3, 1999 | (JP) | H11-344109 |
| Dec. 14, 1999 | (JP) | H11-353844 |

(51) Int. Cl.[7] ..... F25D 23/02
(52) U.S. Cl. ..... 49/192; 49/278
(58) Field of Search ..... 49/276, 278, 277, 49/503, 192

(56) References Cited

U.S. PATENT DOCUMENTS

| | | | | |
|---|---|---|---|---|
| 2,970,857 A | | 2/1961 | Squire | |
| 3,889,419 A | * | 6/1975 | Maleck | 49/193 |
| 4,495,673 A | * | 1/1985 | Khan | 16/232 |
| 4,503,582 A | * | 3/1985 | Gurubatham | 16/232 |
| 4,503,583 A | * | 3/1985 | Frohbieter | 16/232 |
| 4,503,584 A | * | 3/1985 | Malchow | 16/232 |
| 4,590,710 A | | 5/1986 | Newland | |
| 4,932,730 A | | 6/1990 | Zeismann et al. | |
| 4,947,583 A | * | 8/1990 | Inui et al. | 49/193 |
| 5,530,992 A | * | 7/1996 | Baermann | 16/321 |
| 5,675,934 A | * | 10/1997 | Park | 49/193 |
| 5,829,197 A | * | 11/1998 | Oh | 49/193 |
| 5,908,228 A | | 6/1999 | Lee | |
| 5,983,453 A | * | 11/1999 | Miwa | 16/231 |
| 6,000,771 A | * | 12/1999 | Wissinger et al. | 312/405 |
| 6,085,463 A | | 7/2000 | Yoshikawa | |
| 6,282,838 B1 | * | 9/2001 | Yoshikawa | 49/193 |

FOREIGN PATENT DOCUMENTS

| | | | |
|---|---|---|---|
| GB | 807740 A2 | | 11/1997 |
| JP | H55431 | | 2/1993 |
| JP | H9303942 | | 11/1997 |
| JP | H1073367 | | 3/1998 |
| JP | 2000-90044 | * | 9/2000 |
| JP | 2001-124463 | | 5/2001 |
| JP | 2001-147077 | | 5/2001 |
| JP | 2001-0040166 | | 5/2001 |
| JP | 2001-159268 | | 6/2001 |
| JP | 2001-173303 | | 6/2001 |

* cited by examiner

*Primary Examiner*—Gregory J. Strimbu
(74) *Attorney, Agent, or Firm*—Birch, Stewart, Kolasch & Birch, LLP

(57) ABSTRACT

A door opening/closing mechanism fitted on a door that closes and opens an opening formed in the body of an apparatus by being brought into and out of contact with the rim of the opening has cam mechanisms that permit the door to engage with and disengage from the body at either of the right and left sides of the door (102). The cam mechanisms can be brought into a first lock position in which they lie symmetrically at both sides of the door and into a second lock position in which they lie symmetrically at both sides of the door, and each have a hinge pin (134) that serves as a rotation axis in the second lock position and a groove cam (141, 142) that engages with the hinge pin (134) in such a way as to be movable relative to the hinge pin. The groove cam (141, 142) has a slide portion (142*b*) on which a part of the innermost portion of the hinge pin slides when the cam mechanism is moved from the first lock position to the second lock position. When the door (102) is closed, the cam mechanisms at both sides are kept in the first lock position and, when the door is opened at one side, the door (102) slides and thereby causes the cam mechanism at the other side to be brought into the second lock position so as to be rotatably locked in the second lock position.

5 Claims, 74 Drawing Sheets

209
211
205
203
204
204a
A51
A52
A53
A54

212
206

212
206
207
208
210a
210b
212a
210
A55
A56
A57
A58
A59
A60

212
210
206

212
206
207

212

212
207
206

212

212

212

212

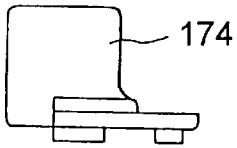
FIG.54B
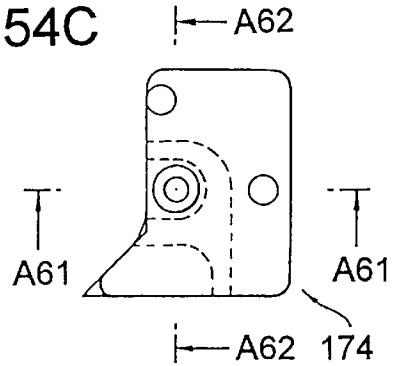
FIG.54C
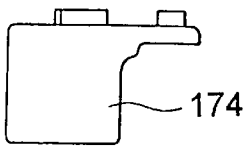
FIG.54D
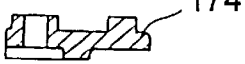
FIG.54E
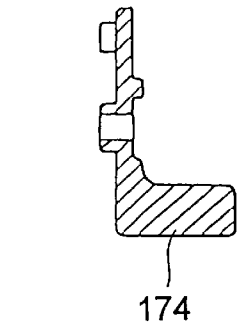
FIG.54F
FIG.54G
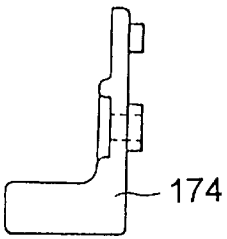
FIG.54A

DOOR OPENING AND CLOSING MECHANISM WITH DUAL PIVOT AXIS FOR A DOOR

BACKGROUND OF THE INVENTION

1. Field of the Invention

The present invention relates to a door opening/closing mechanism for opening and closing a door of, for example, a refrigerator.

2. Description of the Prior Art

A conventionally known door opening/closing mechanism for opening and closing a door of a refrigerator or the like is disclosed, for example, in Japanese Patent Application Laid-Open No. H10-73367. FIGS. 79 and 80 are respectively a sectional view as seen on a horizontal plane and a sectional view as seen from the side of this door opening/closing mechanism. As shown in these figures, a door 301 permits an opening formed in a cabinet 304 to be opened and closed by being pressed against and released from the rim of the opening. The door opening/closing mechanism 300 is fitted on the door 301. On the inner surface of the door 301, a gasket 302 is fitted around the edges thereof. The gasket 302 incorporates a magnet 303, which permits the gasket 302 to be kept in position around the rim of the opening.

The door opening/closing mechanism 300 has an inner handle 310 and an outer handle 311, which are fitted at one side of the door 301 so as to be held by the user. To the inner and outer handles 310 and 311, a grip member 302 is hinge-coupled so as to be rotatable about the axis of a hinge projection 321. At the open end of the grip member 320, a pressing projection 322 is provided. Moreover, on the outer handle 311, a rotary cam 330 is supported so as to be rotatable about a hinge pin 331 when a pressing force is applied to the grip member 320.

On the circumferencial surface of the rotary cam 330, a first and a second contact projection surface 332 and 333 are provided. As the rotary cam 330 rotates, the second contact projection surface 333 makes contact with a slide bar 340 and causes it to slide. The slide bar 340 has, at the tip end thereof, a contact surface 341 having a large area. As the slide bar 340 slides, the contact surface 341 breaks the contact between the gasket 302 and the cabinet 304 that is maintained by the magnetic force of the magnet 303. The slide bar 340 is loaded by a spring 350 with a force that returns the slide bar 340 to its original position when the grip member 320 is released from the pressing force applied thereto.

When the user, with the intention of opening the door 301, holds the inner and outer handles 310 and 311 and presses the grip member 320, the grip member 320 rotates about the hinge projection 321. This causes the pressing projection 322 to move in the direction indicated by arrow B and press the first contact projection surface 332. As a result, the rotary cam 330 rotates counter-clockwise as seen in FIG. 80, and accordingly the slide bar 340, pressed by the second contact projection surface 333, slides.

As a result of the contact surface 341 pressing the front surface of the cabinet 304, the door 301 is opened with a predetermined distance H secured between the cabinet 304 and the gasket 302. At this time, the spring 350 strikes a spring stopper projection 342 provided at the root end of the slide bar 340, and is thereby compressed.

In this state, when the user pulls the inner and outer handles 310 and 311 that the user is holding, the door 301 can be opened without the influence of the magnetic force of the magnet 303 and thus with a comparatively, weak force.

Another conventionally known door opening/closing mechanism that permits a door to be opened and closed at either side (i.e. either at the right-hand or left-hand side) is disclosed in Japanese Patent Application Laid-Open No. H9-303942. In this door opening/closing mechanism, two cam mechanisms for engaging and disengaging a door and a cabinet with and from each other are provided one at either side of the door. FIGS. 81A, 81B, and 81C show the principal portion of one cam mechanism of this door opening/closing mechanism.

The cam mechanism at either side has a lock cam member 402, which is fitted on the cabinet, and a slide cam member 401, which is fitted on the door. On the lock cam member 402, a hinge pin 414 is provided. In the slide cam member 401, a first and a second groove cam 403 and 404 are formed that can move while remaining engaged with the hinge pin 414. When the door is closed, the cam mechanisms at both sides are in a first lock position as shown in FIG. 81A. In this first lock position, the first groove cam 403 lies inclined, and therefore the hinge pin 414 remains engaged with the first groove cam 403 at both sides of the door. Thus, the door is kept closed.

In this state, when the user pulls the door at one side (at the side not illustrated in the figures), in one cam mechanism, the first groove cam 403 moves while remaining engaged with the hinge pin 414 until disengaged therefrom. In the other cam mechanism, as shown in FIG. 81B, the second cam groove 404 moves while remaining engaged with the hinge pin 414 up to a second lock position. At this time, the slide cam member 401 is, at a circular portion 404*a* of the second groove cam 404, supported by the hinge pin 414. Thus, the door is rotatably locked.

On the lock cam member 402, lock outer cams 411 and. 412 are provided integrally therewith. On the slide cam member 401, slide outer cams 409 and 410 are provided integrally therewith. The lock outer cams 411 and 412 and the slide outer cams 409 and 410 are so arranged as to face each other respectively. These outer cams have pairs of two common cylindrical surfaces (for example, 410*a* and 412*a* form one pair, and 410*b* and 412*b* another) whose center axis coincides, in the second lock position, with that of the hinge pin, 414 at either side of the door.

When the door rotates about the hinge pin 414, as shown in FIG. 81C, the lock outer cam 412 and the slide outer cam 410 start engaging with and sliding along each other. Thus, the slide outer cam 410 is guided along the cylindrical surface 412*a*, and, at the side not illustrated in the figures, the slide outer cam 410 is guided along the cylindrical surface 412*b*.

Moreover, as the door rotates, a first cam projection 405 provided so as to be concentric with the circular portion 404*a* slides along and is thereby guided along a second cam projection 406 provided so as to be concentric with the hinge pin 414. This prevents the second groove cam 404 and the hinge pin 414 from being disengaged from each other and thereby permits the door to rotate. In this way, the door can be opened apparently in the same manner as a door having an ordinary one-side opening/closing mechanism. The same Japanese Patent Application discloses also a structure in which the lock outer cams 411 and 412 and the slide outer cams 409 and 410 are abolished and the door is permitted to rotate simply as a result of the first cam projection 405 being guided along the second cam projection 406.

The door opening/closing mechanism disclosed in Japanese Patent Application Laid-Open No. H10-73367 mentioned above requires the user to exert a strong grip when the door 301 is opened at first until the predetermined distance H is secured. Thus, this mechanism is difficult for a person with a weak grip to operate. Even if the grip member 320 is pulled by using the user's body weight, a considerably strong grip is required at the fingertips. Thus, it is difficult to open the door 301 even by using the user's body weight.

The force required to operate the mechanism can be reduced by increasing the distance between the first contact projection surface 332 of the rotary cam 330 and the hinge 331. However, this requires the rotary cam 330 as a whole to be made larger and thus gives the mechanism an unsightly design. Moreover, the grip member 320 needs to be moved through a longer distance, which spoils ease of operation. Furthermore, the very structure of this door opening/closing mechanism requires the slide bar 340 to be disposed near the grip member 320, which imposes restrictions on the design of the door opening/closing mechanism.

These problems are encountered also in the door opening/closing mechanism disclosed in Japanese Patent Application Laid-Open No. H9-303942 mentioned above that permits a door to be opened and closed at either side. Moreover, in this door opening/closing mechanism, as the door slides to the second lock position, friction occurs between the door and the lock cam member 402, and in addition it is necessary to slide the gasket 302 that is kept in close contact with the cabinet 304 by the magnet 303 (see FIG. 79). Thus, operation of this mechanism requires an even stronger force.

Furthermore, if the distance between the two slide cam members 401 happens to vary so as to become greater than the interval between the hinge pins 414 provided at both sides of the door, it becomes difficult to open and close the door. For example, the interval between the right-hand and left-hand slide cam members 401 may vary due to the errors that occur when the slide cam members 401 are fitted on a support member and due to the accuracy with which this support member is produced. Moreover, in cases where the door has its inside formed into an integrally foamed heat insulator filled with polyurethane foam, the interval between the right-hand and left-hand slide cam members 401 may vary also due to the variation of ambient temperature and of foaming scale in the foaming process.

In this condition, at the side at which the door is open (i.e. at the side not illustrated in the figures), the first groove cam 403 is guided by the hinge pin 414, and, at the fulcrum side of the door (i.e. at the side illustrated in the figures), the circular portion 404*a* of the second groove cam 404 is supported by the hinge pin 414. Accordingly, if the interval between the slide cam members 401 differs from the interval between the hinge pins 414 at both sides, high friction occurs between the hinge pin 414 and the first groove cam 403, and thus opening and closing the door requires a strong force.

Moreover, before the lock outer cam 412 engages with the slide outer cam 410, the hinge pin 414 is supported solely by the second grovel cam 404. If the position of the slide cam member 401 varies, the distance through which the second groove cam 404 moves in the direction of the width of the door when the door is opened becomes shorter. Thus, the hinge pin 414 can barely slide along less than half the circumference of the circular portion 404*a*.

As a result, the hinge pin 414 cannot be supported by the second groove cam 404, and the resulting variation of the position of the rotation axis makes it impossible for the door to rotate smoothly. In the structure where the lock outer cam 412 and the slide outer cam 410 are abolished, there is even a risk that the hinge pin 414 at the rotation-axis side moves closer to the first groove cam 403 and causes the door to come off.

Furthermore, the slide outer cam 410 that slides along the lock outer cam 412 as the door rotates is located so as to face the lock outer cam 412 before being engaged therewith. Therefore, if there is a large variation, due to an assembly error, in the position in which the slide cam member 401 is fitted, as the door rotates, the slide outer cam 410 collides with the lock outer cam 412, and thereby makes it impossible to open the door smoothly. This requires adjustment of the fitting position or exchange of the support member, and thus leads not only to low production efficiency but also to a low manufacturing yield by making the support member for supporting the slide cam member 401 useless.

Even if the slide cam members 401 are fitted without any assembly error so as to permit the door to be opened and closed smoothly, similar problems arise depending on the environment in which the refrigerator or the like that incorporates the door opening/closing mechanism is used. For example, as ambient temperature rises, the support member on which the slide cam members 401 are fitted expands, and thus the interval between the slide cam members 401 becomes longer. This makes it impossible to open and close the door smoothly, and also leads to a low manufacturing yield.

SUMMARY OF THE INVENTION

An object of the present invention is to provide a door opening/closing mechanism that permits a door to be opened with a weak force but nevertheless has an acceptable design.

Another object of the present invention is to provide a door opening/closing mechanism that can be manufactured with improved production efficiency and with an improved manufacturing yield and to provide a manufacturing method of such a door opening/closing mechanism.

To achieve the above objects, according to one aspect of the present invention, a door opening/closing mechanism fitted on a door that closes and opens an opening formed in the body of an apparatus by being brought into and out of contact with the rim of the opening is provided with: a lever mechanism that brings the door a predetermined distance away from the rim of the opening by exploiting the action of a lever.

According to another aspect of the present invention, in this door opening/closing mechanism, the lever mechanism is provided with a handle fitted on the door so as to be rotatable about a rotation axis in such a way that the operated portion of the handle serves as the point of effort of the lever mechanism and the rotation axis serves as the fulcrum of the lever mechanism; and an arm that rotates concentrically with the rotation axis in synchronism with the rotation of the handle in such a way that the point at which the arm makes contact with the rim of the opening serves as the point of load of the lever mechanism. Here, when the handle is operated, the arm presses a portion of the rim of the opening and thereby causes the door to be brought the predetermined distance away from the body.

According to another aspect of the present invention, the door opening/closing mechanism described above first is further provided with: cam mechanisms that permit the door to engage with and disengage from the body at either of the right and left sides of the door. The cam mechanisms can be brought into a first lock position in which they lie symmetrically at both sides of the door and into a second lock position in which they lie symmetrically at both sides of the door.

Here, when the door is closed, the cam mechanisms at both sides are kept in the first lock position and, when the door is opened at one side, the door slides and thereby causes the cam mechanism at the other side to be brought into the second lock position.

According to another aspect of the present invention, a door opening/closing mechanism fitted on a door that closes and opens an opening formed in the body of an apparatus by being brought into and out of contact with the rim of the opening is provided with: cam mechanisms that permit the door to engage with and disengage from the body at either of the right and left sides of the door. The cam mechanisms can be brought into a first lock position in which they lie symmetrically at both sides of the door and into a second lock position in which they lie symmetrically at both sides of the door. The cam mechanisms are each provided with: a hinge pin that serves as a rotation axis in the second lock position; and a groove cam that engages with the hinge pin in such a way as to be movable relative to the hinge pin. The groove cam has a slide portion on which a part of the innermost portion of the hinge pin slides when the cam mechanism is moved from the first lock position to the second lock position. Here, when the door is closed, the cam mechanisms at both sides are kept in the first lock position and, when the door is opened at one side, the door slides and thereby causes the cam mechanism at the other side to be brought into the second lock position so as to be rotatably locked in the second lock position.

According to another aspect of the present invention, a door opening/closing mechanism fitted on a door that closes and opens an opening formed in the body of an apparatus by being brought into and out of contact with the rim of the opening is provided with: cam mechanisms that permit the door to engage with and disengage from the body at either of the right and left sides of the door. The cam mechanisms can be brought into a first lock position in which they lie symmetrically at both sides of the door and into a second lock position in which they lie symmetrically at both sides of the door. The cam mechanisms are each provided with: a groove cam formed in the body and guided by the rotation axis of the door; a lock outer cam formed on the body and having two slide surfaces with cross sections shaped like arcs described about the rotation axis at one and the other sides, respectively, of the door; and a slide outer cam formed on the door, having two slide surfaces with cross sections shaped like arcs described about the rotation axis at one and the other sides, respectively, of the door, and guided by the lock outer cam in the second lock position so as to slide on the lock outer cam. Here, when the door is closed, the cam mechanisms at both sides are kept in the first lock position and, when the door is opened at one side, the door slides and thereby causes the cam mechanism at the other side to be brought into the second lock position so as to be rotatably locked in the second lock position. Moreover, at the side at which the cam mechanism is kept in the second lock position when the door is opened, the distance between the point of contact at which a center line through the rotation center of the door is tangent to the portion of the lock outer cam facing the slide outer cam before they starts sliding on each other and the point of contact at which a center line through the rotation center of the door is tangent to the portion of the slide outer cam facing the lock outer cam before they starts sliding on each other, as measured in a radial direction when they are sliding on each other, is made greater than the maximum permissible variation in the outermost distance between the two groove cams formed at both sides of the door.

According to another aspect of the present invention, in a method of manufacturing a door opening/closing mechanism fitted on a door that closes and opens an opening formed in the body of an apparatus by being brought into and out of contact with the rim of the opening, the door opening/closing mechanism is provided with: cam mechanisms that permit the door to engage with and disengage from the body at either of the right and left sides of the door. The cam mechanisms can be brought into a first lock position in which they lie symmetrically at both sides of the door and into a second lock position in which they lie symmetrically at both sides of the door. The cam mechanisms are each provided with: a hinge pin that serves as a rotation axis in the second lock position; a groove cam that engages with the hinge pin in such a way as to be movable relative to the hinge pin; a lock outer cam formed on the body and having two slide surfaces with cross sections shaped like arcs described about the rotation axis at one and the other sides, respectively, of the door; and a slide outer cam formed on the door, having two slide surfaces with cross sections shaped like arcs described about the rotation axis at one and the other sides, respectively, of the door, and guided by the lock outer cam so as to slide on the lock outer cam in such a way as to describe an arc. The door opening/closing mechanism functions in such a way that, when the door is closed, the cam mechanisms at both sides are kept in the first lock position and that, when the door is opened at one side, the door slides and thereby causes the cam mechanism at the other side to be brought into the second lock position so as to be rotatably locked in the second lock position. Here, the method of manufacturing the door opening/closing mechanism includes: a step of setting the design value of the distance, as measured when the tip of the lock outer cam and the tip of the slide outer cam make contact with a straight line parallel to the direction of the width of the body, between the points of contact at which the lock outer cam and the slide outer cam make contact with the straight line to be greater than the maximum permissible variation in the outermost distance between the two groove cams formed at both sides of the door; and a step of manufacturing the door opening/closing mechanism on the basis of the design value.

BRIEF DESCRIPTION OF THE DRAWINGS

This and other objects and features of the present invention will become clear from the following description, taken in conjunction with the preferred embodiments with reference to the accompanying drawings in which:

FIGS. 54A to 54G are diagrams showing the stopper of the door opening/closing mechanism of the eighth embodiment;

DESCRIPTION OF THE PREFERRED EMBODIMENTS

Figure 1:
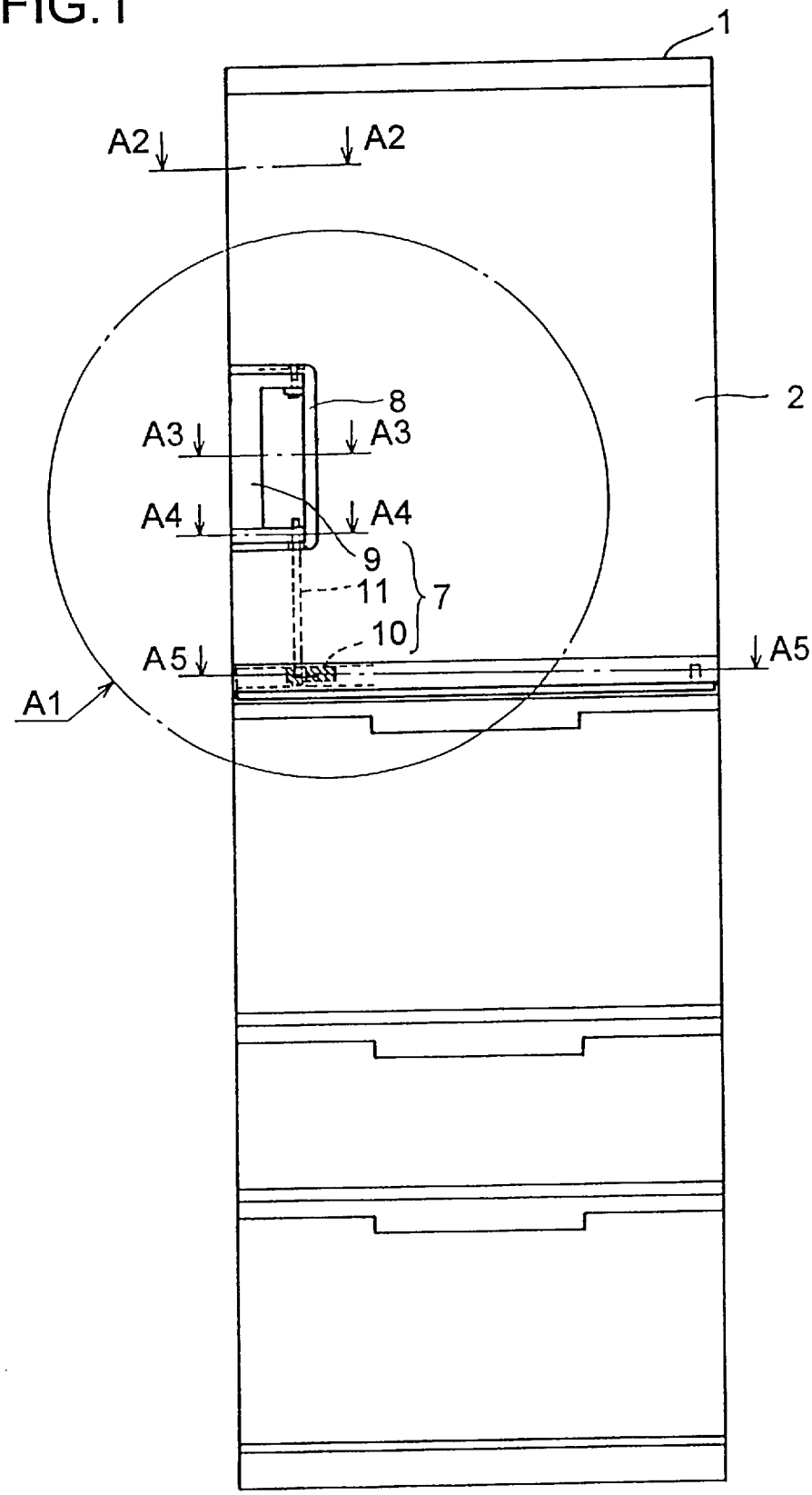
FIG. 1 is a front view of a refrigerator incorporating the door opening/closing mechanism of a first embodiment of the invention.
Figure 2:
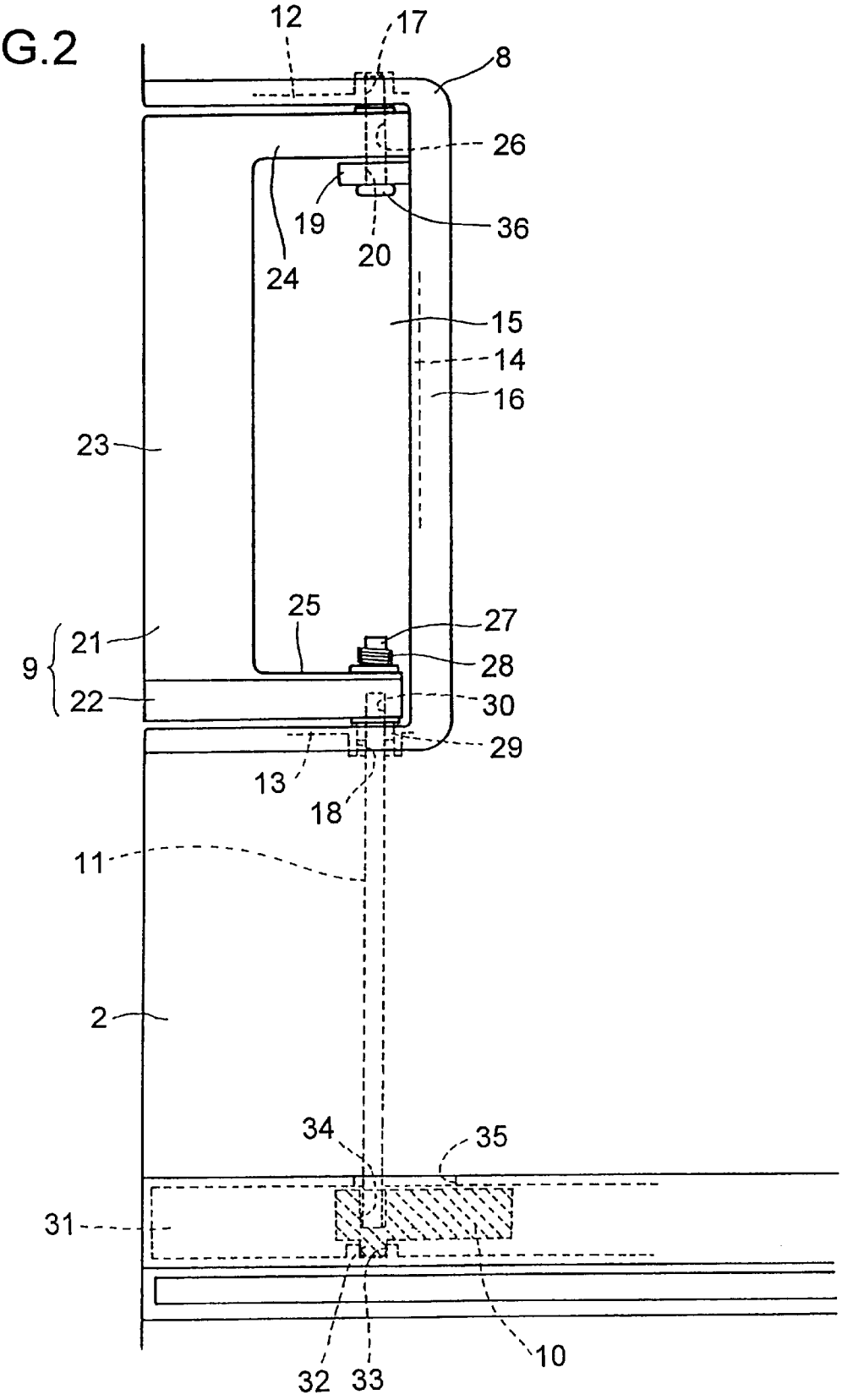
FIG. 2 is an enlarged view of the portion indicated as A1 in FIG. 1.
Figure 3:
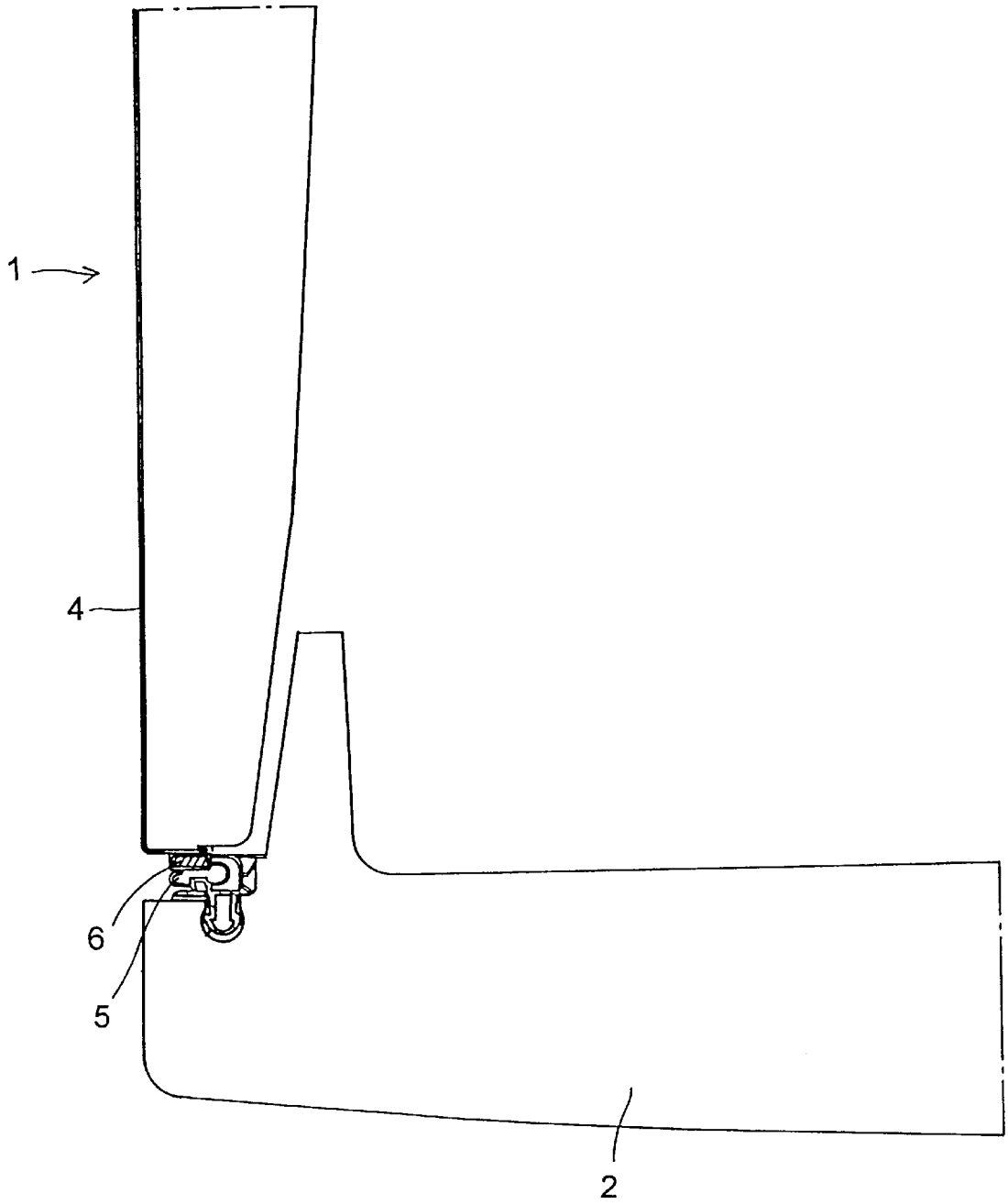
FIG. 3 is a sectional view taken along line A2—A2 of FIG. 1.
Figure 4:
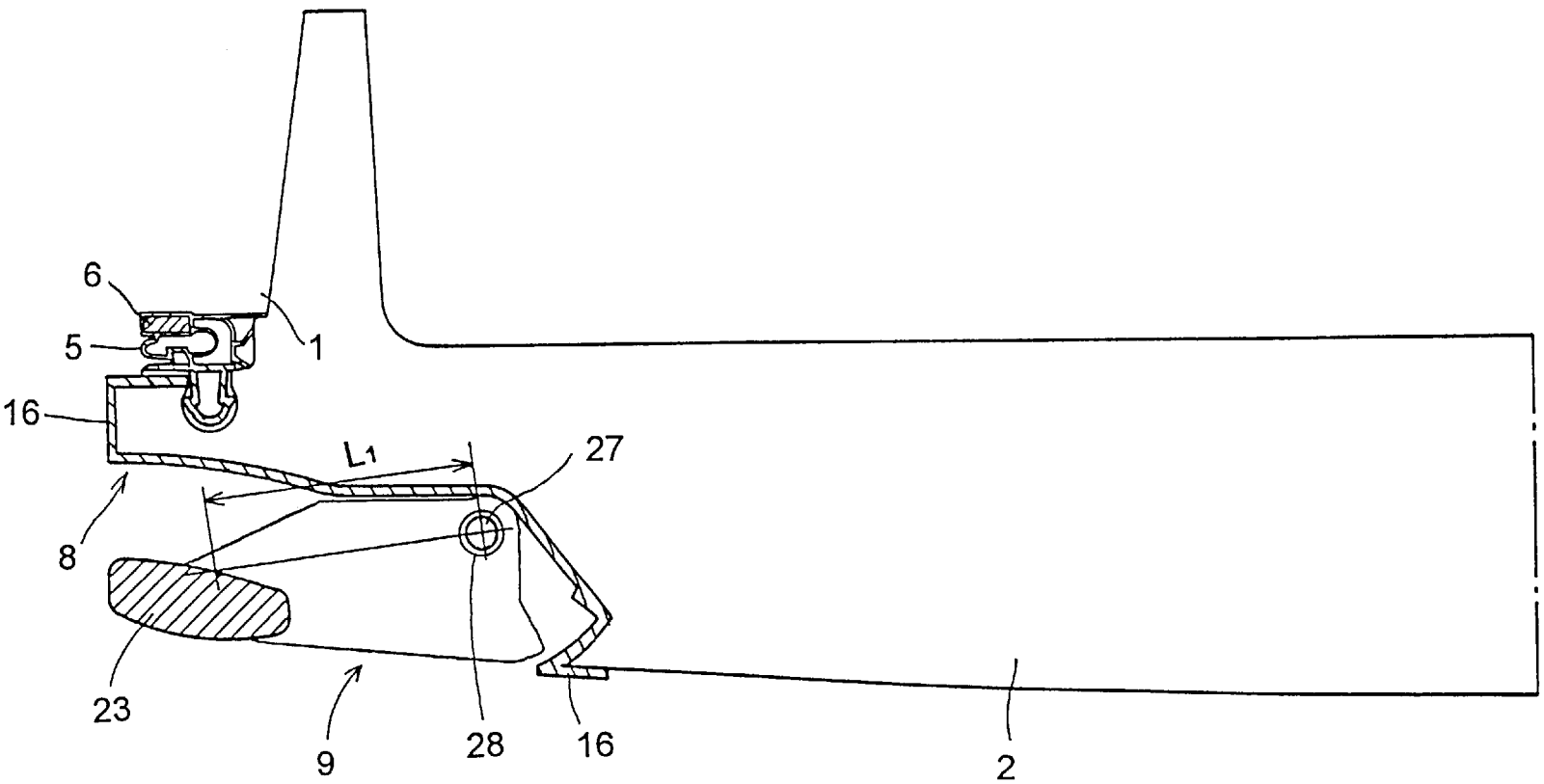
FIG. 4 is a sectional view taken along line A3—A3 of FIG. 1.
Figure 5:
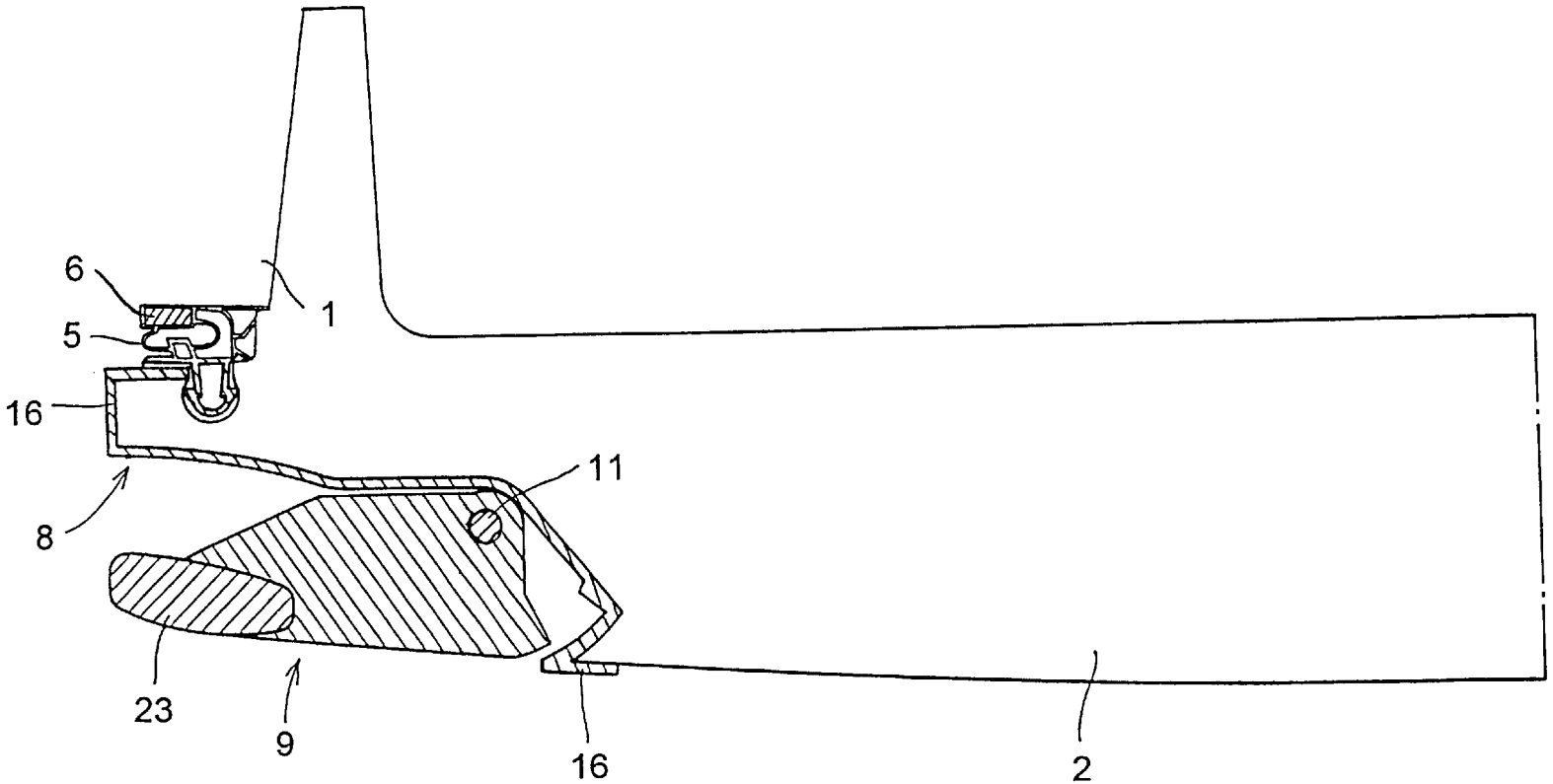
FIG. 5 is a sectional view taken along line A4—A4 of FIG. 1.
Figure 6:
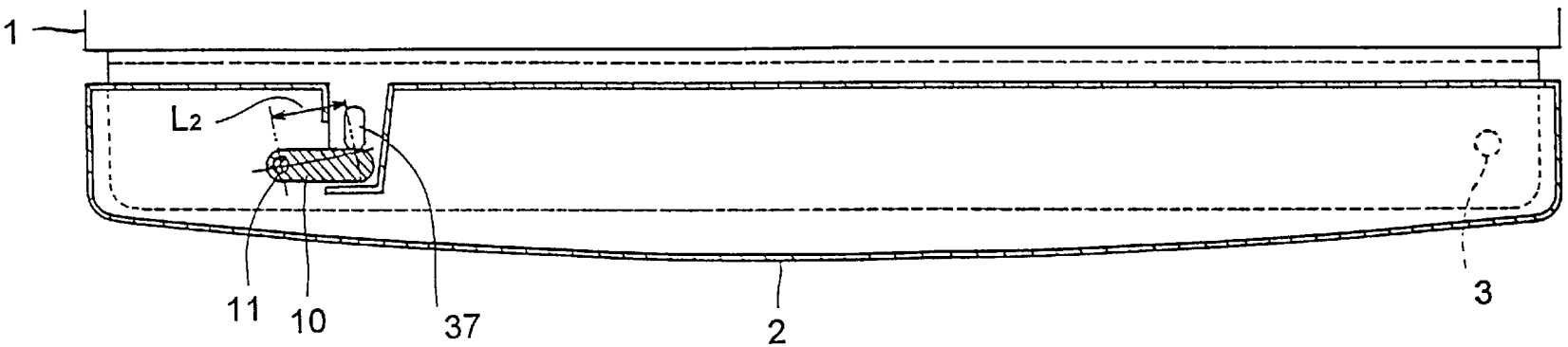
FIG. 6 is a sectional view taken along line A5—A5 of FIG. 1.
Figure 7:
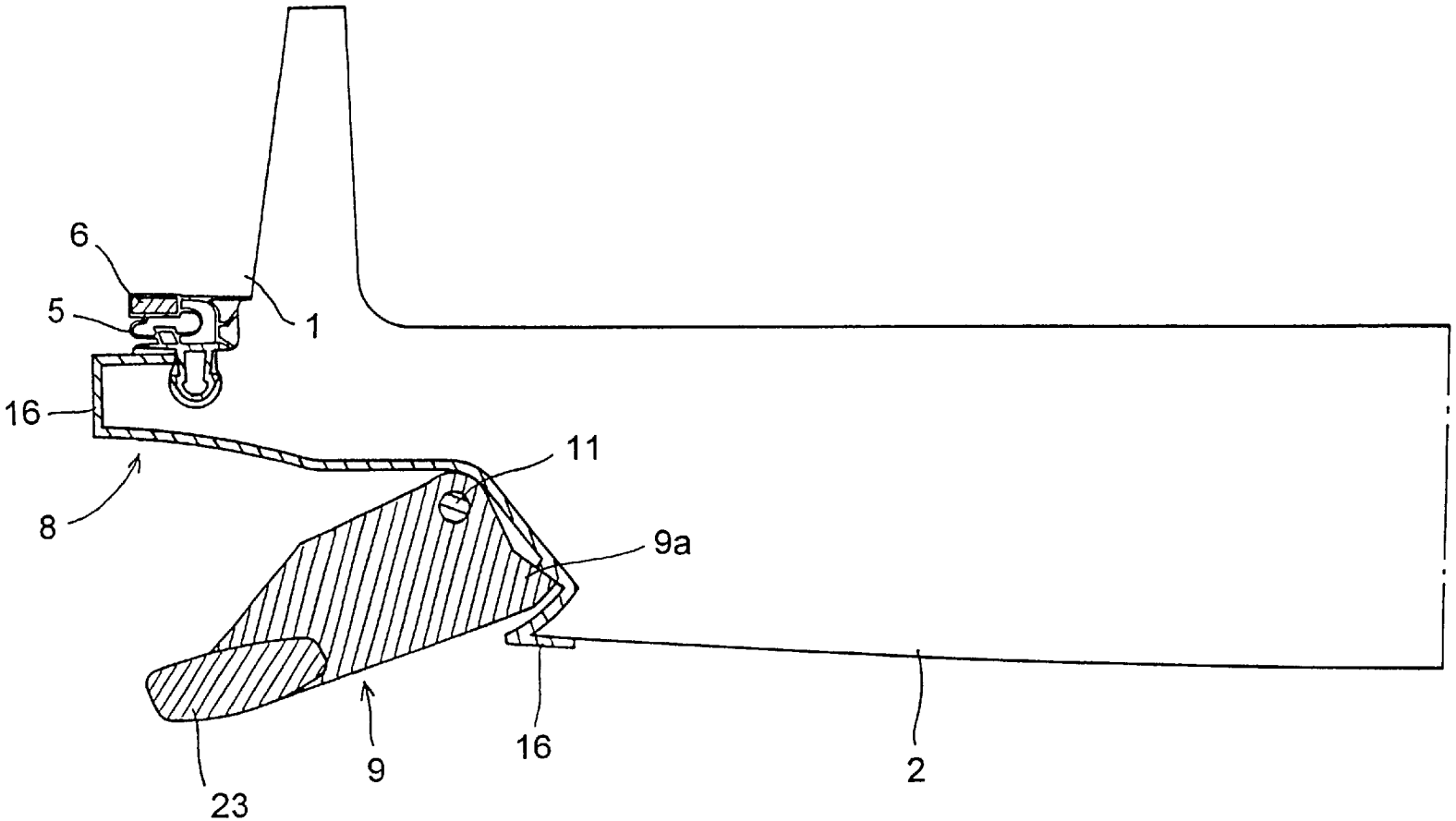
FIG. 7 is a plan view of the handle portion of the door opening/closing mechanism of the first embodiment, when the door is opened.
Figure 8:
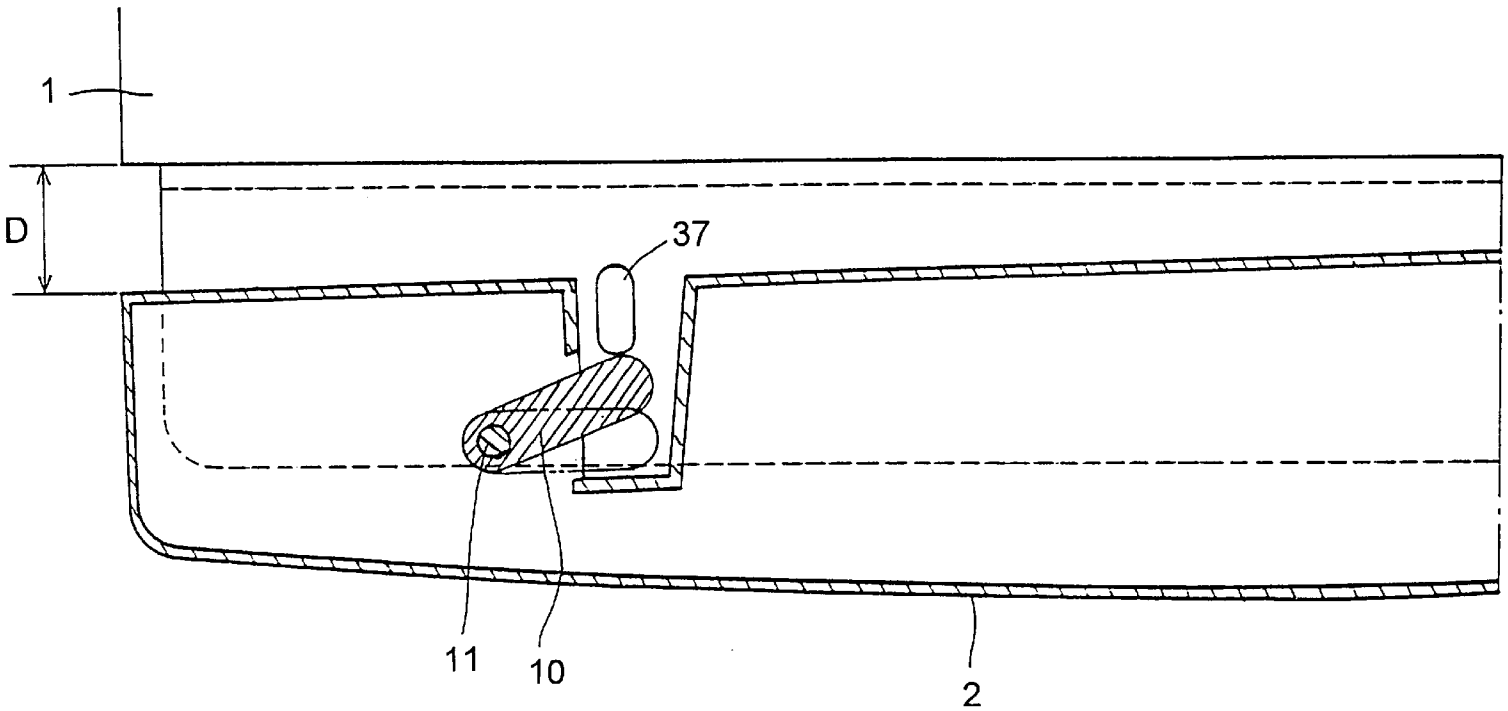
FIG. 8 is a plan view of the arm portion of the door opening/closing mechanism of the first embodiment, when the door is opened.

Hereinafter, embodiments of the present invention will be described with reference to the accompanying drawings. FIG. 1 is a front view of a refrigerator incorporating the door opening/closing mechanism of a first embodiment of the invention. FIG. 2 is an enlarged view of the portion indicated as A1 in FIG. 1. FIG. 3 is a sectional view taken along line A2—A2 of FIG. 1. FIG. 4 is a sectional view taken along line A3—A3 of FIG. 1. FIG. 5 is a sectional view taken along line A4—A4 of FIG. 1. FIG. 6 is a sectional view taken along line A5—A5 of FIG. 1. FIG. 7 is a diagram showing the state in which the handle shown in FIG. 5 is pulled. FIG. 8 is an enlarged view of a principal portion of FIG. 6, and shows the action of the arm when the handle is pulled.

The refrigerator of this embodiment has a box-shaped refrigerator body 1, whose inside is divided into a plurality of compartments arranged vertically. Each compartment of the refrigerator has an opening at the front, and the topmost compartment is fitted with a door 2 that is rotatable in a horizontal direction. As shown in FIG. 6, this door 2 is pivoted on the refrigerator body 1 by a door rotation pivot 3 that is provided at the right side of the door 2 so as to extend vertically. The door 2 opens and closes the opening, by being rotated about the door rotation pivot 3.

As shown in FIG. 3, the refrigerator body 1 has a box-shaped resin member enclosed in a cabinet 4 made of painted steel sheets. At the front end, the cabinet 4 is bent inward so as to form the rim of the opening. On the inner surface of the door 2, a gasket 5 is fitted all around the edges thereof. The gasket 5 incorporates a magnet 6. The magnet 6, by its magnetic force, attracts the cabinet 4 around the rim of the opening, and thereby keeps the gasket 5 in close contact with the cabinet 4 so as to keep the door 2 closed.

As shown in FIG. 1, the door 2 is, at the free-end side thereof, fitted with a door opening/closing mechanism 7. The door opening/closing mechanism 7 has a handle 9, an arm 10, and a lower shaft 11. The handle 9 is rotatably fitted on the door 2 by a handle base 8. The arm 10 is disposed at the bottom of the door 2, and has substantially the shape of an elongated rectangular parallelepiped. The lower shaft 11 couples the handle 9 to arm 10.

The handle base 8 has the shape of a box that is open at the front and at the left side, and, as shown in FIG. 2, has a top wall 12, a bottom wall 13, a right side wall 14, and a rear wall 15. The handle base 8 is fitted into a recessed portion formed in the door 2 at the free-end side thereof and away from both the top and bottom ends thereof. Around the open faces of the handle base 8, a flange 16 is formed.

In a right-hand end portion of the top wall 12 of the handle base 8, a circular through hole 17 is formed. Into this through hole 17, an upper shaft 36, described later, is fitted and is thereby fixed. In a right-hand end portion of the bottom wall 13 of the handle base 8, a circular through hole 18 is formed so as to face the through hole 17. Into this through hole 18, a pivot 29, described later, of the handle 9 is rotatably fitted.

In an upper portion inside the handle base 8, a bracket 19 is formed so as to protrude leftward from the surface of the right side wall 14. In the bracket 19, a substantially circular through hole 20 is formed so as to face the through hole 17. Into this through hole 20, the upper shaft 36 is rotatably fitted.

The handle 9 is composed of a C-shaped handle proper 21 and a shaft support member 22 fitted at the bottom of the handle proper 21. The handle proper 21 is composed of an operation portion 23 extending vertically and an upper support portion 24 and a lower support portion 25 protruding sideways from the top and bottom ends, respectively, of the operation portion 23.

In a tip portion of the upper support portion 24, a circular through hole 26 is formed. Through this through hole 26, the upper shaft 36 is rotatably fitted. On the top surface of a tip portion of the lower support portion 25, a cylindrical projection 27 is formed so as to protrude upward and face the through hole 26. Around the projection 27, a coil spring 28 is fitted so as to load the handle proper 21 with a force that tends to rotate it clockwise.

The shaft support member 22 is so shaped as to be fitted on the lower support portion 25 by being slid in the direction opposite to the direction in which the lower support portion 25 protrudes (i.e. by being slid from right to left as seen in the drawing). On the bottom surface of a tip portion of the shaft support member 22, a cylindrical pivot 29 is formed so as to protrude downward and be coaxial with the projection 27

Moreover, in the shaft support member 22, a shaft fitting hole 30 is formed so as to be coaxial with the pivot 29. Into the shaft fitting hole 30, the upper end of the lower shaft 11 is fitted, and is fixed so as not to rotate with bond, with a key, or by other means.

The arm 10 is disposed in an arm chamber 31 formed at the bottom of the door 2. On the bottom surface of the arm 10, near one end thereof, a cylindrical pivot 32 is formed so as to protrude downward. On the floor surface of the arm chamber 31, a circular pivot support hole 33 having an elevated rim is formed. The pivot 32 is rotatably fitted into the pivot support hole 33 so that the arm 10 can rotate in a horizontal direction while being supported levelly.

Moreover, in a pivoted-end portion of the arm 10, a circular shaft insertion hole 34 is formed so as to extend downward from the top surface of the arm 10 and be coaxial with the pivot 32. Into this shaft insertion hole 34, the lower end of the lower shaft 11 is fitted, and is fixed so as not to rotate with bond, with a key, or by other means.

Inside the door 2, between the recessed portion in which the handle base 8 is fitted and the arm chamber 31, a hollow portion is secured through which the lower shaft 11 is fitted. In the ceiling surface of the arm chamber 31, an opening 35 is formed through which the lower end of the lower shaft 11 is fitted.

The door opening/closing mechanism 7 is fitted on the door 2 through the following procedure. First, the handle base 8 is fitted into the recessed portion of the door 2, and is fixed to the door 2 with screws or the like. The arm 10 is inserted into the arm chamber 31, and the pivot 32 of the arm 10 is fitted into the pivot support hole 33 formed on the floor surface of the arm chamber 31.

The upper end of the lower shaft 11 is fitted into the shaft fitting hole 30 of the shaft support member 22, now still separate from the handle proper 21. The lower end of the lower shaft 11 is inserted in the through hole 18 of the bottom wall 13 of the handle base 8 so as to reach into the arm chamber 31, and is fitted into the shaft insertion hole 34 of the arm 10. Then, the pivot 29 of the shaft support member 22 is fitted into the through hole 18 of the handle base 8.

Next, the spring 28 is fitted around the projection 27 of the lower support portion 25 of the handle proper 21, and one end of the spring 28 is engaged with a predetermined portion of the lower support portion 25. The lower support portion 25 of the handle proper 21 is slid along and thereby fitted on the shaft support member 22. Then, the other end of the spring 28 is engaged with a predetermined portion of the handle base 8.

The pin-shaped upper shaft 36 is inserted, from below, in the through hole 20 of the bracket 19 and then in the through hole 26 of the upper support portion 24 of the handle proper 21. The tip end of the upper shaft 36 is fitted into the through hole 17 of the top wall 12 of the handle base 8. Thus, the handle 9 is rotatably supported on the handle base 8 by the upper shaft 36 and the pivot 29, and this is the end of the fitting of the door opening/closing mechanism 7.

The handle 9 is fitted on the handle base 8 with a gap secured between the handle 9 and the handle base 8 fitted behind the operation portion 23. Accordingly, the user normally operates the handle 9 by reaching, with the finger tips, the rear surface of the operation portion 23 from the free-end side thereof. Alternatively, the user can operate the handle 9 also by reaching, with the finger tips, the rear surface of the operation portion 23 from the rotation axis (the center axes of 29 and 36) side thereof. This permits the user to operate with either of his right and left hands and thereby enhances ease of operation.

As shown in FIG. 6, in the refrigerator body 1, a projection 37 that makes contact with a free-end portion of the arm 10 is formed in a portion of the rim of the opening that faces the arm 10. Here, if it is assumed that, as shown in FIG. 4, the distance from the point on which the force applied to operate the operation portion 23 acts to the center axis of the projection 27 (concentric with the rotation axis, i.e. the center axes of 29 and 36) is $L_1$ and that, as shown in FIG. 6, the distance from the point at which the arm 10 makes contact with the projection 37 to the center axis of the lower shaft 11 (concentric with the rotation axis, i.e. the center axes of 29 and 36) is $L_2$, then the distance $L_1$ is longer than the distance $L_2$.

Next, the workings of the door opening/closing mechanism 7 constructed as described above will be described. When the operation portion 23 of the handle 9 is held with a hand and pulled forward, the arm 10 receives a force that tends to rotate it counter-clockwise about the lower shaft 11 (see FIG. 6). The free-end portion of the arm 10 presses the projection 37, and thus the door 2 receives a force that tends to rotate it counter-clockwise about the door rotation pivot 3. As a result, the gasket 5 starts being released, against the magnetic force of the magnet 6, from the cabinet 4 around the rim of the opening.

When, as shown in FIG. 7, the handle 9 is pulled until a stopper portion 9*a* of the handle 9 makes contact with the handle base 8, then, as shown in FIG. 8, the door 2 is located a predetermined distance D away from the rim of the opening of the refrigerator body 1. In this state, when the handle 9 is pulled further forward, the door 2 rotates counter-clockwise about the door rotation pivot 3 (see FIG. 6). In this way, the opening of the refrigerator body 1 thus far closed by the door 2 is opened so that articles can be put into and taken out of the refrigerator.

Here, as described above, the distance $L_1$ (see FIG. 4) is longer than the distance $L_2$ (see FIG. 6). Thus, on the principle of the action of a lever, the door 2 can be brought open by the predetermined distance D with a very weak force. Moreover, the arm 10 is disposed at the bottom of the door 2, i.e. away from the handle 9, and is thus inconspicuous enough to permit the door opening/closing mechanism to be given an acceptable design.

Moreover, when the door 2 is opened further from its position the predetermined distance D away from the refrigerator body 1, the attraction exerted between the door 2 and the refrigerator body 1 by the magnet 6 is already so weak that the door 2 can be opened with a weak force. Furthermore, in this embodiment, the direction of the force applied to the operation, portion 23 of the handle 9 coincides with the direction in which the door 2 is opened. This permits the action of opening the door 2 by the predetermined distance D first and the action of opening the door 2 further from that position to be performed as a smoothly continuous sequence of operation, and thus makes the door 2 easy to open.

Figure 9:
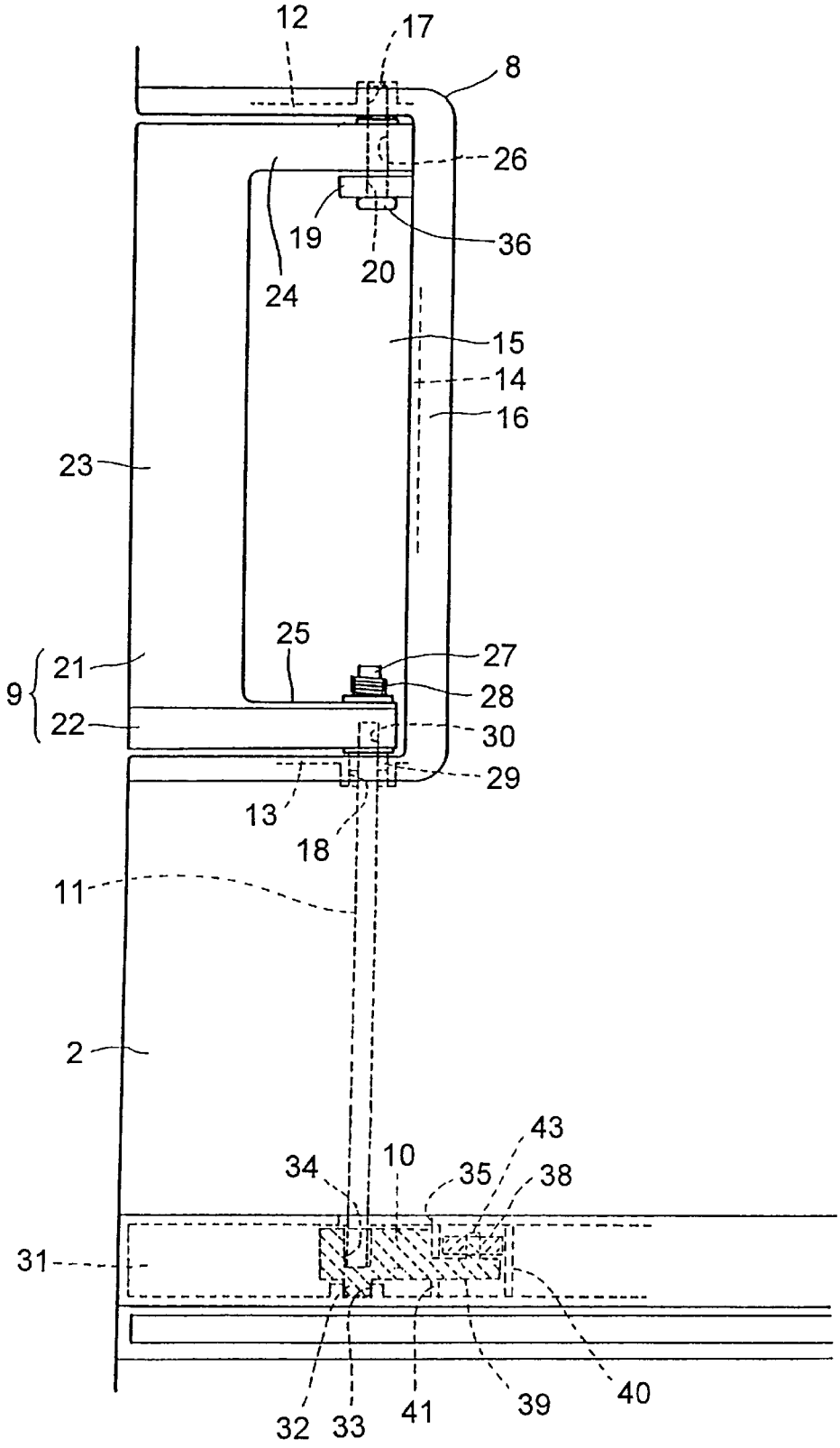
FIG. 9 is a front view of the door opening/closing mechanism of a second embodiment of the invention.
Figure 10:
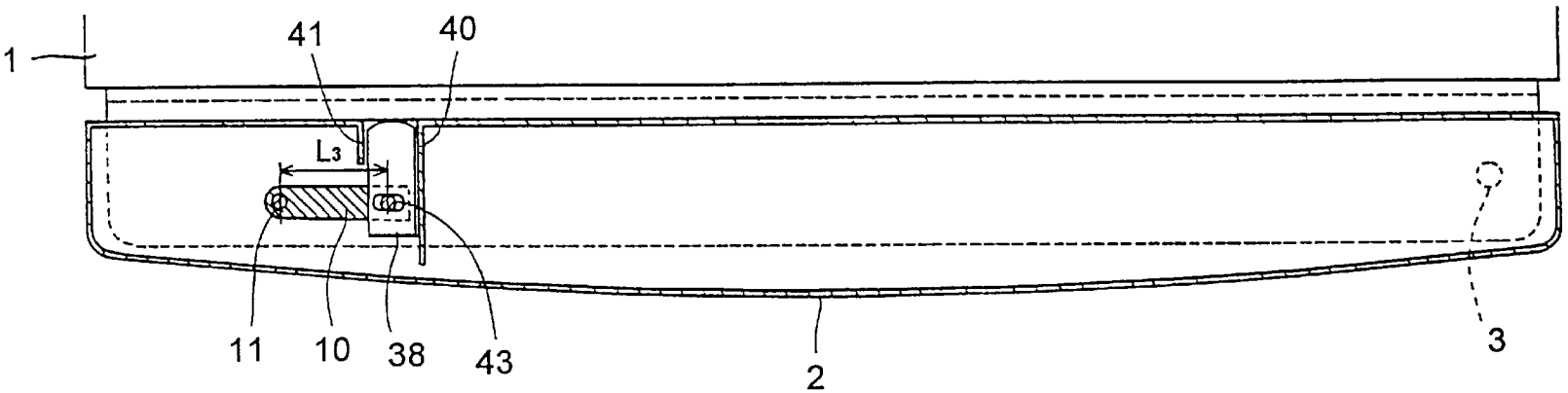
FIG. 10 is a plan view of the arm portion of the door opening/closing mechanism of the second embodiment.
Figure 11:
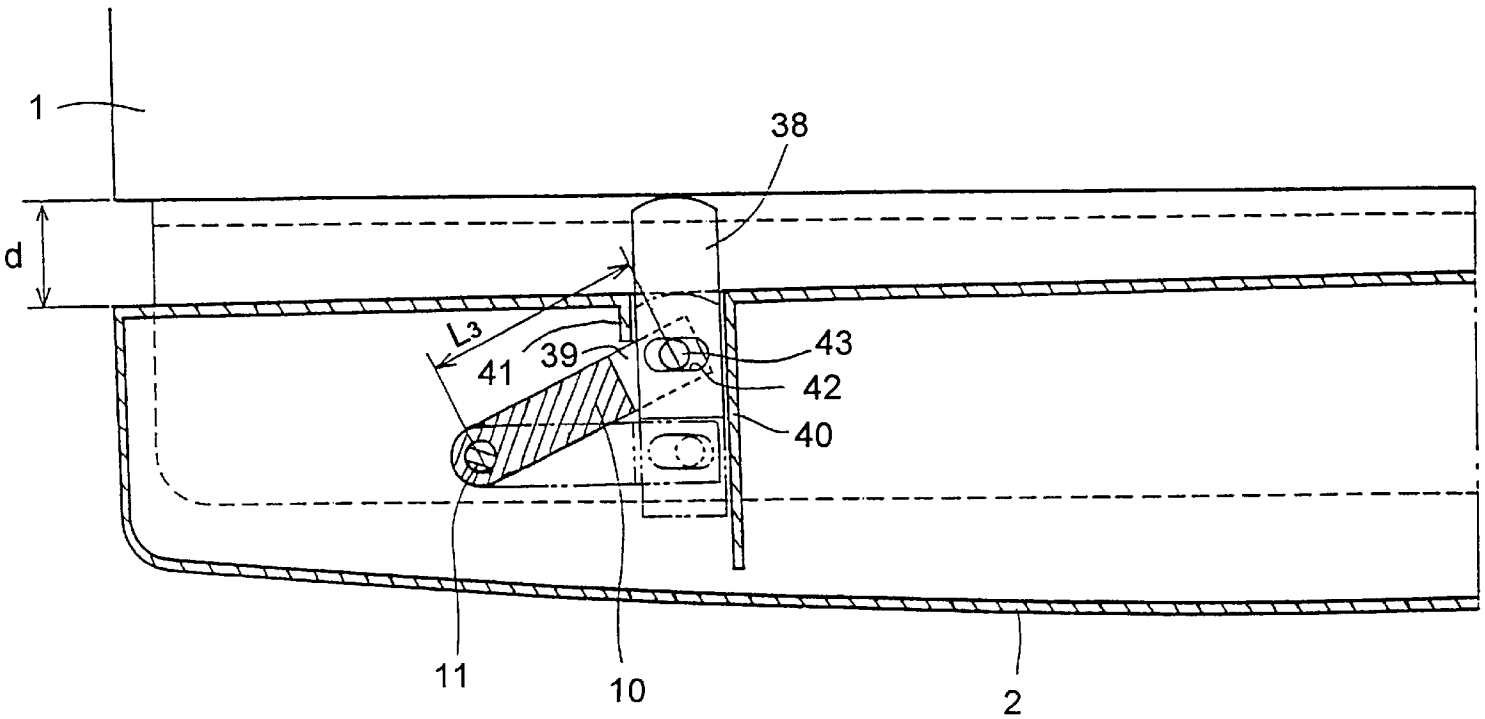
FIG. 11 is a plan view of the arm portion of the door opening/closing mechanism of the second embodiment, when the door is opened.

Next, a second embodiment of the invention will be described. In the drawings and descriptions of this embodiment, such components as find their counterparts in the first embodiment are identified with the same reference numerals, and overlapping descriptions will not be repeated. A refrigerator incorporating the door opening/closing mechanism of the second embodiment has the same appearance as that of the first embodiment shown in FIG. 1 and described above. FIG. 9 is an enlarged view of the portion indicated as A1 in FIG. 1. FIG. 10 is a sectional view taken along line A5—A5 of FIG. 1. FIG. 11 is an enlarged view of a principal portion of FIG. 10, and shows the action of the slide member when the handle 9 is pulled. Moreover, FIGS. 3, 4, and 5 described earlier apply also here as sectional views taken along lines A2—A2, A3—A3, and A4—A4, respectively, of FIG. 1.

As shown in FIGS. 9 and 11, in this embodiment, the free-end portion of the arm 10 is formed into a thin portion 39 having a smaller thickness. Over the thin portion 39, a slide member 38 having the shape of an elongated plate is disposed so as to overlap the top surface of the thin portion 39. The slide member 38 is supported by a pair of guide ribs 40 and 41 that extend in the longitudinal direction in such a way that the slide member 38 can slide back and forth. One end of the slide member 38 faces a portion of the rim of the opening of the refrigerator body 1.

In the slide member 38, an elongated hole 42 is formed so as to extend in the lateral direction. With this elongated hole 42, a cylindrical pin 43 formed on the top surface of the thin portion 39 so as to protrude upward is slidably engaged. Here, if it is assumed that the distance from the point at which the arm 10 is connected to the slide member 38 to the center axis of the lower shaft 11 (i.e. the center axes of 29 and 36) is $L_3$, then the distance $L_1$ (see FIG. 4) is longer than the distance $L_3$.

In this refrigerator constructed as described above, when the operation portion 23 of the handle 9 is held with a hand and pulled forward, as shown in FIG. 11, the arm 10 receives a force that tends to rotate it counter-clockwise about the lower shaft 11. The slide member 38 is guided by the guide ribs 40 and 41 to move toward the refrigerator body 1 until pressed against the refrigerator body 1. Thus, the door 2 receives a force that tends to rotate it counter-clockwise about the door rotation pivot 3. As a result, the gasket 5 starts being released, against the magnetic force of the magnet 6, from the portion of the cabinet.4 that forms the rim of the opening.

As in the first embodiment, when the handle 9 is pulled until the stopper portion 9*a* of the handle 9 makes contact with the handle base a (see FIG. 7), the handle 9 stops rotating. Now, as shown in FIG. 11, the door 2 is open by a predertermind distance d with respect to the refrigerator body 1. In this state, when the handle 9 is pulled further forward, the door 2 rotates counter-clockwise about the door rotation pivot 3. In this way, the opening of the refrigerator compartment thus far closed by the door 2 is opened so that articles can be put into and taken out of the refrigerator.

Here, as described above, the distance $L_1$ (see FIG. 4) is longer than the distance $L_3$ (see FIG. 11). Thus, on the principle of the action of a lever, the door 2 can be brought open by the predetermined distance with a very weak force.

Moreover, the slide member 38 is disposed at the bottom of the door 2, i.e. away from the handle 9, and is thus inconspicuous enough to permit the door opening/closing mechanism to be given an acceptable design. Furthermore, in this embodiment, the front face of the refrigerator body 1 can be made flat including the portion thereof with which the slide member 38 makes contact, and is thus easy to clean and design.

The first and second embodiments deal with cases where the door 2 is rotatably fitted to the refrigerator body 1 by the rotation pivot However, the constructions of those embodiments can be applied also in cases where a drawer-type door is moved back and forth so as to be opened and closed. Specifically, in such a case, the handle 9 is fitted in an upper, laterally central portion of the door, and the components that rotatably support the handle 9 (i.e. the pivot 29 and the shaft fitting hole 30) are arranged horizontally below the operation portion 23 of the handle 9. Moreover, the arm 10 or the slide member 28 is fitted at least at one side of the door 2. In this way, it is possible to achieve the same effects as in the cases described previously.

Furthermore, in this case, the handle 9 can be operated by reaching, with the fingertips, the rear surface of the handle 9 from above the handle 9. This makes it possible, in cases where the handle 9 is located lower than the user's elbows (for example where a drawer-type door is provided roughly below the vertical center of the cabinet), to move the handle 9 downward by using the weight of an arm of the user. This helps further enhance ease of operation.

The constructions of the first and second embodiments can be applied also in cases where the door 2 is fitted horizontally on the cabinet 4 so as to cover the top face thereof and is pivoted at the rear end of the door 2. Specifically, in such a case, the handle 9 is fitted at the front end of the door, and the components that rotatably support the door are arranged horizontally on that side of the operation portion 23 of the handle 9 which is closer to the longitudinal center of the door. Moreover, the arm 10 or the slide member 28 is fitted at least at one side of the door. In this way, it is possible to achieve the same effects as in the cases described previously.

Figure 12:
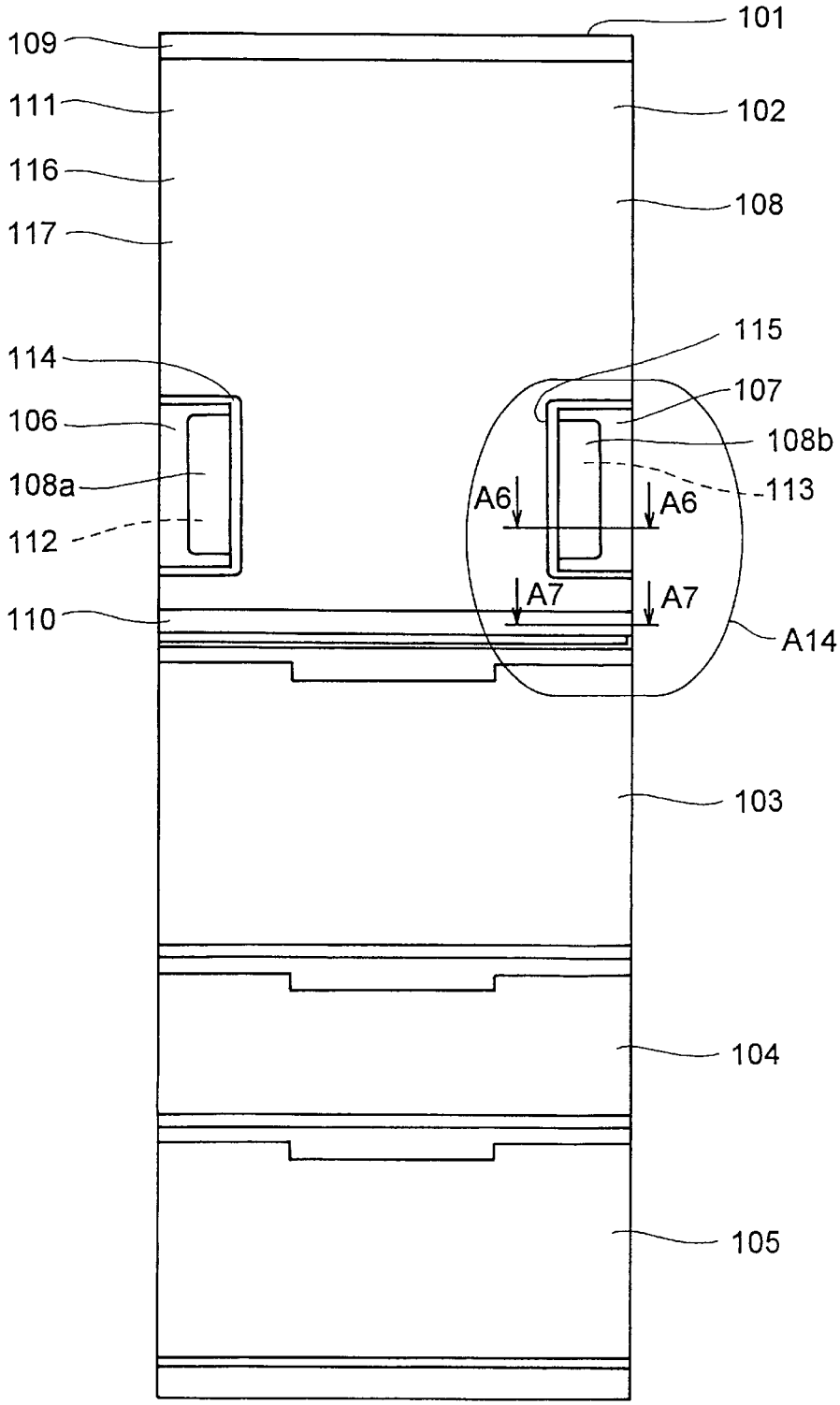
FIG. 12 is a front view of a refrigerator incorporating the door opening/closing mechanism of a third embodiment of the invention.
Figure 13:
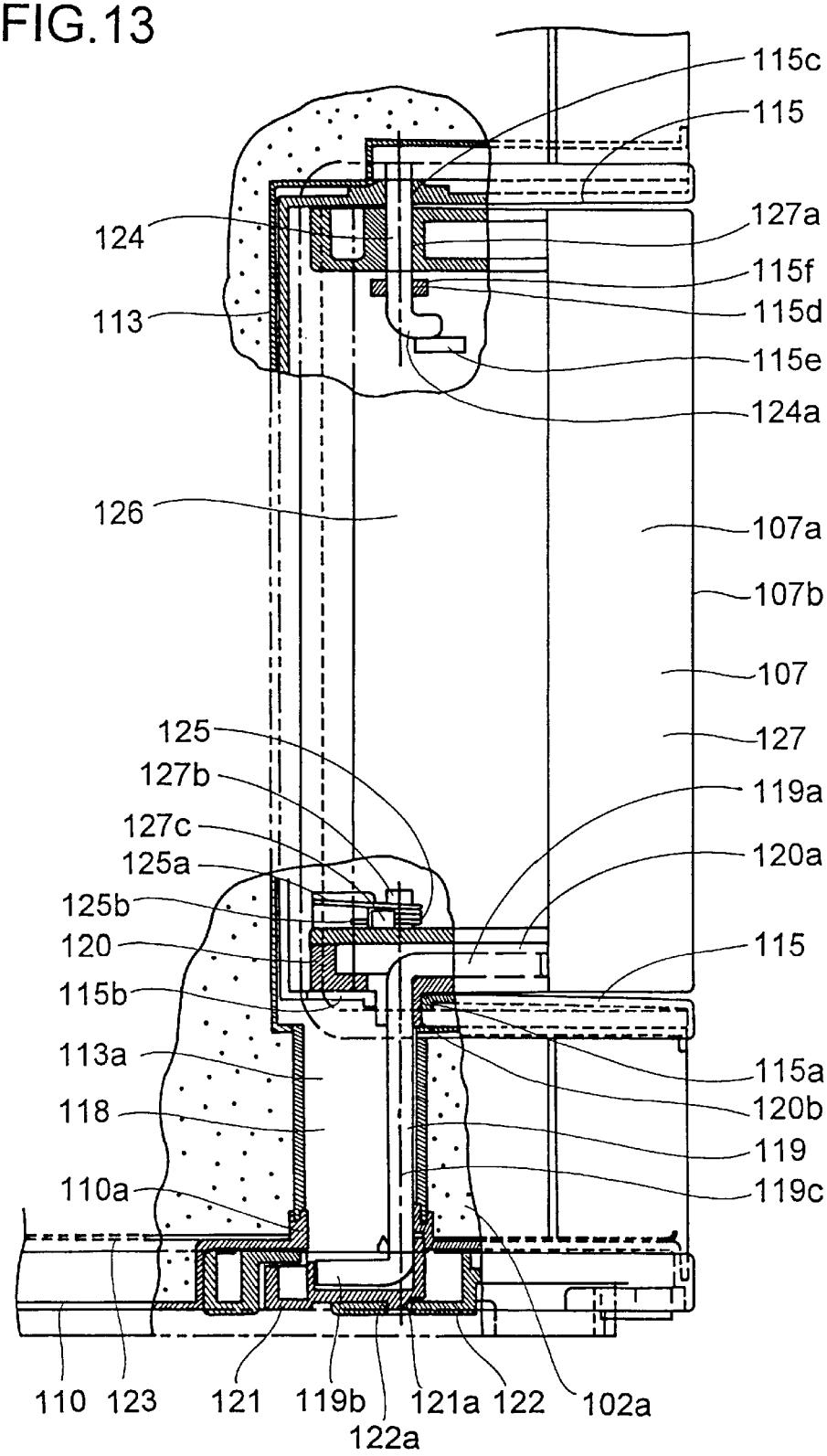
FIG. 13 is an enlarged view of the portion indicated as A14 in FIG. 12.
Figure 14:
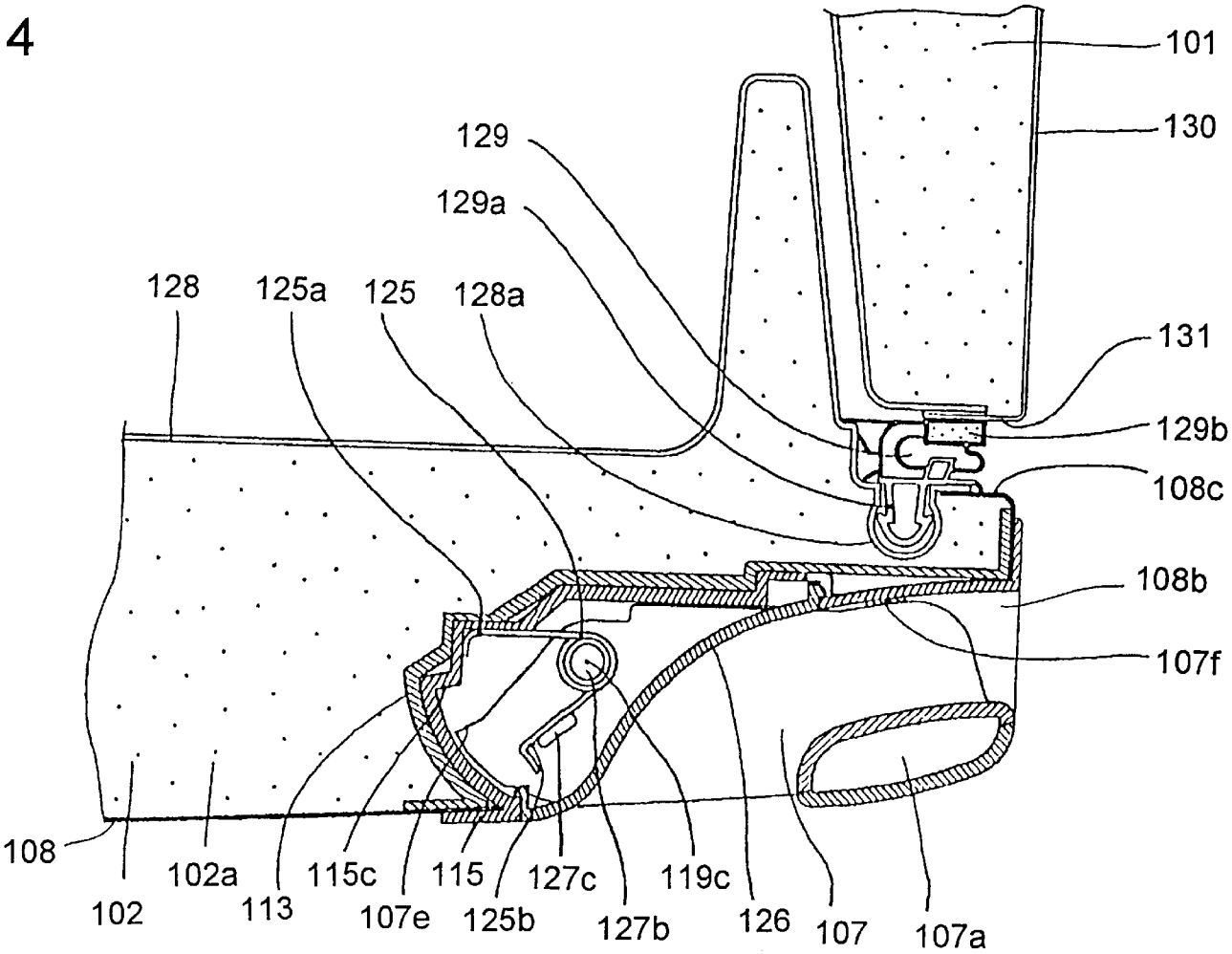
FIG. 14 is a sectional view taken along line XIV—XIV of FIG. 12.
Figure 15:
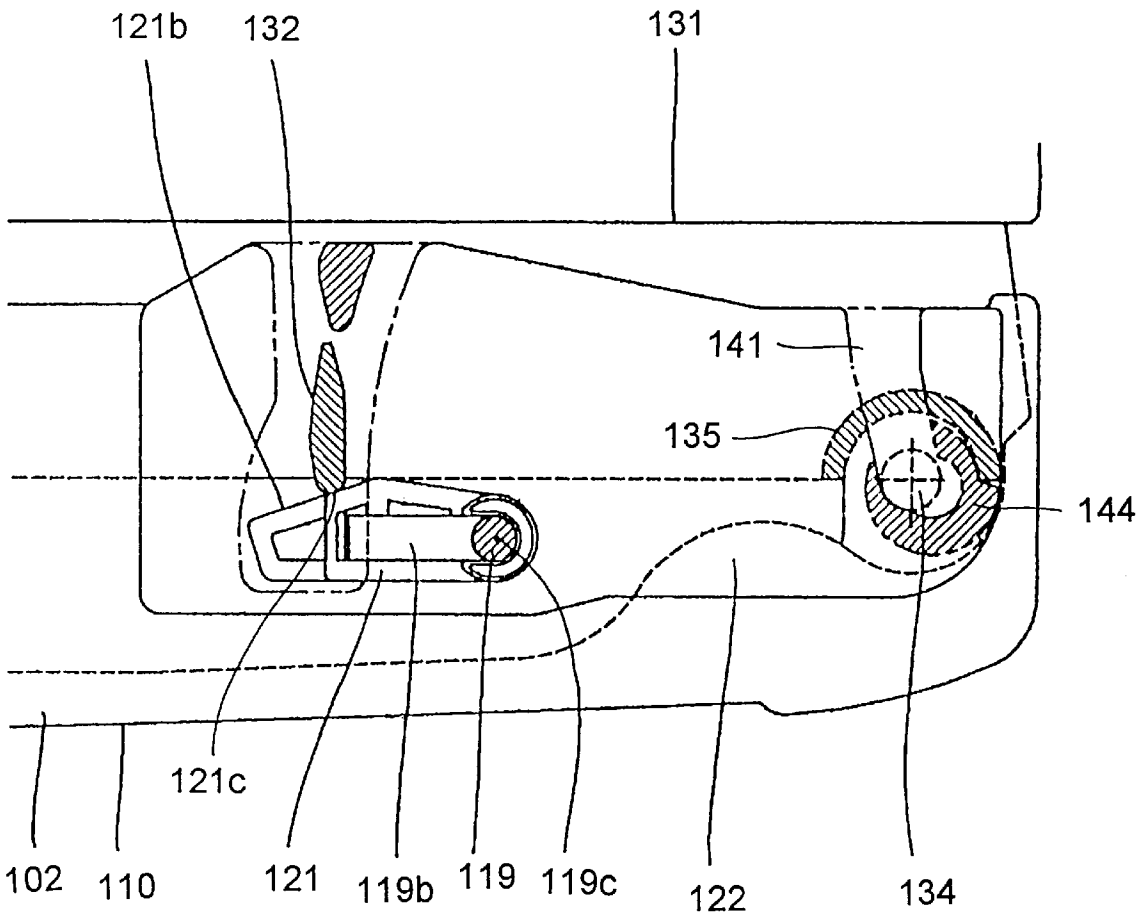
FIG. 15 is a sectional view taken along line XVII—XVII of FIG. 12.

Next, a third embodiment of the invention will be described. FIG. 12 is a front view of a refrigerator incorporating the door opening/closing mechanism of the third embodiment. FIG. 13 is an enlarged view of the portion indicated as A14 in FIG. 12. FIG. 14 is a sectional view taken along line XIV—XIV of FIG. 12. FIG. 15 is a sectional view taken along line XV—XV of FIG. 12.

In FIG. 12, reference numeral 101 represents a refrigerator body, reference numeral 102 represents a refrigerator compartment door, reference numeral 103 represents a vegetable compartment door, reference numeral 104 represents a freezer compartment door, and reference numeral 105 represents a freezer compartment door. The refrigerator body 101 has separate compartments corresponding to the individual doors mentioned just above and each having an opening at the front. The refrigerator compartment door 102 is of a type that can be opened at either the right or left side thereof, and has handles 106 and 107, each having a lever mechanism, respectively at the right and left sides thereof. The vegetable compartment door 103 and the freezer compartment doors 104 and 105 are each of a drawer type that can be drawn out and pushed in in the longitudinal direction.

Figure 16:
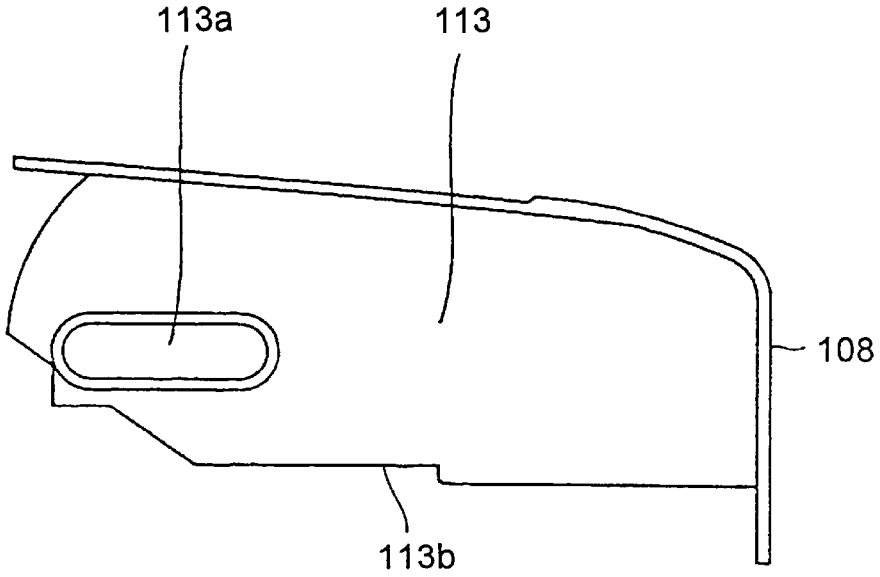
FIG. 16 is a bottom view of the handle support of the door opening/closing mechanism of the third embodiment.

The refrigerator compartment door 102 is formed as a box-shaped member 111 composed of a door plate 108 that is bent rearward at the right and left ends thereof and an upper and a lower door cap 109 and 110 that are respectively fitted into the upper and lower ends of the door plate 108. In the refrigerator compartment door 102, openings 108*a* and 108*b* are formed by, cutting out parts of the door plate 108. In the openings 108*a* and 108*b*, handle supports 112 and 113 are respectively fitted from behind the refrigerator compartment door 102. As shown in FIG. 16, which shows the handle support 113 as seen from below, the opening 108*b* is isolated from the inside of the door plate 108 by a wall 113*b*. The handle support 112 has the same structure.

Figure 17:
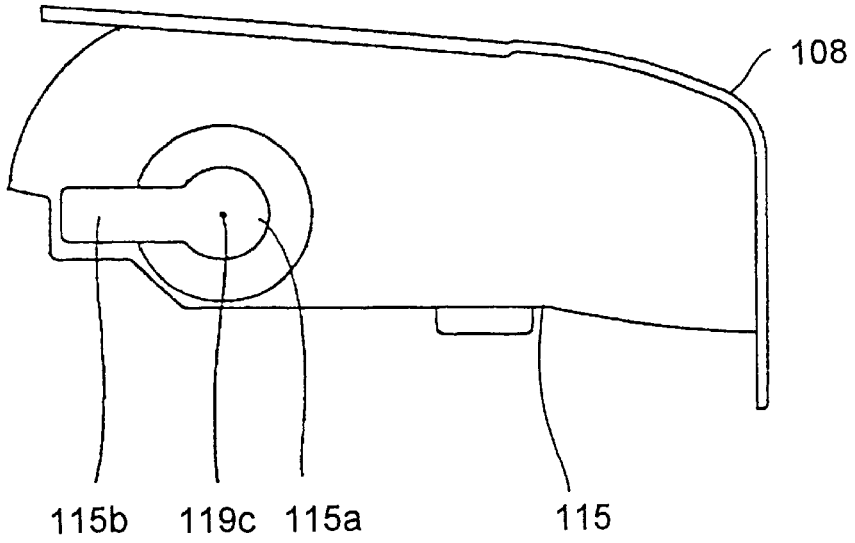
FIG. 17 is a bottom view of the handle base of the door opening/closing mechanism of the third embodiment.

In the handle supports 112 and 113, handle bases 114 and 115 are fitted by being inserted in the openings 108*a* and 108*b* obliquely from the front. As shown in FIG. 17, which shows the handle base 115 as seen from below, the handle base 115 is fitted outside the handle support 113 and is fixed to the door plate 108 with screws (not shown) that are inserted from inside the refrigerator compartment door 102 with the door plate 108 (see FIG. 14) sandwiched in between. The handle base 114 has the same structure.

The box-shaped member 111, the handle supports 112 and 113, and the handle bases 114 and 115 are assembled together to form a refrigerator compartment door base first-stage assembly 116. In this assembly 116, wherever there is a gap between its constituent components, a seal (not shown) is applied from inside the refrigerator compartment door 102 to achieve proper sealing. The handle supports 112 and 113 are not visible from the outside, and therefore, in FIG. 12, their outlines are not shown but their rough positions are indicated by broken-line leaders.

The refrigerator compartment door first-stage assembly is placed in a foaming fixture, and a raw material of urethane foam is injected into the assembly 116 through an opening (not shown) formed at the back. This opening is then closed with a back plate (not shown) fitted at the back of the assembly 116. Thereafter, with a lid put on the foaming fixture, the raw material is formed into urethane foam. After completion of the foaming process, the assembly 116 is taken out of the foaming fixture. In this way, a refrigerator compartment door second-stage assembly 117 is obtained that has a heat insulator 102*a* (see FIG. 13) of urethane foam inside it. The heat insulator 102*a* may be made of any other foam material, or of glass wool or the like.

As mentioned above, FIG. 13 is a detail view of the portion A14 of FIG. 12, i.e. the portion around the right-hand handle 107, and includes partial sectional views that illustrate the internal structure. The portion around the left-hand handle 106 of the refrigerator compartment door 102 has a structure reversed left to right as compared with that shown in FIG. 12.

At the bottom of the handle base 115, which is located in front of the handle support 113, a keyhole-shaped keyhole 115*b* (see FIG. 17) is formed. The keyhole 115*b* is formed by forming a circular hole 115*a* and then forming a substantially rectangular cut that extends therefrom with a width smaller than the diameter of the circular hole 115*a*.

The handle support 113 has a cavity 113*a* (see FIG. 16), having an elongated circular cross section, that faces the keyhole 115*b*. The cavity 113*a* reaches down to the lower door cap 110, in which a hole 110*a*; having a similar elongated circular cross section is formed. The keyhole 115*b*, the cavity 113*a*, and the hole 110*a* communicate with one another so as to form a continuous space 118 as a whole.

The cavity 113*a* and the hole 110*a* of the lower door cap 110 are fitted to each other in such a way that, when the raw material of urethane foam is injected into the box-shaped member so as to be foamed, the urethane foam does not leak into the space 118; if necessary, a seal may be applied where the cavity 113*a* and the hole 110*a* are fitted together. In this way, the space 118 and the portion around it are isolated from the heat insulator 102*a*.

The handle 107 is composed of a C-shaped handle proper 127 and a shaft support member 120 fitted at the bottom of the handle proper 127. A lower shaft 119 is inserted in a cavity 120*a* formed inside the shaft support member 120. An upper and a lower portion of the lower shaft 119 are bent in the shape of L so as to be formed into bent portions 119*a* and 119*b*. The bent portion 119*a* is held by a substantially circular holding portion 120*b* formed at the bottom of the shaft support member 120 so as to protrude downward. After the lower shaft 119 and the shaft support member 120 are assembled together, the bent portion 119*b* is inserted in the keyhole 115*b* of the handle base 115.

Then, the holding portion 120*b* of the shaft support member 120 is fitted into the circular hole 115*a* of the handle base 115. Thus, the shaft support member 120, together with the lower shaft 119, is rotatably fitted on the handle base 115. The bent portion 119*a* of the lower shaft 119 is fixed to the holding portion 120*b* of the shaft support member 120 by tight fitting, with bond, or by other means.

Part of the lower shaft 119 is inserted in the space 118, and the lower bent portion 119*b* of the lower shaft 119 reaches into the lower door cap 110. Therefore, the space 118 is so shaped as to permit insertion of the bent portion 119*b*. Moreover, on the bent portion 119*b*, a cam lever 121 is fitted that has the point of load of a lever mechanism described later. The cam lever 121 is built in a slide cam member 122.

Furthermore, the upper and lower portions of the lower shaft 119 are respectively formed into the L-shaped bent portions 119*a* and 119*b*, and therefore there is no need to provide a key or form a key groove to prevent rotation of the lower shaft 119 when it is coupled to the shaft support member 120 and to the cam lever 121. This helps simplify the construction of the door opening/closing mechanism, reduce the number of components, and facilitate assembly.

Moreover, the bent portions 119*a* and 119*b* are formed integrally with the lower shaft 119, and are thus rigid. This ensures secure coupling between the shaft support member 120 and the lower shaft 119 and between the cam lever 121 and the lower shaft 119. This also makes it possible to transmit a strong force over a long distance with a simple structure, and thus makes it possible to realize a door opening/closing mechanism that permits a door to be opened with enhanced ease of operation.

Moreover, the bent portion 119*b* can be fitted into and pulled out of the cam lever 121 in the vertical direction. Thus, even after the components described above have been assembled together, it is possible to remove the lower shaft 119 or the shaft support member 120 without removing the slide cam member 122. This makes it possible to disassemble the door opening/closing mechanism from the handle 107 side thereof with the refrigerator compartment door 102 kept fitted on the refrigerator body 101, and thus permits easy repair thereof Moreover, in cases where the bent portions 119*a* and 119*b* are coupled to the shaft support member 120 and the cam lever 121 by tight fitting, variations in the vertical dimensions, fitting angles, and bending angles of these components are readily adsorbed unless such variations are extreme.

The shaft support member 120 and the cam lever 121 may be formed integrally with the lower shaft 119 by die-casting of aluminum, forging, or injection-molding. In that case, the space 118 needs to be made so wide as to permit insertion of the portion corresponding to the cam lever 121 of the component so produced. This additionally requires the handle support 113 to be made larger, but helps make the lower shaft 119, the shaft support member 120, and cam lever 121 rigid. Moreover, this helps reduce the number of components and of production steps, and thus makes it possible to realize a door opening/closing mechanism that suffers less from dimensional variations, offers stable quality, and ensures easy assembly.

Alternatively, the lower shaft 119, the shaft support member 120, and the cam lever 121 may be formed integrally by bending a single bar-shaped material into a desired shape. Specifically, first, a bar-shaped material is bent so as to form portions corresponding to the bent portion 119*a*, the lower shaft 119, the bent portion 119*b*, and the cam lever 121 up to the end thereof Then, the bar-shaped material is reversed to return to the position of a circular boss 121*a* described later, and is then bent to fit the shape of the circular boss 121*a*. Here, the bar-shaped material does not necessarily have a circular cross section as long as it can be rotatably supported at the desired portions thereof. It is possible even to form the lower shaft 119, the cam lever 121, the shaft, support member 120, and the handle proper 127 integrally.

The space 118 and the portion around it are isolated from the heat insulator 102*a*, and thus the heat insulator 102*a* is prevented from leaking into the space 118. This ensures free movement of the lower shaft 119 and the cam lever 121, and thereby permits the door to be opened with enhanced ease of operation.

Furthermore, securing the space 118 makes it possible to insert the bent portion 119*b* together with the lower shaft 119 into the lower door cap 110 even though the door has the foamed heat insulator 102 inside. This helps simplify the structure of the handle of the door, reduce the number of components, and facilitate assembly.

Obviously, these effects can be obtained also with door opening/closing mechanisms like those of the first and second embodiments that have a handle only at one side of a door so that the door can be opened at one side.

On the bottom surface of the cam lever 121, a circular boss 121*a* is formed so as to protrude downward. The center of the circular boss 121*a* lies on the center axis 119*c* of the lower shaft 119. The circular boss 121*a* is rotatably fitted into a hole 122*a* formed in the slide cam member 122. Thus, the cam lever 121 is rotatable about the circular boss 121*a*, and permits the lower shaft 119 and the handle 107 to rotate together. Moreover, the circular boss 121*a* acts as the fulcrum of a lever mechanism.

The slide cam member 122 is fixed to a door angle 123 with screws, with the lower door cap 110 sandwiched in between. As will be described later, the slide cam member 122 has a first grove cam 141 (see FIG. 15) that permits the refrigerator compartment door 102 to be opened at both sides. This slide cam member 122, having the first groove cam 141, supports the cam lever 121. This eliminates the need to provide a separate member for supporting the cam lever 121, and thus helps simplify the construction of the door opening/closing mechanism and reduce the space it occupies.

In this way, the handle proper 127 is, by being slid in from the outside of the door (from the right side as seen in FIG. 13), fitted on the shaft support member 120 that is rotatably fitted on the handle base 115. The handle proper 127 is fitted on the shaft support member 120 by engagement using claws (not shown). The handle proper 127 may be fixed to the shaft support member 120 with screws.

Moreover, in an upper portion of the handle base 115, a projection 115*f* is formed. In the projection 115*f*, in the handle proper 127, and in the handle base 115, through holes 115*d*, 127*a*, and 115*c* are respectively formed so as to lie on the center axis 119*c* of the lower shaft 119. Through these through holes 115*d*, 127*a*, and 115*c*, an upper shaft 124 is fitted from below, and thereby the upper portion of the handle proper 127 is rotatably fitted on the handle base 115.

A lower portion of the upper shaft 124 is formed into an L-shaped bent portion 124*a*. The upper shaft 124 is, after being fitted through the through holes 115*d*, 127*a*, and 115*c*, rotated so as to be hooked on a projection 115*e* formed on the handle base 115. This prevents the upper shaft 124 from coming off.

Moreover, on the top surface of a lower portion of the handle proper 127, a circular boss 127*b* is formed near the center axis 119*c* of the lower shaft 119. Around the circular boss 127*b*, a spring 125 is fitted. One end 125*a* of the spring 125 is so located as to press the handle base 115 rearward.

The other end 125*b* of the spring 125 is hooked on a spring rest 127*c* formed on the top surface of the lower portion of the handle proper 127 so as to press the spring rest 127*c* forward. Thus, when the operation portion 107*a* of the handle 107 is held with a hand and pulled forward to open the refrigerator compartment door 102 and is then released from the hand, the handle 107 returns to its original position by the resilient force of the spring 125.

A base cover 126 is fitted on the handle base 115 by engagement using claws (not shown) so as to cover the bent portion 124*a* of the upper shaft 124, the projection 115*e*, the circular boss 127*b*, the spring rest 127*c*, and the spring 125. Moreover, a handle cover 107*b* is fitted on the front surface of the handle proper 127 by engagement using claws (not shown).

As a result of the base cover 126 being fitted on the handle base 115, the bent portion 124*a* is enclosed by the rear surface of the base cover 126, the projection 125*e*, and the top surface of the handle base 115. Therefore, even if the bent portion 124*a* hooked on the projection 115*e* rotates, it collides with the base cover 126 and thus never happens to come off the projection 115*e*. This prevents the upper shaft 124 from coming out of the through holes 127*a*, 115*c*, and 115*d*.

A wall may additionally be formed at the front end of the projection 115*e* so as to extend upward. Between the top end of this wall and the projection 115*f*, a space is secured so as to permit the bent portion 124*a* to rotate. This wall serves to prevent the upper shaft from coming off before the base cover 126 is fitted, and thereby helps enhance ease of assembly.

In cases where sealing is so secure that there is no risk of urethane leakage and in addition there is no risk of deformation of the components under the foaming pressure, it is also possible to first assemble the above-described handle-related components into the refrigerator compartment door first-stage assembly 116 and then foam urethane to form the door heat insulator 102*a*. Obviously, the effects described above can be obtained also with doors designed to be opened at one side.

In FIGS. 16 and 17, the cavity 113*a* and the keyhole 115*b* are so shaped as to permit insertion of the bent portion 119*b* of the lower shaft 119. Moreover, into the circular hole 115*a*, the holding portion 120*b* (see FIG. 13) of the shaft support member 120 is rotatably fitted. The center of the circular hole 115*a* lies on the center axis 119*c* of the lower shaft 119.

Here, since the diameter of the circular hole 115*a* is greater than the width of the substantially rectangular cut of the key hole 115*b*, the holding portion 120*b* of the shaft support member 120 does not get into the rectangular cut. Thus, the shaft support member 120 is rotatably fitted on the handle base 115.

FIG. 14 shows the state of the right-hand handle 107 of the refrigerator compartment door 102 when the door 102 is closed. In the same condition, the left-hand handle 106 is in a state reversed left to right as compared with that shown in FIG. 14. On a bent portion 108*c* of the door plate 108, where the door plate 108 is bent rearward, a back plate 128 is fitted. In the back plate 128, a groove 128*a* is formed around the edges thereof. A gasket 129 having a protruding fitting portion 129*a* is fitted on the back plate 128, with the fitting portion 129*a* of the gasket 129 fitted into the groove 128*a*.

The gasket 129 incorporates an elastic magnet 129*b*. When the door is closed, the gasket 129 is kept in close contact with the front face portion 131 of a cabinet 130 enclosing the refrigerator body 101 and made of painted steel sheets, and serves to shut off ambient air and insulate heat.

When the door is opened at the right side from the closed state, the door opening/closing mechanism works as follows. When the operation portion 107*a* of the handle 107 is held with a hand and pulled forward, the handle 107 rotates clockwise about its rotation pivot (119*c*). As the handle 107 rotates, the shaft support member 120 and the bent portion 119*a* of the lower shaft 119 that are fitted at the bottom of the handle 107 rotate together clockwise about the rotation pivot (119*c*).

As the lower shaft 119 rotates, the cam lever 121 (see FIG. 15) also rotates clockwise about the rotation pivot (119*c*). Then, the cam lever 121 presses a lock outer cam 132 (see FIG. 15), described later, that is provided on the refrigerator body 101. The handle 107 rotates until a stopper portion 107*e* thereof makes contact with a stopper rest 115*c* of the handle base 115, and thus the refrigerator compartment door 102 is opened at the right side by a predetermined distance from the front face portion 131 of the refrigerator body 101.

At this time, mainly a right-hand portion of the gasket 129, which has thus far been kept in close contact with the front face portion 1311 by the magnetic force of the magnet 129*b*, is located slightly away from the front, face portion 131. As will be described later, this makes it easier to move the refrigerator compartment door 102 horizontally, and also to move the refrigerator compartment door 102 to a second lock position where it is rotatably locked.

Thereafter, when the handle 107 is pulled further, while the stopper portion 107*e* is kept in contact with the stopper rest 115*c*, the refrigerator compartment door 102 is opened further at the right side. At this time, since the gasket 129 is located slightly away from the front face portion 131, ambient air is free to enter the compartment, and thus the refrigerator compartment door 102 can be opened with a weaker force than when opened by the predetermined distance mentioned above. Between the rear surface of the operation portion 107*a* and the base cover 126, a space is secured so that the user can hold the operation portion 107*a* securely by reaching, with the finger tips, as wide an area as possible over the operation portion 107. This permits the user to pull the handle 107 forward with a sufficient force applied thereto, and thus permits the door to be opened and closed with enhanced ease of operation.

Thereafter, when the operation portion 107*a* is released from the hand, the resilient force of the spring 125 fitted around the circular boss 127*b* formed on the top surface of the lower portion of the handle 107 causes the handle 107 to return to its original position (the position shown in the figure) with respect to the handle base 115. This is because one end 125*a* of the spring 125 is located so as to press the handle base 115 rearward and the other end 125*b* thereof is located so as to press the spring rest 127*c*, formed on the top surface of the lower portion of the handle 107, forward.

When the handle 107 returns to its original position with respect to the handle base 115, the handle 107 hits the handle base 115 and makes a hitting noise. To alleviate this hitting noise, it is preferable to lay a cushion 107*f* on one or both of the handle 107 and the handle base 115.

One end 125*a* (the handle base 115 side end) of the spring 125 is bent forward. This permits the handle 107, with the spring 125 fitted around the circular boss 127*b*, to be fitted on the shaft support member 120 by being slid along it from the right side as seen in the figure without being caught on the wall of the handle base 115.

If the heat insulator 102*a* of the refrigerator compartment door 102 offers low heat insulation, condensation occurs on the surfaces of the handle support 113 and the handle base 115. In such cases, a heat-conducting material such as aluminum foil may be laid on the heat insulator 102*a* side surface of the handle support 113 and on the heat insulator 102*a* side surface of the door plate 108 around the opening 108*b*. This helps prevent condensation.

Front portions of the handle support 113 and the handle base 115, where they are connected to the door plate 108, may be so formed as to have surfaces substantially perpendicular to the door plate 108 there, or surfaces that are so inclined as to extend in a rear-right direction from the door plate 108. This requires the handle support 113 and the handle base 115 to be made larger, but makes it easy to lay the heat-conducting material.

The rim of the opening 108*b* of the door plate 108 is sandwiched between the handle support 113 and the handle base 115. This eliminates the risk of urethane leakage when the raw material of urethane foam is foamed, and also isolates the components provided outside the handle support 113 (i.e. on the handle base 115 side of the handle support 113) from the heat insulator 102*a*. In this way, the heat insulator 102*a* is prevented from reaching the movable components of the lever mechanism constituted by the handle 107 and others and thus from hampering the action of the lever mechanism. By applying seals between the handle support 113 and the rim of the opening 108*b* of the door plate 108 and between the handle base 115 and the same rim, it is possible to more securely prevent leakage of the heat insulator 102*a*.

It is also possible to abolish the handle support 113 and instead form, in the handle base 115, a cavity (corresponding to the cavity 113*a*) having the same cross-sectional shape as the keyhole 115*b*. In this case, the handle base 115 is fitted around the rim of the opening 108*b* with screws, with a seal applied in between. This helps reduce the number of components and simplify the assembly of the door opening/closing mechanism. In this case, seals are necessary also around the through hole 115*c* of the handle base 115 and other openings.

FIG. 15 is a sectional view of and around a portion of the lower door cap 110 at the right side of the refrigerator compartment door 102, mainly a portion around the cam lever 121, when the door 102 is closed. In the same condition, the corresponding portion of and around the lower door cap 110 at the left side has a sectional view reversed left to right as compared with that shown in FIG. 15.

On the lower bent portion 119*b* of the lower shaft 119, the cam lever 121 built in the slide cam member 122 from below is fitted so as to enclose the bent portion 119*b*. Accordingly, the bent portion 119*b* can be fitted into and pulled out of the cam lever 121 in the vertical direction.

Moreover, the circular boss 121*a* (see FIG. 13) formed on the bottom surface of the cam lever 121 so as to lie on the center axis 119*c* of the lower shaft 119 is rotatably fitted into the hole 122*a* (see FIG. 13) of the slide cam member 122.

When the operation portion 107*a* of the handle 107 is pulled forward (see FIG. 14), the lower shaft 119 rotates clockwise, as seen from above, about its center axis 119*c*. Accordingly, the cam lever 121 also rotates clockwise about the center axis 119*c*, and presses the lock outer cam 132 that is formed on the slide cam member 122 so as to protrude upward. As a result, by the time when the stopper portion 107*e* (see FIG. 14) of the handle 107 makes contact with the stopper rest 115*c* of the handle base 115, the refrigerator compartment door 102 is open with the right side thereof located a predetermined distance away from the front face portion 131 of the refrigerator body 101.

The pressing surface 121*b* of the cam lever 121, at which the cam lever 121 presses the front end of the lock outer cam 132, is so inclined as to extend in a rear-right direction toward the right side end of the refrigerator compartment door 102. Accordingly, for most part of the time that the cam lever 121 is pressing the lock outer cam 132, the cam lever 121 presses the front end of the lock outer cam 132 obliquely from a front-right direction (here, "right" means the right side of the refrigerator compartment door 102). Thus, the refrigerator compartment door 102 receives a reaction force that tends to move it in a front-right direction. Quite naturally, when the refrigerator compartment door 102 is opened at the left side, the handle 106 (see FIG. 12) is operated so that the door 102 receives a reaction force that tends to move it in a front-left direction.

Thus, when the handle 107 (see FIG. 15) is operated, the action of the lower shaft 119, the cam lever 121, and the lock outer cam 132 brings the refrigerator compartment door 102 away from the front face portion 131 of the refrigerator body 101. At this time, the handle 107, the lower shaft 119, and the cam lever 121 constitute a lever mechanism that acts on the principle of the action of a lever. Here, the point of effort of the lever mechanism lies on the operation portion 107*a* of the handle 107, the fulcrum thereof lies on the center axis 119*c* of the lower shaft 119, and the point of load thereof lies on the point at which the cam lever 121 makes contact with the lock outer cam 132.

Thanks to the lever mechanism, even when the handle 107 is pulled forward, it is possible to vary, with a certain degree of freedom, the direction of the force applied to the lock outer cam 132 by varying the shape of the cam lever 121 or other. Accordingly, in cases where, as will be described later, the refrigerator compartment door 102 is slid while being rotated, it is possible to apply a force that acts in the same direction as the door 102 is slid, and thereby alleviate the resistance encountered when the door 102 is slid. Instead of pressing the lock outer cam 132, it is also possible to open the refrigerator compartment door 102 by pressing another portion of the refrigerator body 101. Also in that case, by appropriately setting the direction in which the force at the point of load of the lever mechanism acts, it is possible to alleviate the resistance encountered when the door 102 is slid.

Moreover, the distance from the point at which the pressing surface 121*b* of the cam lever 121 makes contact with the lock outer cam 132 to the center line 119*c* is shorter than the distance from the center line 119*c* to the center of the operation portion 107*a* of the handle 107. That is, in the lever mechanism, the distance between the point of load and the fulcrum is shorter than the distance between the point of effort and the fulcrum. Thus, on the principle of the action of a lever, the lock outer cam 132 is pressed with a force stronger than the force applied to the operation portion 107. Accordingly, the door can be opened with a weak force as in the first and second embodiments. Moreover, the cam lever 121 is disposed at the bottom of the refrigerator compartment door 102, i.e. away from the handle 107. This makes it possible to reduce the space occupied by the door opening/closing mechanism and give it an acceptable design.

Moreover, the cam lever 121 is disposed at the bottom of the refrigerator compartment door 102, and is thus pressed downward by the weight of the door 102. Thus, the cam lever 121, on which the point of load of the lever mechanism lies, and the component that receives the force (for example, the lock outer cam 132) are kept stably in position in the vertical direction. This permits the driving force to be transmitted securely from the lever mechanism to the recipient component, and thus makes it possible to realize a door opening/closing mechanism that ensures stable opening/closing of a door.

Moreover, the rotation of the handle 107 is transmitted through the lower shaft 119 to the cam lever 121. This makes it possible to locate away from each other the plane on which the point of load of the lever mechanism rotates and the plane on which the point of effort thereof rotates. Thus, it is possible to locate the point of effort (the operation portion 107*a* of the handle 107) and the point of load (the point at which the cam lever 121 makes contact with the loch outer cam 132) in appropriate positions in the vertical direction so that the lever mechanism acts effectively. This permits the door to be opened with enhanced ease of operation.

Specifically, locating the handle 107, in the height direction, in the range of heights from the elbow to the shoulder of a woman having an average figure makes it easy for the user to pull the handle 107 forward. On the other hand, locating the cam lever 121 at the bottom of the refrigerator compartment door 102 ensures stable transmission of the force.

Moreover, the lower shaft 119 is fitted through the space 118 (see FIG. 12). This makes it possible to realize a door opening/closing mechanism having an elegant design pleasing to the sight. Obviously, these effects can be obtained also with doors designed to be opened at one side.

Figure 18A:
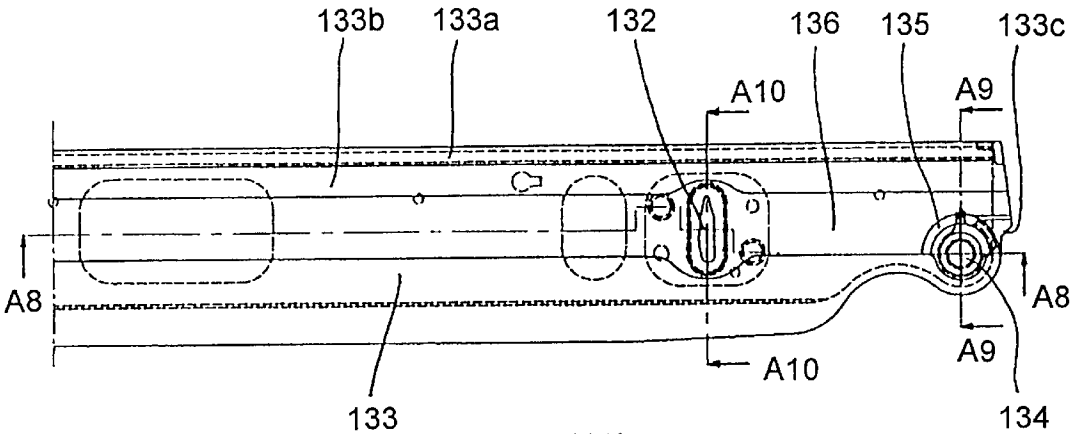
FIGS. 18A to 18D are diagrams showing the hinge angle provided in a lower front portion of the door opening/closing mechanism of the third embodiment.

FIG. 18A is a plan view of a hinge angle 133 fitted below a front portion of the refrigerator compartment door 102.

Figure 18B:
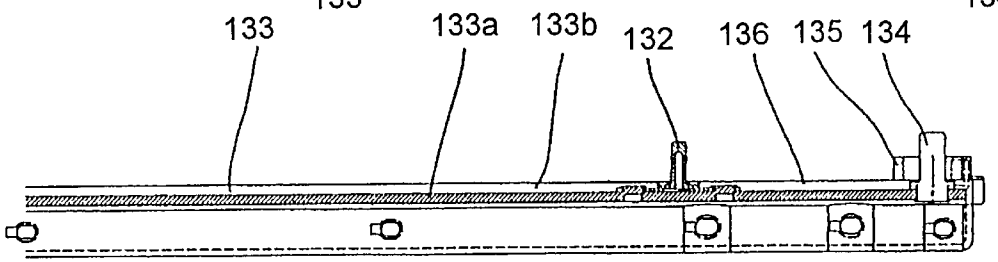
Figure 18C:
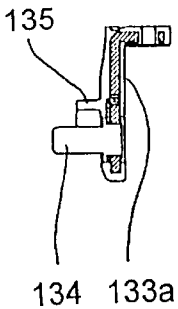
Figure 18D:
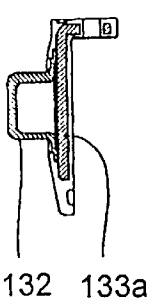

The left-hand half of the hinge angle 133 with respect to its lateral center has a shape reversed left to right as compared with that shown in FIG. 18A. FIGS. 18B, 18C, and 18D are sectional views taken along lines XVIII-B—XVIIIB, XVIII-C—XVIII-C, and XVIII-D—XVIII-D, respectively, of FIG. 18A.

The hinge angle 133 is fitted on the front face portion 131 (see FIG. 15) of the refrigerator body 101 with screws or the like. The weight of the refrigerator compartment door 102 and others weighs on the portion of the refrigerator body 101 just below the refrigerator compartment door 102. For this reason, to secure sufficient mechanical strength, the lock outer cam 132 is made of a stamped metal (for example, a stainless steel sheet). At both ends of an angle member 133*a* made of a metal (for example, a galvanized iron sheet, 3.2 mm thick), a hinge pin 134 made of a metal (for example, a stainless steel bar) and the lock outer cam 132 are fitted by swaging. The hinge pin 134 serves as the rotation axis of the refrigerator compartment door 102 when it is opened and closed.

A hinge cover 133*b* is formed integrally with the angle member 133*a* by insert molding. Moreover, a lock cam portion 136 having a second cam projection 135, described later, is formed integrally with the hinge cover 133*b*. Moreover, a stopper rest 133*c* is provided so as to restrict the maximum angle through which the refrigerator compartment door 102 can be opened.

The top surface of the hinge pin 134 fitted on the hinge angle 133 supports the corresponding surface of the slide cam member 122 (see FIG. 15). This permits the refrigerator compartment door 102 to be kept at a certain height above the hinge angle 133, and thereby prevents friction and collision between them when the door is slid or when it is opened or closed. Accordingly, most of the friction encountered when the door is opened occurs between the top surface of the hinge pin 134 and the slide cam member 122.

When the door is opened, the front end of the lock outer cam 132, which is so formed as to have sufficient mechanical strength, is pressed by the cam lever 121 (see FIG. 15). The lock outer cam 132 serves as a guide when the refrigerator compartment door 102 is opened. Thus, there is no need to provide a separate member to be pressed by the lever mechanism, nor provide further reinforcement. This helps simplify the construction of the door opening/closing mechanism and thereby make it inexpensive. Furthermore, the lock outer cam 132 is located near and substantially on the same plane as the hinge pin 134 that bears most of the sliding resistance when the door is slid, the driving force can be transmitted securely from the lever mechanism to the hinge pin 134 that slides along the first groove cam 141 (see FIG. 15). This ensures stable opening of the door.

Figure 19B:
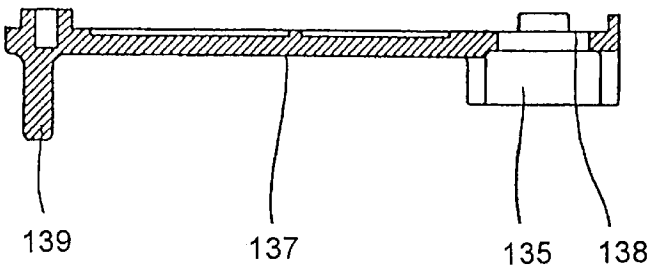
FIGS. 19A to 19D are diagrams showing the lock cam member provided in an upper portion of the door opening/closing mechanism of the third embodiment.
Figure 19D:
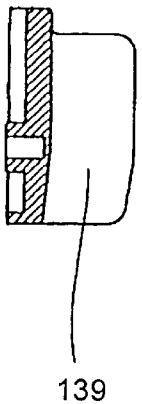
Figure 19A:
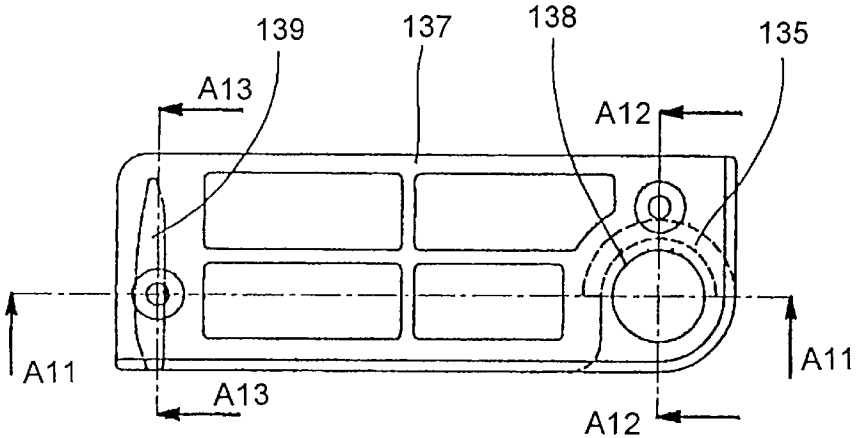

FIG. 19A is a plan view of a lock cam member 137 that is fitted, with screws or the like, to a hinge angle (not shown) fitted on the top face of the refrigerator body 101. The lock cam member 137 engages with a slide cam member 122, described later, that is fitted at the top right of the refrigerator compartment door 102. The lock cam member fitted at the left side of the refrigerator body 101 has a shape reversed left to right as compared with that shown in FIG. 19A.

Figure 19C:
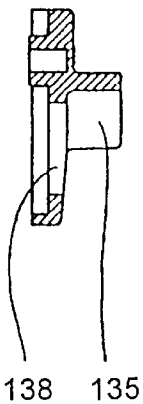

FIGS. 19B, 19C, and 19D are sectional views taken along lines XIX-B—XIX-B, XIX-C—XIX-C, and XIX-D—XIX-D, respectively, of FIG. 19A. At one end of the lock cam member 137, a through hole 138 is formed. through which a hinge pin (not shown) is fitted, and a second cam projection 135 having the shape of an arc is formed so as to be concentric with the through hole 138.

The lock cam member 137 is formed integrally with the lock outer cam 139 out of a resin material (for example, a polyacetal resin). The cam lever 121 shown in FIG. 15 described earlier is provided only at the bottom of the refrigerator compartment door 102, and thus the lock outer cam 139 of the lock cam member 137 provided above the refrigerator compartment door 102 is not pressed. Therefore, the lock outer cam 139 has sufficient mechanical strength even though it is formed out of a resin material.

The lock outer cam 139 is disposed at the same lateral position as the lock outer cam 132 (see FIG. 18A) and has a shape analogous thereto. Here, to permit the lock outer cam 139 to engage with a slide outer cam 143 (see FIG. 20A) over a longer distance, the lock outer cam 139 is made larger in the longitudinal direction than the lock outer cam 132 while maintaining the same engagement relationship.

Figure 20A:
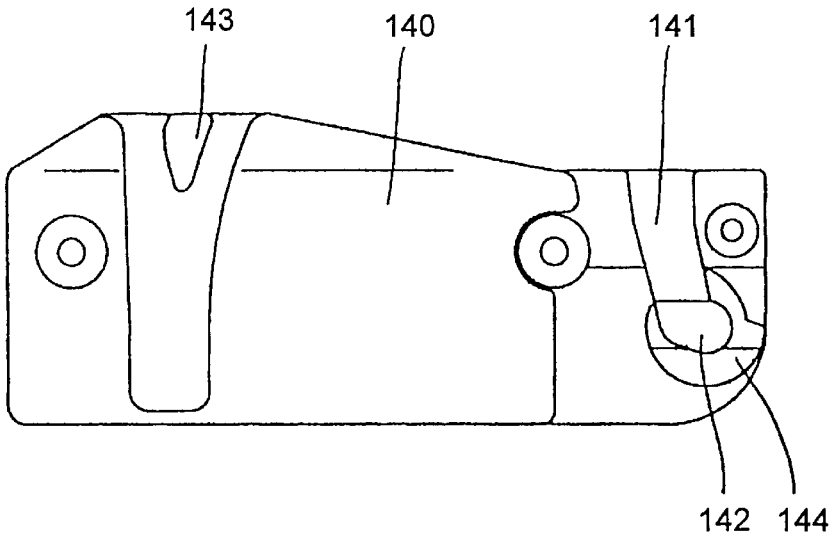
FIGS. 20A and 20B are diagrams showing the slide cam member provided in an upper portion of the door opening/closing mechanism of the third embodiment.
Figure 20B:
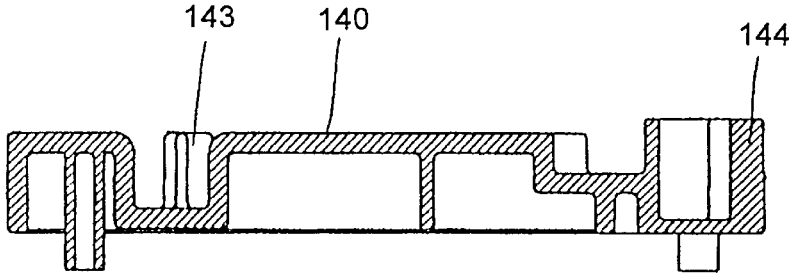

FIGS. 20A and 20B are a plan view and a sectional view as seen from the front, respectively, of the slide cam member 140 that engages with the lock cam member 137. In the slide cam member 140, a first and a second groove cam 141 and 142 are formed. The first groove cam 141 is so shaped as to permit the hinge pin (not shown) to move relative thereto from a first lock position, where it keeps the refrigerator compartment door 102 closed, to a disengaged state. The second groove cam 142 is so shaped as to permit the hinge pin to move from the first lock position to a second lock position, where it serves as a rotation axis.

Moreover, on the slide cam member 140, a slide outer cam 143 is formed that is so disposed as to engage with the lock outer cam 139 (see FIG. 19A), and a first cam projection 144 is formed that is so disposed as to engage with the second cam projection 135 in the second lock position.

Figure 21A:
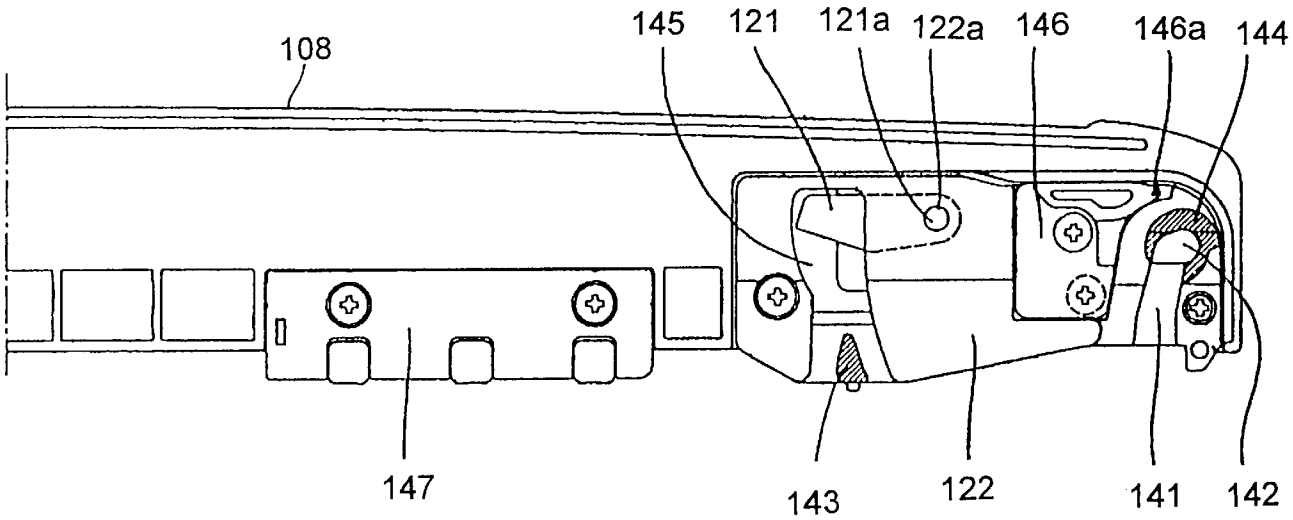
FIGS. 21A and 21B are diagrams showing the slide cam member provided in a lower portion of the door opening/closing mechanism of the third embodiment.
Figure 21B:
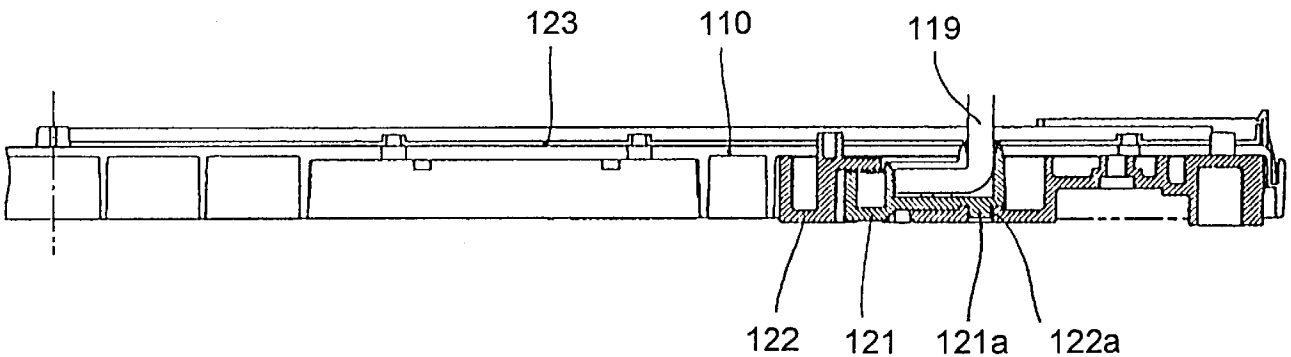

FIGS. 21A and 21B are a bottom view and a sectional view as seen from the front, respectively, of a portion around the slide cam member 122, shown in FIG. 15, fitted at the bottom right of the refrigerator compartment door 102. Like the slide cam member 122 shown in FIGS. 20A and 20B, the slide cam member 140 here also has a first groove cam 141, a second groove cam 142, a slide outer cam 143, and a first cam projection 144. Moreover, in the slide cam member 122, an opening 145 is formed through which the cam lever 121 presses the lock outer cam 132 (see FIG. 18A).

The circular boss 121*a* that serves as the rotation axis of the cam lever 121 is rotatably fitted into a hole 122*a* formed in the slide cam member 122. Reference numeral 146 represents a stopper that prevents the refrigerator compartment door 102 from being opened further when it is already fully open. The stopper 146 has a stopper portion 146*a*, and, when the refrigerator compartment door 102 is fully open, the stopper portion 146*a* makes contact with the stopper rest 133*c* (see FIG. 18A) formed on the hinge angle, 133 and thereby prevents the door 102 from being opened further.

Reference numeral 147 represents a roller assembly that runs onto the top surface of the hinge angle 133 to bear the weight of the refrigerator compartment door 102 when the door 102 is closed. Thus, the roller assembly 147 helps keep the refrigerator compartment door 102 in close contact with the front face portion 131 of the cabinet 130, and also assists the opening/closing of the door 102. The slide cam member 122, the stopper 146, and the roller assembly 147 are fixed to the door angle 123 with screws, with the lower door cap 110 sandwiched in between. For simplicity's sake, in FIG. 21B, the stopper 146, the roller assembly 147, and the door plate 108 are not illustrated.

Figure 22A:
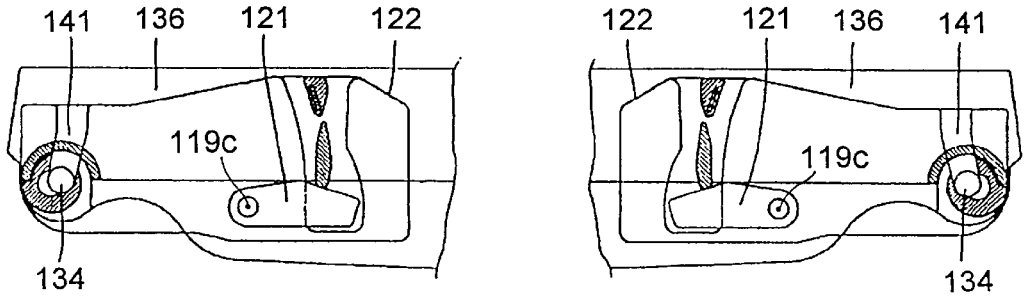
FIGS. 22A to 22C are plan views showing the relative positions of the lock cam member and the slide cam member of the door opening/closing mechanism of the third embodiment, when the door is opened.
Figure 22B:
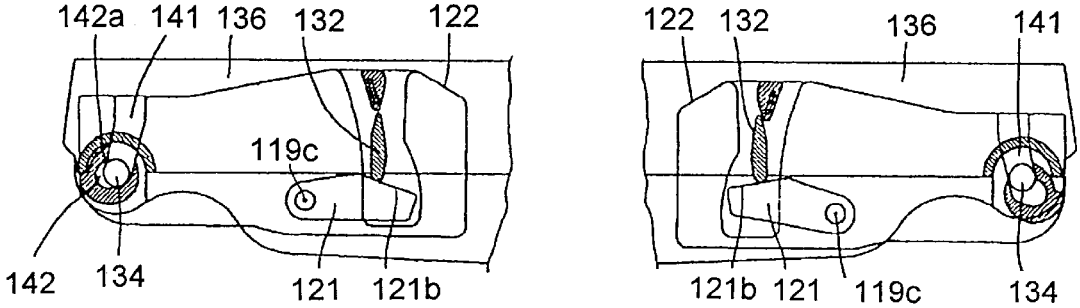
Figure 22C:
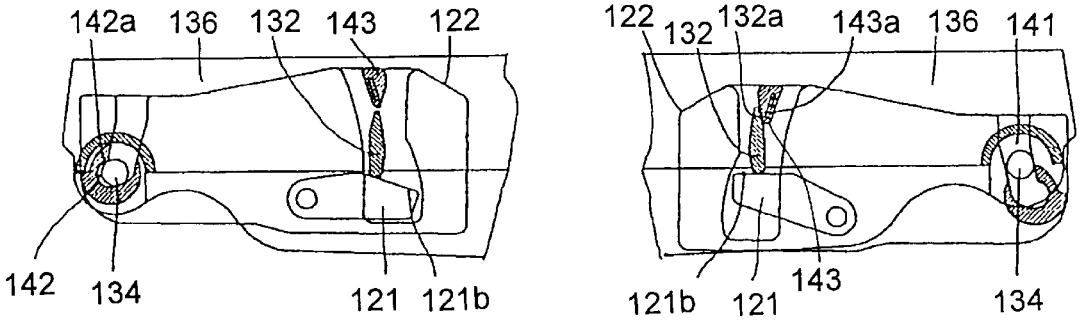

FIGS. 22A, 22B, and 22C are diagrams showing the relative positions of the lower lock cam portion 136 (see FIG. 18A) and the slide cam member 122 (see FIG. 15) when the refrigerator compartment door 102 is opened at the right side. FIG. 21A shows the state observed when the refrigerator compartment door 102 is closed. At this time, the cam mechanism constituted by the lock cam portion 136 and the slide cam member 122 is in a first lock position.

At this time, the first groove cams 141 formed in the right-hand and left-hand slide cam members 122 point obliquely inward with respect to the refrigerator compartment door 102. The first groove cams 141 at both sides are kept in fixed positions by the hinge pins 134, and therefore, even if the user pulls the refrigerator compartment door 102 or the operation portion 107*a* of the handle 107 (see FIG. 14) forward at both the right and left sides simultaneously, the door 102 never comes off the body.

FIG. 22B shows the state observed when the operation portion 107*a* of the right-hand handle 107 of the refrigerator compartment door 102 is held with a hand and pulled slightly forward so that the door 102 starts being opened at the right side. At this time, as the operation portion 107*a* is pulled slightly forward, the cam lever 121 rotates clockwise about its rotation axis 119*c*. As a result, the pressing surface 121*b* of the cam lever 121 presses rearward a right-hand portion of the front end of the lock outer cam 132.

Due to this force and the reaction force from the lock outer cam 132, the right-hand wall of the right-hand first groove cam 141 moves obliquely forward by sliding on the right-hand hinge pin 134, and thus the right side of the refrigerator compartment door 102 moves obliquely in a front-right direction. Simultaneously, the innermost wall 142*a* of the left-hand second groove cam 142 moves obliquely rearward by sliding on the left-hand hinge pin 134, and thus the left side of the refrigerator compartment door 102 moves obliquely in a rear-right direction.

FIG. 22C shows the state observed when the operation portion 107*a* is pulled further forward so that the refrigerator compartment door 102 is opened further at the right side. At this time, the right-hand cam lever 121 presses further rearward the right-hand portion of the front end of the lock outer cam 132, and thus, at the right side of the door 102, the slide surface 143*a* of the slide outer cam 143 slides along the slide surface 132*a* of the lock outer cam 132.

Thus, the first groove cam 141 guided by the right-hand hinge pin 134 moves the door 102 further obliquely in the front-right direction. On the other hand, the innermost wall 142*a* of the left-hand second groove cam 142 moves further obliquely rearward while keeping contact with the left-hand hinge pin 134, and thus the left side of the refrigerator compartment door 102 moves further obliquely in the rear-right direction.

At this time, the stopper portion 107*e* (see FIG. 14) of the operation portion 107*a* makes contact with the stopper rest 115*c* of the handle base 115. Thus, even if the operation portion 107*a* is pulled further forward, the cam lever 121 no longer presses the lock outer cam 132, and therefore the handle 107 thereafter serves simply as an ordinary handle.

For most of the time that the pressing surface 121*b* of the cam lever 121 is pressing the lock outer cam 132, the pressing surface 121*b* is so inclined as to extend obliquely from rear side to front center. Thus, the pressing surface 121*b* presses the front end of the lock outer cam 132 obliquely from a front-right direction, and therefore, as the reaction force of this force, the right side of the refrigerator compartment door 102 receives a force that tends to move it in a front-right direction. Here, the reaction force that presses the lock outer cam 132 acts in a direction close to the direction in which the door 102 is opened. This makes it easy for the right-hand first groove cam 141 to move along the right-hand hinge pin 134.

Moreover, as the pressing surface 121*b* moves, the slide cam member 122 at the left side of the door is simultaneously pulled toward the right side of the door. This makes it easy for the left-hand second groove cam 142 to move along the left-hand hinge pin 134. This in turn makes it easy for the left-hand slide cam member 122 to move to the second lock position where it rotates about the hinge pin 134.

In this way, part of the driving force exerted by the pressing surface 121*b* of the cam lever 121 acts to move the refrigerator compartment door 102 to the second lock position. This permits the door to be slid easily and securely when it is opened, and thereby makes it possible to realize a door opening/closing mechanism that ensures easy opening of a door.

Moreover, while the door is acting as shown in FIGS. 22A to 22C, the pressing surface 121*b* of the left-hand cam lever 121, the pressing surface 121*b* of the left-hand cam lever 121 barely makes contact with the left-hand lock outer cam 132, and therefore does not hamper the movement of the left-hand slide cam member 122. The relative positions of the pressing surface 121*b* of the left-hand cam lever 121 and the lock outer cam 132 are kept substantially fixed as long as the pressing surface 121*b* is located close to the lock outer cam 132 when the door is opened or closed.

Here, by securing a small gap between the pressing surface 121*b* of the left-hand cam lever 121 and the lock outer cam 132, it is possible to prevent the noise caused by the pressing surface 121*b* sliding on the lock outer cam 132 when the left-hand slide cam member 122 moves.

Figure 23A:
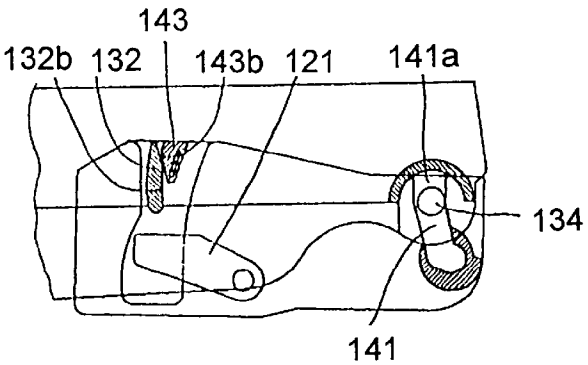
FIGS. 23A to 23C are plan views showing the relative positions of the lock cam member and the slide cam member of the door opening/closing mechanism of the third embodiment, when the door is opened.
Figure 23A:
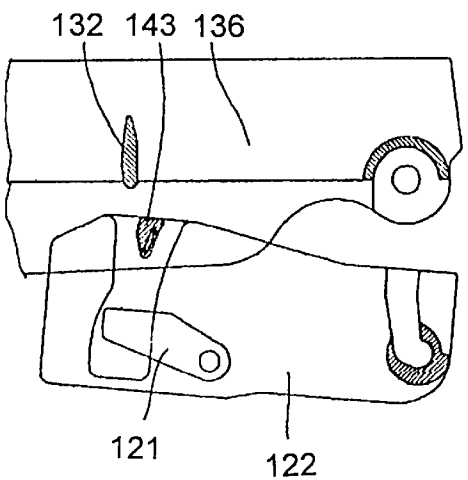
Figure 23A:
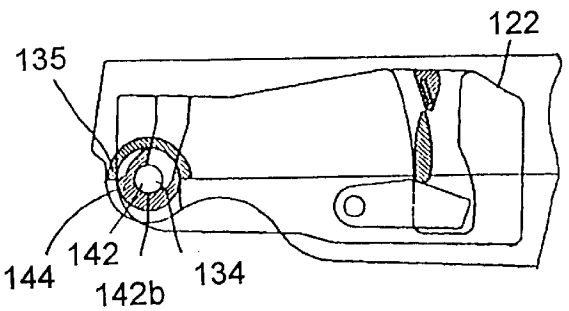
Figure 23B:
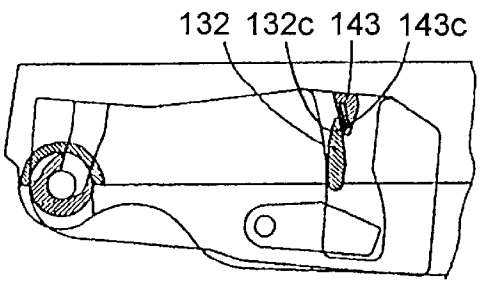
Figure 23C:
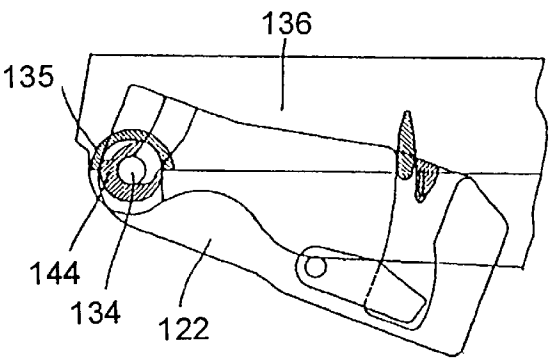

FIGS. 23A, 23B, and 23C are diagrams showing the relative positions of the lock cam portion 136 and the slide cam member 122 when the refrigerator compartment door 102 is opened further. FIG. 23A shows the state observed when the operation portion 107*a* is pulled further forward from the state shown in FIG. 22C so that the refrigerator compartment door 102 is opened further at the right side.

At this time, a circular portion 142*b* of the left-hand second groove cam 142 is so located as to make contact with the hinge pin 134, and the left-hand slide cam member 122 is located in the second lock position. Then, the left-hand first cam projection 144 starts engaging with and thereby being guided to slide along the second cam projection 135. On the other hand, a slide surface 143*b* of the right-hand slide outer cam 143, by sliding along a slide surface 132*b* of the lock outer cam 132, moves in such a way as to describe an arc about the left-hand hinge pin 134 serving as the rotation axis.

Thus, the left-hand slide cam member 122 is locked so as not come off the hinge pin 134. This prevents the refrigerator compartment door 102 from coming off the body, and thereby ensures secure opening/closing of the door.

When the refrigerator compartment door 102 rotates further, a right-hand portion of an innermost portion 141*a* of the right-hand first groove cam 141 moves, while keeping contact with the hinge pin 134, in such a way as to rotate about the left-hand hinge pin 134 serving as the rotation axis. Thereafter, the right-hand hinge pin 134 disengages from the first groove cam 141. The engagement between the right-hand first groove cam 141 and the hinge pin 134 provides assisting engagement when the slide outer cam 143 or the lock outer cam 132 is damaged or lost and when the left-hand first cam projection 144 engages with the second cam projection 135.

When, as shown in FIG. 23B, the refrigerator compartment door 102 is opened further with the operation portion 107*a* held with the hand, the right-hand lock outer cam 132 disengages from the slide outer cam 143. That is, the right-hand lock cam portion 136 disengages from the slide cam member 122.

On the other hand, at the left side of the door, a slide surface 143*c* of the slide outer cam 143 slides along a slide surface 132*c* of the lock outer cam 132 in such a way as to rotate about the center axis of the hinge pin 134. Thus, the slide outer cam 143 is guided by the lock outer cam 132 to slide along it.

Thereafter, as shown in FIG. 23C, solely the engagement between the left-hand first cam projection 144 and the second cam projection 135 keeps the left-hand slide cam member 122 being guided by the lock cam portion 136. Thus, the door is opened by rotating about the left-hand hinge pin 134.

The door, now open at the right side as shown in FIG. 23C, can be closed by pushing, with a hand, the front face of the door near the right side end thereof. At this time, the relevant portions of the slide cam member 122 and the lock cam portion 136 have relationships just as shown in FIGS. 22A to 22C and 23A to 23C. However, here, the operation portion 107*a* of the handle 107 is not held with a hand nor pulled forward, and therefore the resilient force of the spring 125 keeps the cam lever 121 in the state shown in FIG. 22A.

FIGS. 22A to 22C and 23A to 23C show the relationships between the slide cam member 122 and the lock cam portion 136 fitted below, the refrigerator compartment door 102. The slide cam member 140 (see FIG. 20A) and the lock cam member 137 (see FIG. 19A) fitted above the refrigerator compartment door 102 have similar positional relationships. When the door is opened at the left side, these components have relationships reversed left to right as compared with those shown in FIGS. 22A to 22C and 23A to 23C.

Figure 24:
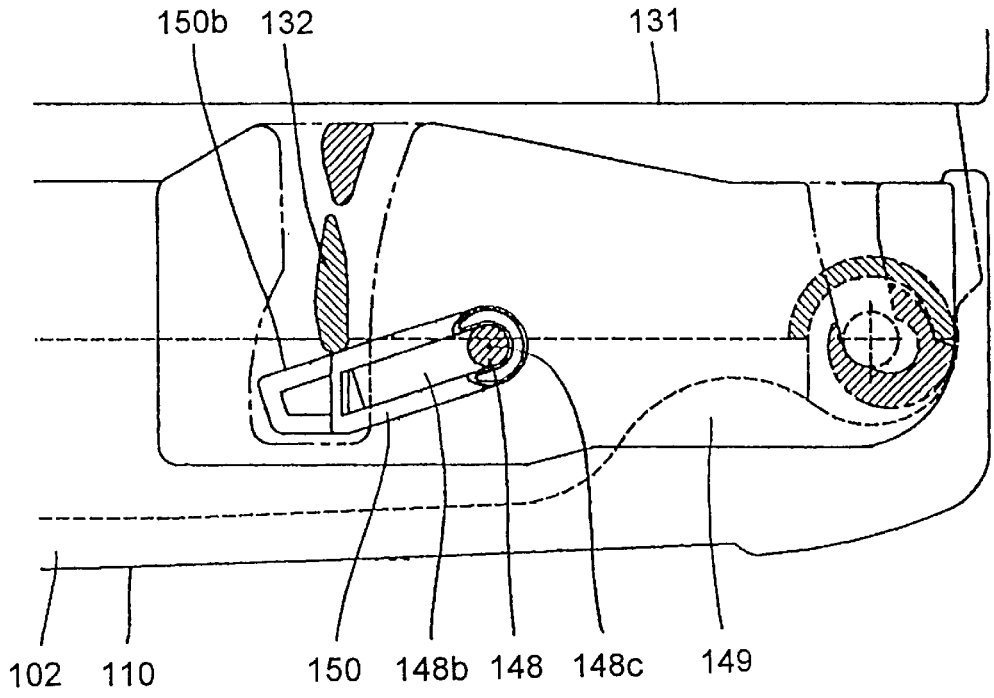
FIG. 24 is a plan view of the slide cam member of the door opening/closing mechanism of a fourth embodiment of the invention.

FIG. 24 is a plan view of the cam lever used in the door opening/closing mechanism of a fourth embodiment of the invention. This figure shows a sectional view taken along line XV—XV of FIG. 12, and corresponds to FIG. 15 of the third embodiment. In this embodiment, the rotation axis 4148*c* of the lower shaft 148 is located behind the front end of the lock outer cam 132. In the other respects, the fourth embodiment has the same construction as the third embodiment.

On a lower portion of the lower shaft 148 that is bent so as to be formed into an L-shaped bent portion 148*b*, a cam lever 150 rotatably built in a slide cam member 149 is fitted so as to enclose the bent portion 148*b*. When the refrigerator compartment door 102 is opened at the right side, the slide cam member 149 moves in the same manner as shown in FIGS. 22A to 22C described previously. Meanwhile, for most of the time that a pressing surface 150*b* of the cam lever 150 is pressing the front end of the lock outer cam 132, the rotation axis 148*c* of the lower shaft 148, on which the fulcrum of the lever mechanism lies, remains located behind the front end of the lock outer cam 132.

Thus, the cam lever 150 presses the front end of the lock outer cam 132 obliquely from a front-right direction (here, "right" means the right side of the door), and therefore, as the reaction force of this force, the refrigerator compartment door 102 receives a force that tends to move it in a front-right direction.

Accordingly, part of the driving force exerted by the cam lever 150 that serves as the arm of the lever mechanism acts to move the left-hand slide cam member to the second lock position. This permits the door to be slid easily and securely when it is opened, and thereby makes it possible to realize a door opening/closing mechanism that ensures easy opening of a door.

The third and fourth embodiments deal with cases where the cam lever 121 or 150 serving as the arm of the lever mechanism is provided only at the bottom of the door. However, another cam lever may be provided also at the top of the door to achieve smoother action of the door. The arm, specifically the cam lever 121 or 150, may be given any other shape than specifically described above; for example, even if it is shaped simply like a bar, it functions; satisfactorily to help the door open.

Next, the door opening/closing mechanism of a fifth embodiment of the invention will be described. The door opening/closing mechanism of this embodiment is constructed in the same manner as in the refrigerator of the third embodiment shown in FIG. 12. Therefore, for convenience sake, such components as are found also in the third embodiment shown in FIGS. 12 to 23C will be identified with the same reference numerals.

Figure 25A:
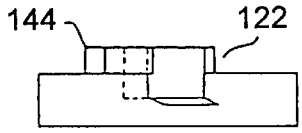
FIGS. 25A to 25E are diagrams showing the slide cam member provided in an upper portion of the door opening/closing mechanism of a fifth embodiment of the invention.
Figure 25B:
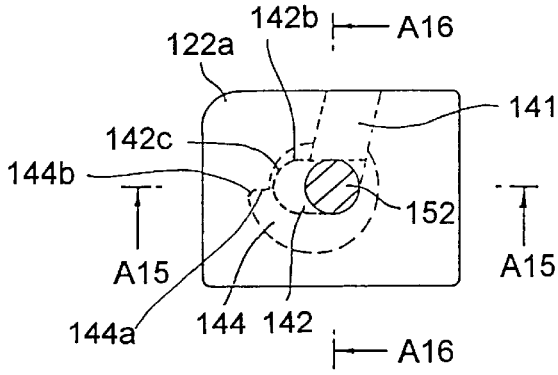
Figure 25C:
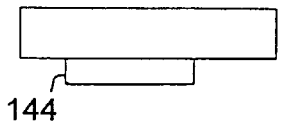
Figure 25D:
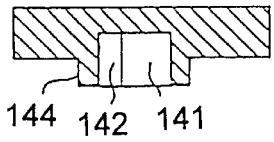
Figure 25E:
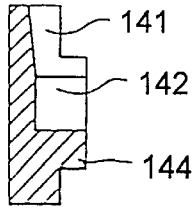

FIGS. 25A to 25E are diagrams showing the slide cam member 122 fitted at the top left of the refrigerator compartment door 102 (see FIG. 12). Of these figures, FIG. 25A is a rear view, FIG. 25B is a plan view, FIG. 25C is a front view, FIG. 25D is a sectional view along line XXV-D—XXV-D of FIG. 25A, and FIG. 25E is a sectional view along line XXV-E—XXV-E of FIG. 25A.

In the slide cam member 122, a first groove cam 141 and a second groove cam 142 are formed so as to be continuous with each other. Around the second groove cam 142, a first cam projection 144 is formed so as to protrude downward. The first groove cam 141 extends from one end of a base member 122*a* of the slide cam member 122 obliquely to the center thereof, and is continuous with the second groove cam 142 formed substantially at the center of the base member 122*a*. The second grove cam 142 has a linear portion 142*b* and a circular portion 142*c*.

As shown in FIG. 25E, the first groove cam 141 is deepest, at the end of the base member 122*a* and becomes gradually shallower toward the center. The first cam projection 144 has varying diameters around it, and has the largest diameter at an edge portion 144*a* thereof. The edge portion 144*a* serves as a stopper portion (cliff portion) that establishes a locked state of the cam mechanism when, as described later, the door is closed, and part of the edge portion 144*a* is chamfered to form a chamfered portion 144*b* with which to absorb a dimensional variation described later.

Figure 26A:
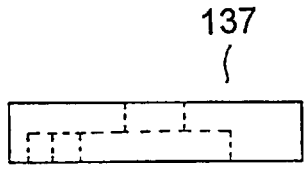
FIGS. 26A to 26E are diagrams showing the lock cam member provided in an upper portion of the door opening/closing mechanism of the fifth embodiment.
Figure 26B:
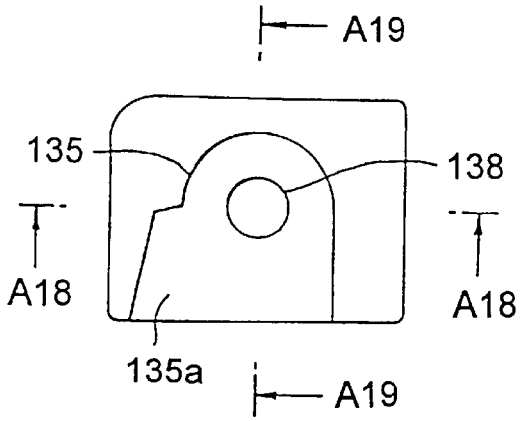
Figure 26C:
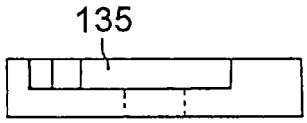
Figure 26D:
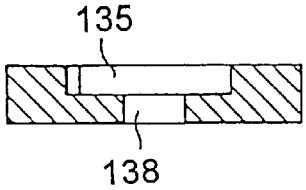
Figure 26E:
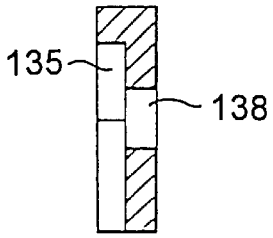

FIGS. 26A to 26E are diagrams showing the lock cam member 137 fitted on the refrigerator body 101 (see FIG. 12). FIGS. 26A to 26E show the faces of the lock cam member 137 corresponding to the faces of the slide cam member 122 shown in FIGS. 25A to 25E. Accordingly, FIG. 26D is a sectional view along line XXVI-D—XXVI-D of FIG. 26A, and FIG. 26E is a sectional view along line XXVI-E—XXVI-E of FIG. 26A.

In the lock cam member 137, a second cam projection 135 is formed that engages with the first cam projection 144 of the slide cam member 122. Reference numeral 135*a* represents a groove formed by the second cam projection 135, and, within this groove 135*a*, a through hole 138 is formed. Through this through hole 138, a hinge pin 134, described later, that is provided on the body is fitted so as to serve as a rotation axis 152 about which the door rotates.

In FIG. 25B, the first groove cam 141 formed in the slide cam member 122 is guided by the hinge pin 134 that is formed integrally with the lock cam member 137. On the other hand, the second groove cam 142 serves to guide the slide cam member 122 to a position where it does not disengage from the rotation axis 152 (the hinge pin 134).

The first cam projection 144 formed on the slide cam member 122 is guided by the second cam projection 135 formed in the slide cam member 137 so that, as the door is opened, the former slides on the latter. This prevents the slide cam member 122 from coming off the rotation axis 152 and thereby prevents the door from coming off the body.

Figure 27A:
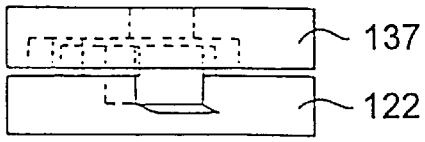
FIGS. 27A to 27D are diagrams showing the engagement between the slide cam member and the lock cam member provided in an upper portion of the door opening/closing mechanism of the fifth embodiment.
Figure 27B:
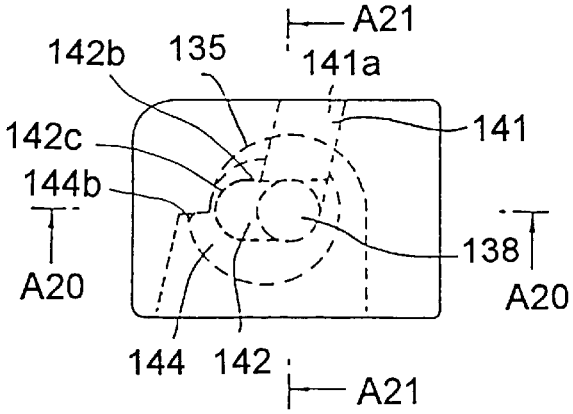
Figure 27D:
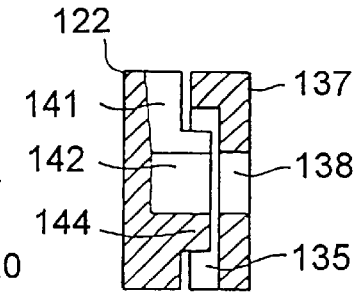
Figure 27C:
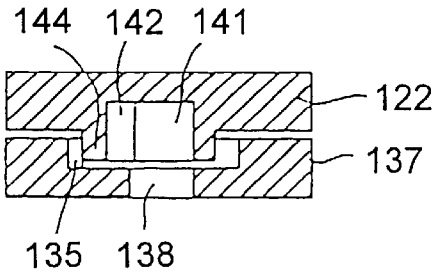

FIGS. 27A to 27D are diagrams showing a state of the slide cam member 122 and the lock cam member 137 combined together. FIG. 27C is a sectional view along line XXVII-C—XXVII-C of FIG. 27A, and FIG. 27D is a sectional view along line XXVII-D—XXVII-D of FIG. 27A. In these figures, the individual components are in their first lock position in which they are located when the refrigerator compartment door 102 is completely closed.

A pair of slide cam members 122 is fitted on the refrigerator compartment door 102, one at the right side and the other at the left side. Correspondingly, a pair of lock cam members 137 are fitted on the refrigerator body 101, in corresponding positions. FIGS. 28A to 28D show how the slide cam members 122 (illustrated with solid lines) engage with and disengage from the lock cam members 137 (illustrated with broken lines).

In these figures, a pair of slide cam members 122 shaped symmetrically with each other and a pair of lock cam members 137 shaped symmetrically with each other are arranged in symmetrical, right-hand and left-hand, positions. These figures are all plan views showing how they form hinges in the door opening/closing mechanism that permits the door to be opened at either the right or left side, illustrating specifically a case where the refrigerator compartment door 102 is opened at the right side.

Figures 28A, 28B, 28C, 28D:
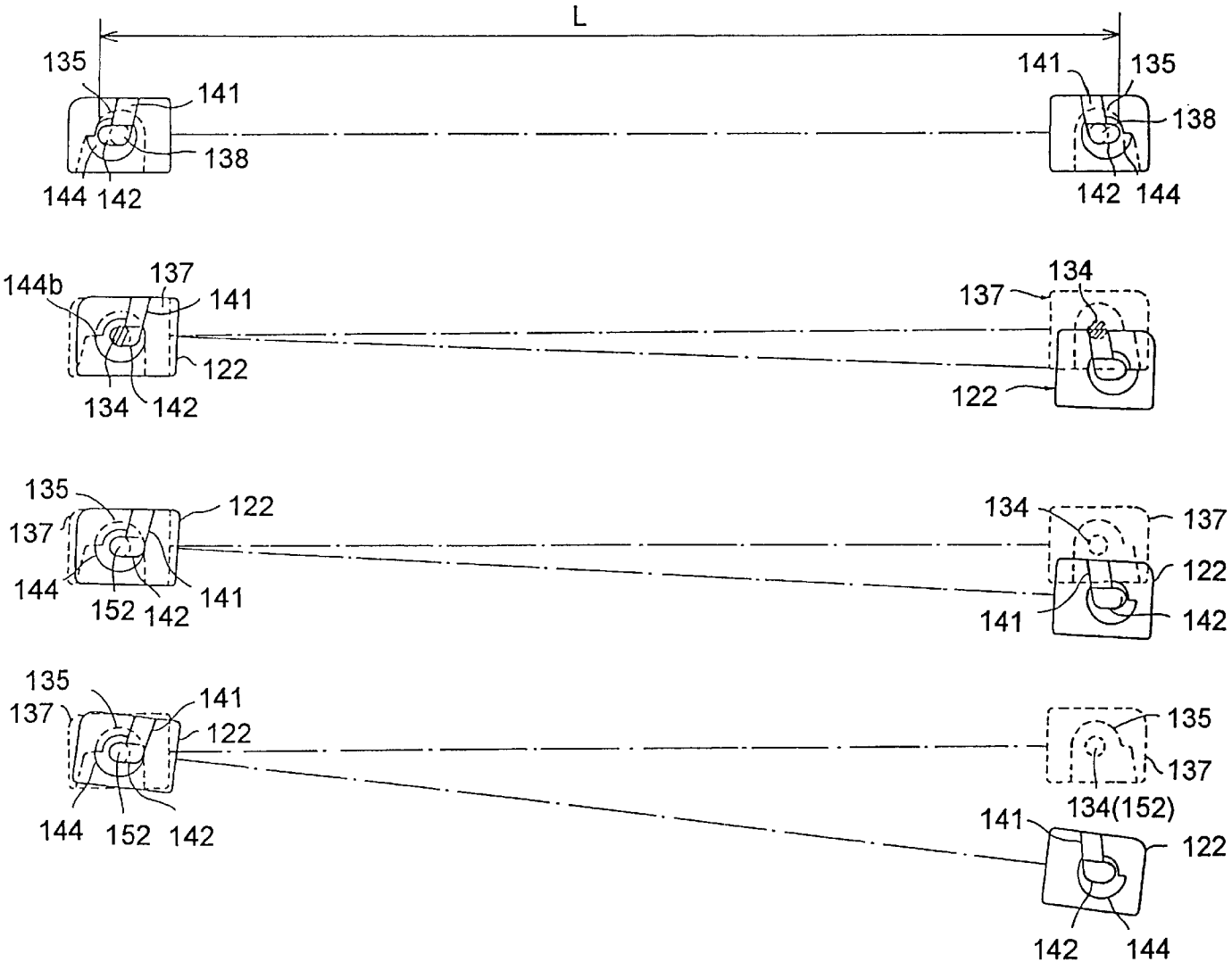
FIGS. 28A to 28D are plan views showing the relative positions of the lock cam member and the slide cam member of the door opening/closing mechanism of the fifth embodiment, when the door is opened.

FIG. 28A shows a state in which the door is completely closed. The slide cam members 122 fitted on the door and the lock cam members 137 fitted on the body are combined together in their first locked position in both of the symmetrical, right-hand and left-hand, positions. At this time, the first groove cams 141 formed in the right-hand and left-hand slide cam members 122 both point obliquely inward with respect to the door. The first groove cams 141 are both kept in fixed positions by the hinge pins 134, and therefore, even if the user pulls forward the door at both the right and left sides simultaneously, the door never comes off the body.

FIG. 28B shows a state observed when the door starts being opened at the right side. The first-groove cam 141 formed in the right-hand slide cam member 122 is located in a position where it can come off the hinge pin 134. At this time, the first groove cam 141 is guided by the hinge pin 134 so that the door slides slightly rightward.

As a result, the second groove cam 142 formed in the left-hand slide cam member 122 slides on the hinge pin 134 fitted through the through hole 138 formed in the left-hand lock cam member 137. Thus, the slide cam member 122 is guided to a second lock position in which it does not come off the left-hand hinge pin 134 that serves as the rotation axis 152.

Since the second groove cam 142 has the linear portion 142*b* (see FIG. 25B), even if, for example, the interval between the right-hand and left-hand second groove cams 142 is greater than designed due to assembly errors or the like, the linear portion 142*b* engages with the hinge pin 134 and thereby holds the slide cam member 122. This prevents the left-hand hinge pin 134 from being guided into the first groove cam 141 to move relative thereto, and thus helps stabilize the position of the rotation axis of the door. Moreover, it is also possible to prevent the hinge pin 134 from being guided into the first groove cam 141 to cause the door to come off.

Here, it is preferable to make the linear portion 142*b* longer than the range of variations in the outermost distance L between the second groove cams 142 at both sides of the door, because then the hinge pin 134 can be held by the second groove cam 142 securely. The range of variations is determined on the basis of the fitting errors of the slide cam member 122 and the machining errors of the door angle 123 (see FIG. 21A) that is used to fit the slide cam member 122.

In cases where the door has its inside formed into an integrally foamed heat insulator filled with polyurethane foam, the interval between the right-hand and left-hand slide cam members 122 may vary also due to the variation of ambient temperature and of foaming scale in the foaming process. Moreover, the interval varies also according as the door angle 123 expands as ambient temperature rises. The linear portion 142*b* may be so formed that the wall surfaces thereof on which the hinge pin 134 slides are curved as seen on a horizontal plane.

Since the linear portion 142*b* is longer than the range of variations in the outermost distance L, even if the outermost distance L varies with respect to the interval between the right-hand and left-hand hinge pins 134, it is possible to open the door with a minimum load due to friction and thus with a weak force. That is, a variation in the outermost distance L is absorbed by varying the position of the second groove cam 142 with respect to the left-hand hinge pin 134. This prevents the wall surfaces of the right-hand first groove cam 141 from being pressed onto the hinge pin 134, and thereby keeps the sliding friction low. At this time, the left-hand hinge pin 134 does not slide on the circular portion 142*c* but is held in the linear portion 142*b*.

Furthermore, as shown in FIGS. 28C and 28D, as the door rotates, the first cam projection 144 formed on the left-hand slide cam member 122 is guided by the second cam projection 135 formed on the left-hand lock cam member 137 so that the former slides on the latter. This prevents the slide cam member 122 from coming off the left-hand rotation axis 152 and thereby prevents the door from coming off so that the door can be opened and closed securely. In FIGS. 28B, 28C, and 28D, the left-hand cam mechanism is rotatably locked in the second lock position by the first and second cam projections 144 and 135.

The first cam projection 144 has part thereof chamfered as the chamfered portion 144*b* (see FIG. 25B) that is so large as to absorb a dimensional variation in the direction of the width of the door. Thus, even if there is a variation in the outermost distance L mentioned above, the chamfered portion 144*b* guides the door and thereby helps it open. This ensures secure engagement between the first and second cam projections 144 and 135.

Alternatively, it is also possible to form a similar chamfered portion in a portion of the second cam projection 135 facing the chamfered portion 144*b* that is formed immediately in advance of the point at which the first cam projection 144 engages with the second cam projection 135. Alternatively, it is also possible to form chamfered portions in both of the first and second cam projections 144 and 135. Alternatively, it is also possible to form the corner into a curved shape instead of forming a chamfered portion.

By forming an innermost portion 141*a* (see FIG. 27A) in the first groove cam 141, it is possible to engage the first and second cam projections 144 and 135 together more securely. The innermost portion 141*a* will be described later. When the door is opened at the left side, it acts in a manner reversed left to right as compared with the action shown in FIGS. 28A to 28D.

FIGS. 29A to 29E and FIGS. 30A to 30E show the slide cam member 122 and the lock cam member 137, respectively, of the door opening/closing mechanism of a sixth embodiment of the invention. For convenience sake, such components as are found also in the fifth embodiment are identified with the same reference numerals.

Figure 29A:
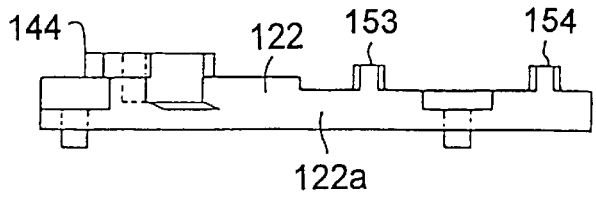
FIGS. 29A to 29E are diagrams showing the slide cam member of the door opening/closing mechanism of a six embodiment of the invention.
Figure 29B:
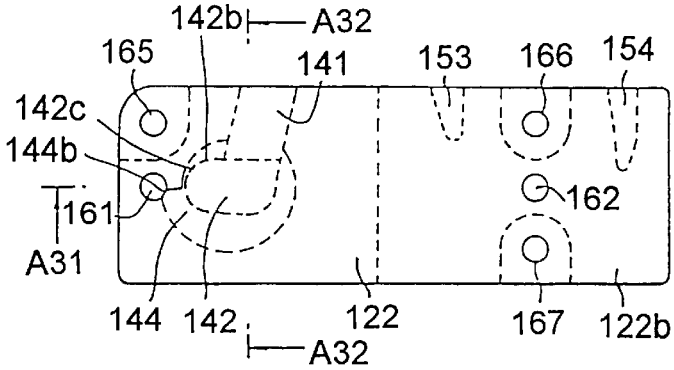
Figure 29E:
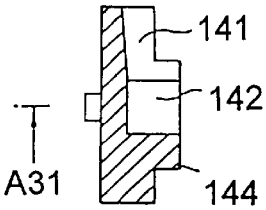
Figure 29C:
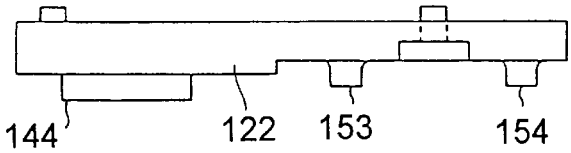
Figure 29D:
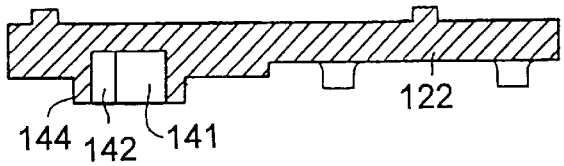
Figure 30A:
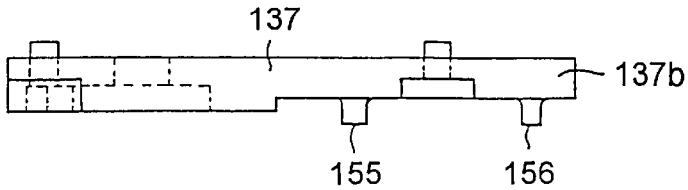
FIGS. 30A to 30E are diagrams showing the lock cam member of the door opening/closing mechanism of the six embodiment.
Figure 30B:
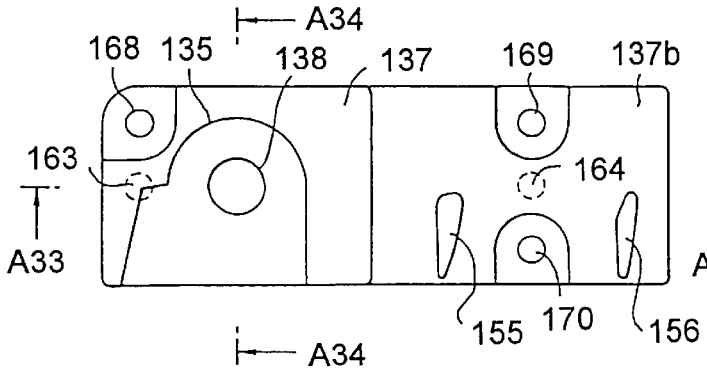
Figure 30E:
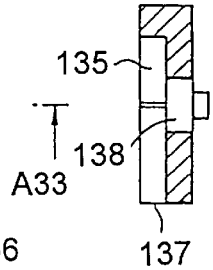
Figure 30C:
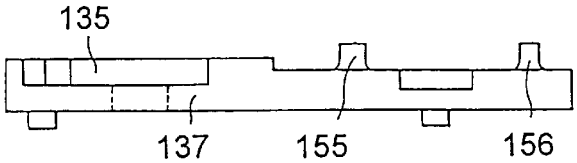
Figure 30D:
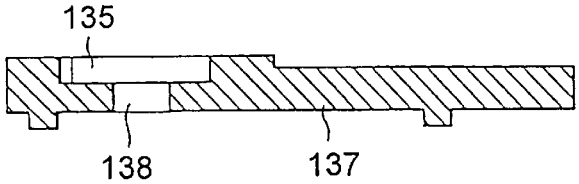

Of these figures, FIGS. 29A and 30A are rear views, FIGS. 29B and 30B are plan views, FIGS. 29C and 30C are front views. FIG. 29D is, a sectional view along line XXIX-D—XXIX-D of FIG. 29B. FIG. 30D is a sectional view along line XXX-D—XXX-D of FIG. 30B. FIG. 29E is a sectional view along line XXIX-E—XXIX-E of FIG. 29B. FIG. 30E is a sectional view along line XXX-E—XXX-E of FIG. 30B.

In this embodiment, as compared with the fifth embodiment, the slide cam member 122 and the lock cam member 137 additionally have outer cam portions 122*b* and 137*b*, respectively, that are so formed as to extend laterally therefrom. On the outer cam portion 122*b*, slide outer cams 153 and 154 are formed. On the outer cam portion 137*b*, lock outer cams 155 and 156 are formed. In other words, the sixth embodiment differs from the fifth embodiment in additionally having the functions of the slide outer cams 153 and 154 and the lock outer cams 155 and 156.

In these figures, through the through hole 138 formed in the lock cam member 137, the hinge pin 134, described later, that is provided on the body is fitted so as to serve as the rotation axis 152 (see FIG. 25B) about which the door rotates. The first groove cam 141 formed on the slide cam member 122 guides the rotation axis 152 at the side at which the door is opened. On the other hand, the second groove cam 142 slides relative to the rotation axis 152 at the side opposite to the side at which the door is opened so that the rotation axis 152 engages, through the linear portion 142*b*, with the circular portion 142*c*. Thus, the slide cam member 122 is brought to a position where it does not come off the rotation axis 152.

As the door is opened, the first cam projection 144 formed on the slide cam member 122 is guided by the second cam projection 135 formed in the lock cam member 137 so that the former slides on the latter. This prevents the slide cam member 122 from coming off the rotation axis 152 and thereby prevents the door from coming off the body.

Furthermore, on the slide cam member 122, the slide outer cams 153 and 154 are formed that have both of their side walls so shaped as to have arc-shaped cross sections. Similarly, on the lock cam member 137, the lock outer cams 155 and 156 are formed that have both of their side walls so shaped as to have arc-shape cross sections. As the door is opened, the slide outer cams 153 and 154 engage with the lock outer cams 155 and 156 so that the former are guided by the latter to slide on the latter. This makes it possible to guide the slide cam member 122 more securely to the position where it does not come off the rotation axis 152. A detailed description will be given later. Reference numerals 161 to 164 represent positioning pins, and reference numerals 165 to 170 represents holes for fitting screws.

Figure 31A:
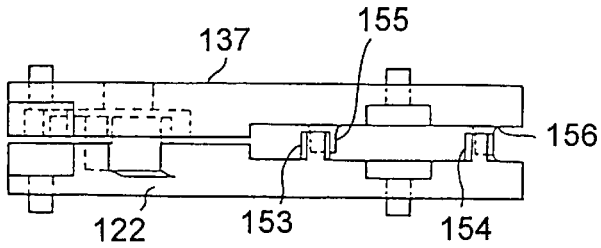
FIGS. 31A to 31D are diagrams showing the engagement between the slide cam member and the lock cam member of the door opening/closing mechanism of the sixth embodiment.
Figure 31B:
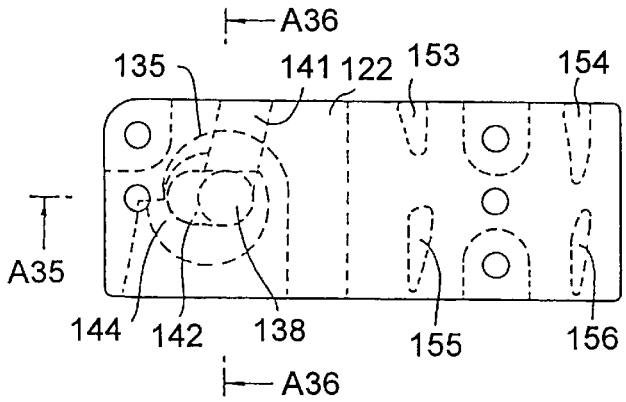
Figure 31D:
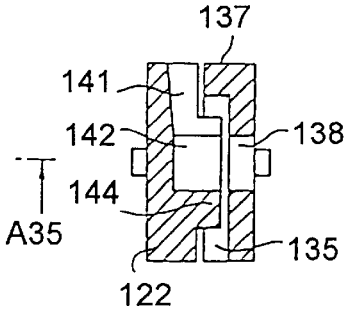
Figure 31C:
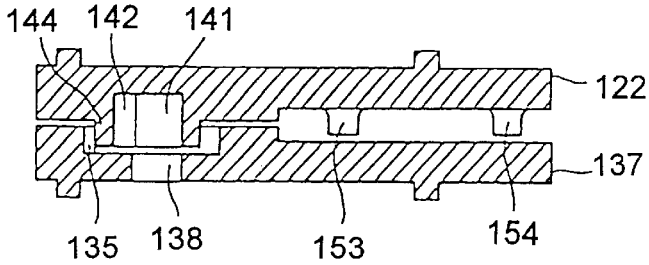

FIGS. 31A and 31B are a front view and a top view, respectively, of the slide cam member 122 and the lock cam member 137 combined together. FIGS. 31C and 31D are sectional views along lines XXXI-C—XXXI-C and XXXI-D—XXXI-D, respectively, of FIG. 31B. These figures show the positional relationship among the individual components as observed when the door is completely closed.

A pair of slide cam members 122 shaped symmetrically with each other and a pair of lock cam members 137 shaped symmetrically with each other are arranged in symmetrical positions at the right and left sides of the door. FIGS. 32A to 32D are plan views showing the action of the slide cam members 122 (illustrated with solid lines) and the lock cam members 137 (illustrated with broken lines) of the door opening/closing mechanism that permits the door to be opened at either the right or left side. These figures show a case where the door is opened at the right side.

Figures 32A, 32B, 32C, 32D:
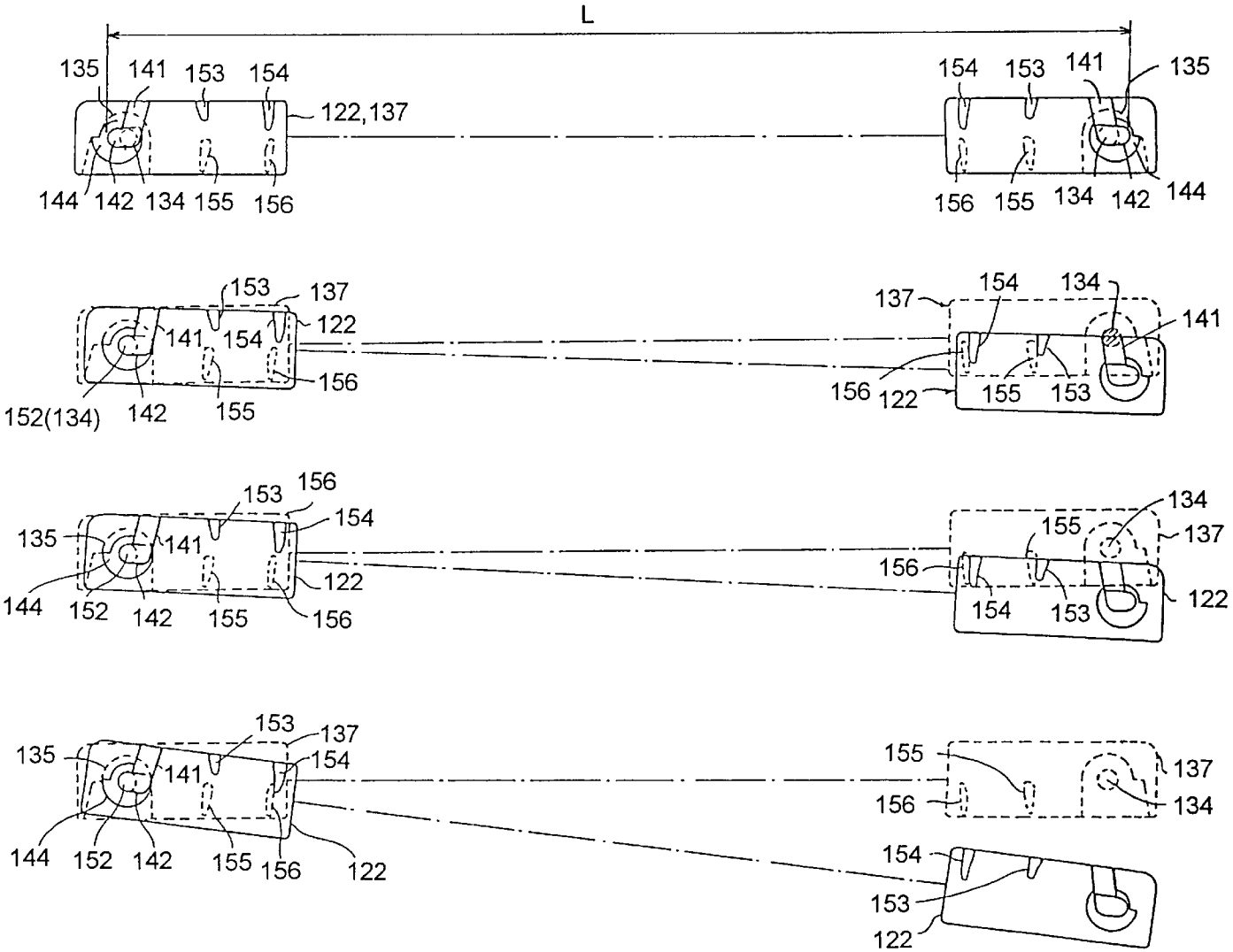
FIGS. 32A to 32D are plan views showing the relative positions of the lock cam member and the slide cam member of the door opening/closing mechanism of the sixth embodiment, when the door is opened.

FIG. 32A shows the state observed when the door is completely closed. In this figure, the slide cam members 122 fitted on the door and the lock cam members 137 fitted on the body are located in their first lock position in which they are combined together in perfectly symmetrical, right-hand and left-hand, positions. At this time, the first groove cams 141 formed in the right-hand and left-hand slide cam members 122 both point inward with respect to the door. The first groove cams 141 are both kept in fixed positions by the hinge pins 134, and therefore, even if the user pulls forward the door at both the right and left sides simultaneously, the door never comes off the body.

FIG. 32B shows a state observed when the door starts being opened at the right side. The first groove cam 141 formed in the right-hand slide cam member 122 is located in a position where it can come off the hinge pin 134. At this time, the first groove cam 141 is guided by the hinge pin 134 so that the door slides slightly rightward.

As a result, the second groove cam 142 formed in the left-hand slide cam member 122 slides on the hinge pin 134 fitted through the through hole 138 formed in the left-hand lock cam member 137. Thus, the left-hand slide cam member 122 guided to a second lock position in which it does not come off the hinge pin 134 that serves as the rotation axis 152.

Since the second groove cam 142 has the linear portion 142*b* (see FIG. 29B), even if, for example, the interval between the right-hand and left-hand second groove cams 142 is greater than designed due to assembly errors or the like, the linear portion 142*b* engages with the hinge pin 134 and thereby holds the slide cam member 122. This prevents the hinge pin 134 from being guided into the first groove cam 141 to move relative thereto, and thus helps stabilize the position of the rotation axis of the door. Moreover, it is also possible to prevent the hinge pin 134 from being guided into the first groove cam 141 to cause the door to come off.

Here, it is preferable to make the linear portion 142*b* longer than the range of variations in the outermost distance L between the second groove cams 142 at both sides of the door, because then the hinge pin 134 can be held by the second groove cam 142 securely. The range of variations is determined on the basis of the fitting errors of the slide cam member 122 and the machining errors of the door angle 171 (see FIG. 33A) that is used to fit the slide cam member 122. In cases where the door has its inside formed into an integrally foamed heat insulator filled with polyurethane foam, the interval between the right-hand and left-hand slide cam members 122 may vary also due to the variation of ambient temperature and of foaming scale in the foaming process. Moreover, the interval varies also according as the door angle 171 expands as ambient temperature rises.

Since the linear portion 142*b* is longer than the range of variations in the outermost distance L, even if the outermost distance L varies with respect to the interval between the right-hand and left-hand hinge pins 134; it is possible to open the door with a minimum load due to friction and thus with a weak force. That is, a variation in the outermost distance L is absorbed by varying the position of the second groove cam 142 with respect to the left-hand hinge pin 134. This prevents the wall surfaces of the right-hand first groove cam 141 from being pressed onto the hinge pin 134, and thereby keeps the sliding friction low. At this time, the left-hand hinge pin 134 does not slide on the circular portion 142*c* but is held in the linear portion 142*b*.

Furthermore, as shown in FIGS. 32C and 32D, as the door, rotates, the first cam projection 144 formed on the left-hand slide cam member 122 is guided by the second cam projection 135 formed on the left-hand lock cam member 137 so that the former slides on the latter. This prevents the slide cam member 122 from coming off the left-hand rotation axis 152 and thereby prevents the door from coming off so that the door can be opened and closed securely.

In FIG. 32C, the slide outer cams 153 and 154 formed on the right-hand slide cam member 122 are engaged completely with the lock outer cams 155 and 156 formed on the right-hand lock cam member 137. The slide outer cam 154 formed on the left-hand slide cam member 122 starts engaging with the lock outer cam 156 formed on the left-hand lock cam member 137.

In FIG. 32D, the right-hand slide outer cams 153 and 154 are disengaged from the right-hand lock outer cams 155 and 156. The left-hand slide outer cam 154 is engaged with the left-hand lock outer cam 156.

As the door rotates further, the left-hand slide outer cam 154 disengages from the left-hand lock outer cam 156. Then, the left-hand slide outer cam 153 engages with the left-hand lock outer cam 155 (not shown).

As a result of the action described above, the engagement with the left-hand lock outer cams 155 and 156 causes the door to slide rightward. Thus, the hinge pin 134 is held by the circular portion 142*c*, so that the cam mechanism securely maintains a locked state. In this way, in the cam mechanism on the pivoted side of the door, a rotatably locked state is maintained securely. This prevents the door from coming off the body, and permits the door to be opened and closed securely. When the door is opened at the left side, it acts in a manner reversed left to right as compared with the action shown in FIGS. 32A to 32D.

Figure 33B:
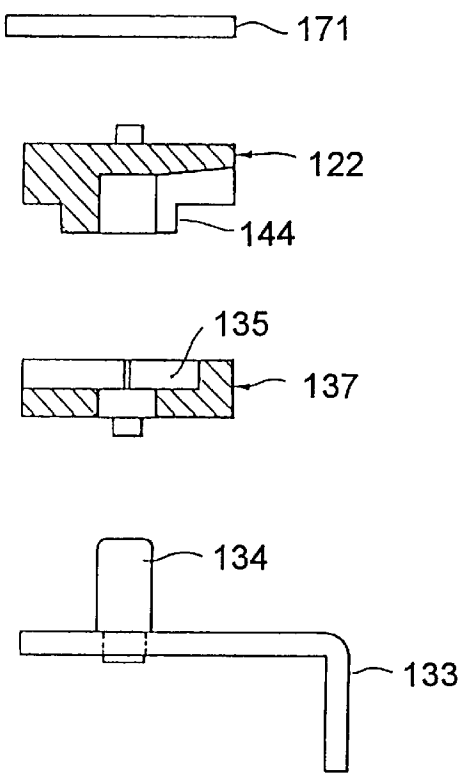
FIGS. 33A and 33B are exploded views of the slide cam member of the door opening/closing mechanism of the sixth embodiment.
Figure 33A:
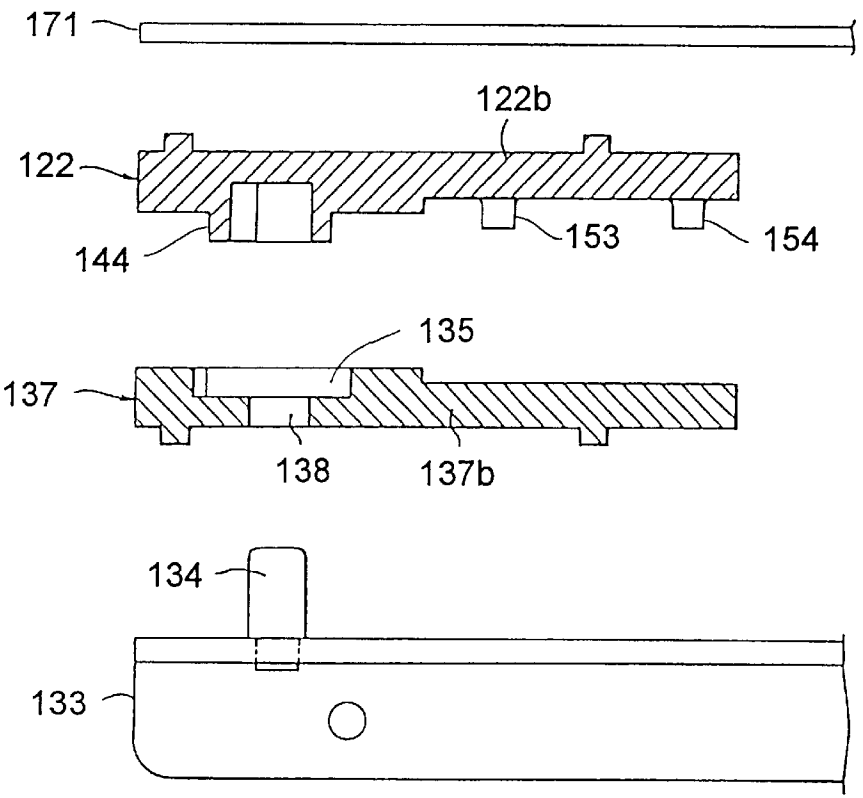

FIGS. 33A and 33B are exploded views of the slide cam member 122 of this embodiment. FIG. 33B is a side view of FIG. 33A. As shown in these figures, the slide cam member 122 is fitted on a door angle 171. On the other hand, the lock cam member 137 is fitted on a hinge angle 133. Here, the hinge pin 134 that is fitted beforehand on the hinge angle 133 penetrates the lock cam member 137 through the through hole 138 and protrudes upward therefrom. The door angle 171 is fitted on the door (not shown). On the other hand, the hinge angle 133 is fitted on the body.

The slide cam member 122 and the lock cam member 137 are formed by injection molding using, as a resin material, a polyamide resin, polyacetal resin, or the like.

Figure 34A:
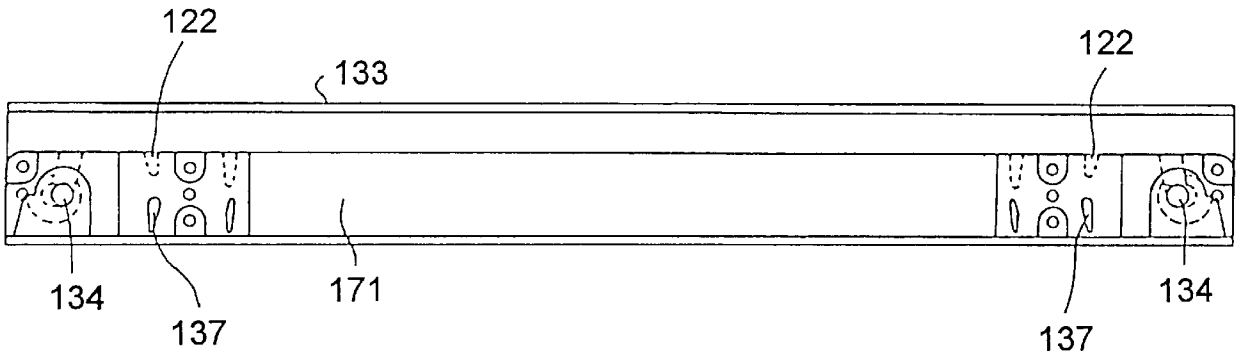
FIGS. 34A to 34C are diagrams showing the slide cam member and the lock cam member fitted on the hinge angle of the door opening/closing mechanism of the sixth embodiment.
Figure 34B:
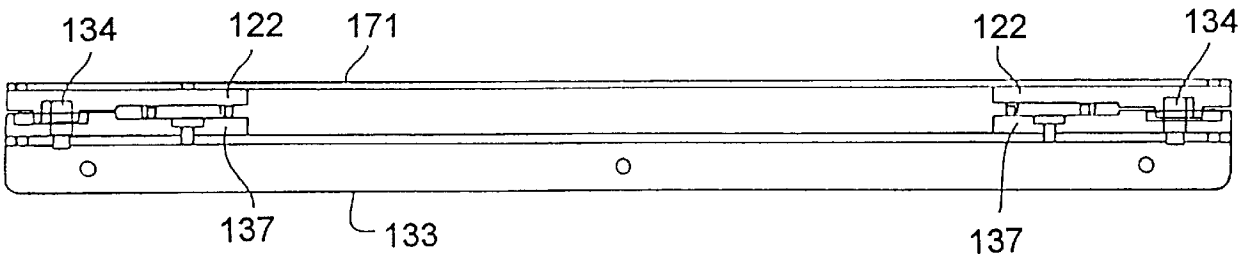
Figure 34C:
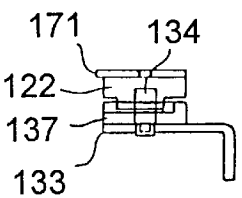

FIGS. 34A to 34C are a plan view, a front view, and a side view of the slide cam members 122 and the lock cam members 137 fitted in predetermined positions and combined together. In these figures, a pair of slide cam members 122 shaped symmetrically with each other and a pair of lock cam members 137 shaped symmetrically with each other are arranged in symmetrical, right-hand and left-hand, positions. They thus form hinges of the door that can be opened at either the right or left side. Here, the weight of the door weighs on the top surface of the hinge pin 134.

FIGS. 35A to 35E show the lock cam member 137, the hinge pin 134, and the hinge angle 133 formed integrally as a lock cam member, 175. This helps reduce the total number of constituent components by one as compared with the construction shown in FIGS. 33A and 33B described previously. In these figures, the lock cam member 175 has a hinge pin 177 that serves as the rotation axis of the door and a fitting portion 176 that permits the lock cam member 175 to be fitted on the body.

Figure 35A:
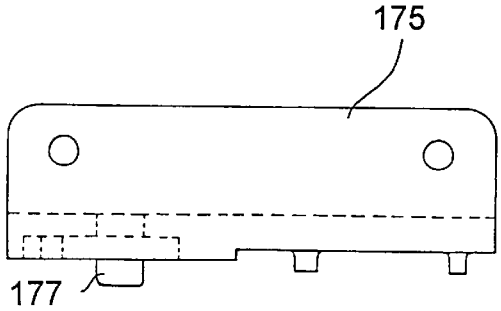
FIGS. 35A to 35E are diagrams showing the hinge angle and the lock cam member of the door opening/closing mechanism of the sixth embodiment, when they are formed integrally.
Figure 35B:
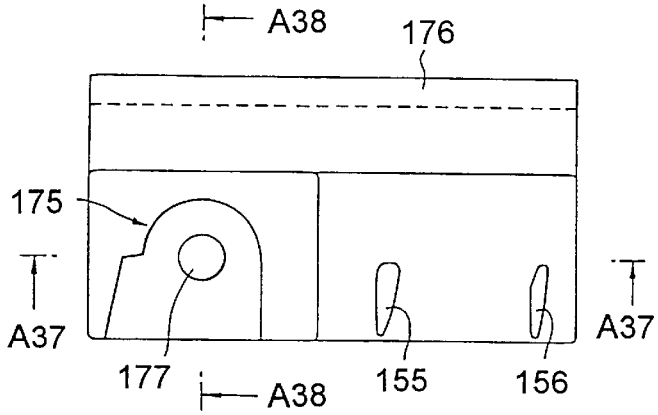
Figure 35E:
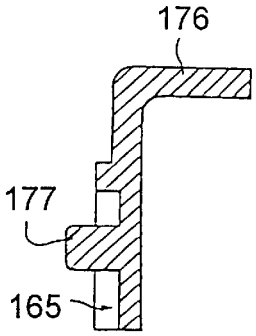
Figure 35C:
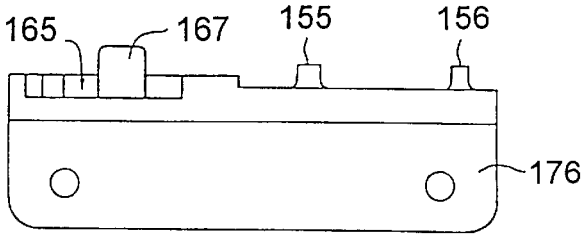
Figure 35D:
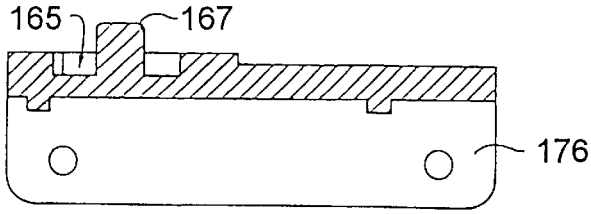

The lock cam member 175 is made of a casting such as a die-cast zinc alloy. FIGS. 35A to 35C are a rear view, a plan view, and a front view, respectively, of the lock cam member 175. FIGS. 35D and 35E are sectional views along lines XXXV-D—XXXV-D and XXXV-E—XXXV-E, respectively, of FIG. 35A.

Figure 36B:
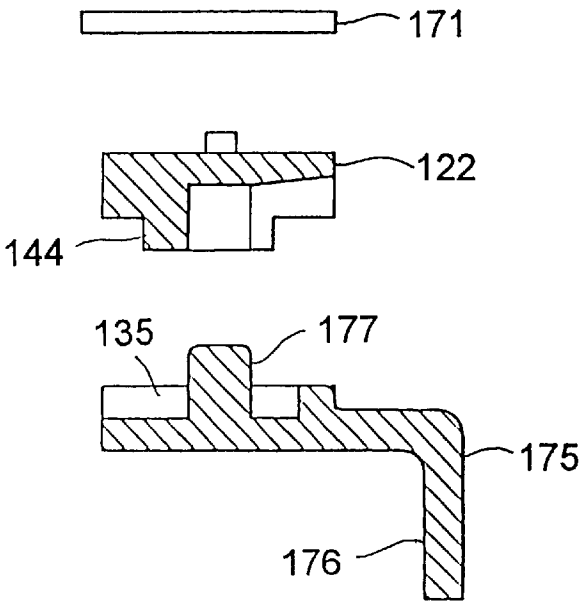
FIGS. 36A and 36B are exploded views showing how the lock cam member, formed integrally with the hinge angle, and the slide cam member are fitted together in the door opening/closing mechanism of the sixth embodiment.
Figure 36A:
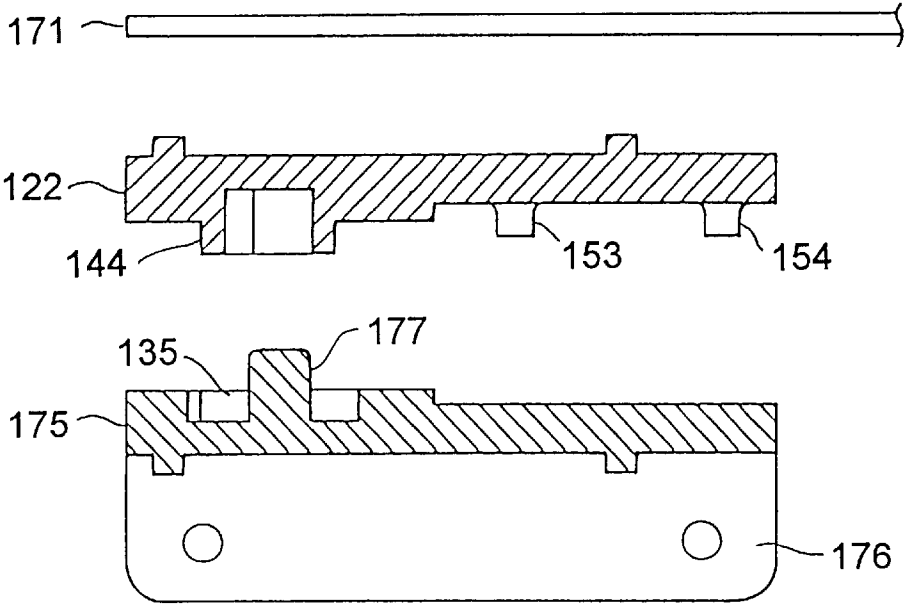

FIGS. 36A and 36B are exploded views showing how the slide cam member 122 and the lock cam member 175 are fitted. FIG. 36A is a front view, and FIG. 36B is a side view. In these figures, the slide cam member 122 is fitted on the door angle 171 that is fitted on the door (not shown), and the lock cam member 175 has its fitting portion 176 fitted directly on the body (not shown).

Figure 37A:
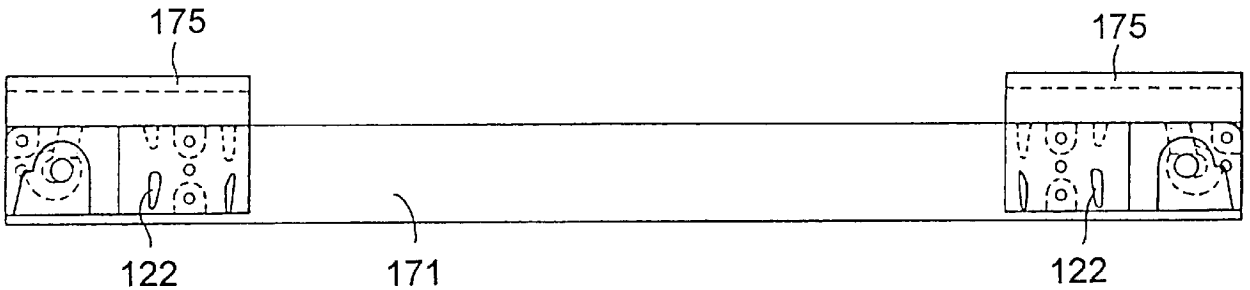
FIGS. 37A to 37C are diagrams showing the door angle of the door opening/closing mechanism of the sixth embodiment.
Figure 37B:
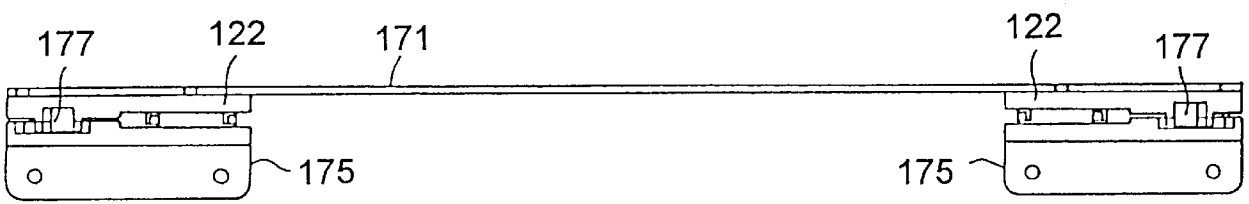
Figure 37C:
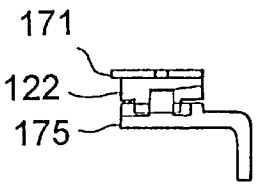

FIGS. 37A to 37C are a plan view, a front view, and a side view of the slide cam members 122 and the lock cam members 175 fitted in predetermined positions and combined together. Here, a pair of slide cam members 122 shaped symmetrically with each other and a pair of lock cam members 175 shaped symmetrically with each other are arranged in symmetrical positions at the right and left sides of the door. They thus form hinges of the door that can be opened at either the right or left side. Here, the weight of the door weighs on the top surface of the hinge pin 177.

Figure 38A:
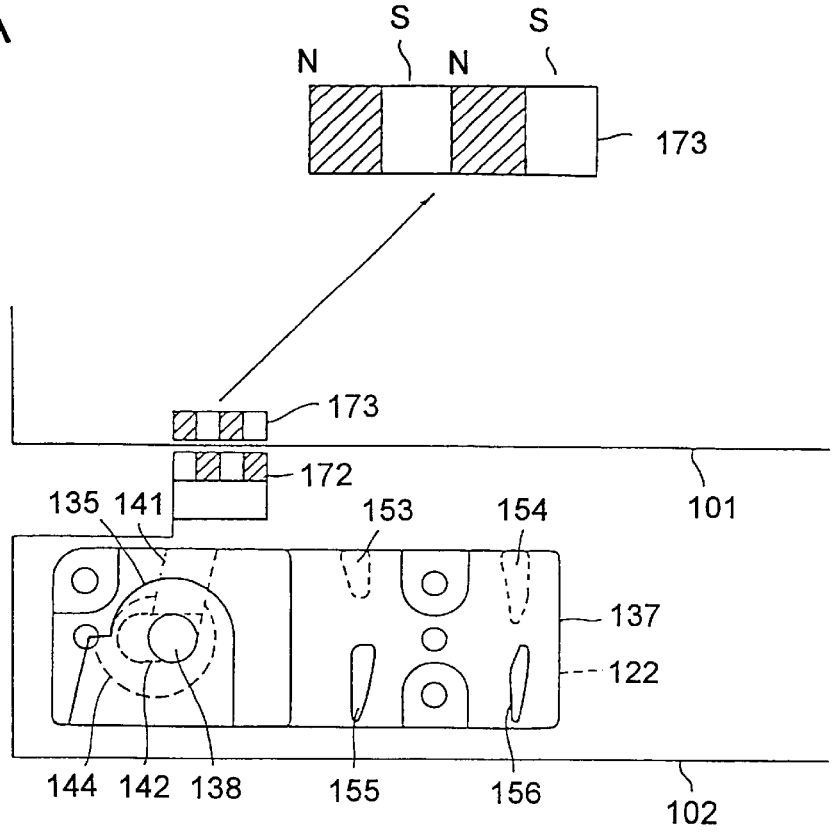
FIGS. 38A and 38B are diagrams illustrating the function of the permanent magnets fitted on the door-side and cabinet-side portions of the door opening/closing mechanism of the sixth embodiment.
Figure 38B:
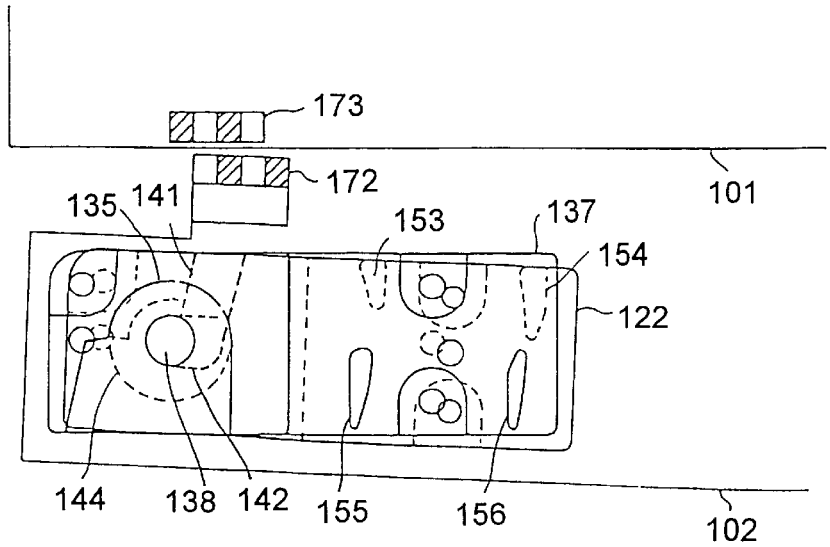

FIGS. 38A and 38B show how the door opening/closing mechanism acts when permanent magnets are fitted on the door and the body. As shown in FIG. 38A, on the rear face of the refrigerator compartment door 102 and on the front face of the refrigerator body 101, permanent magnets 172 and 173 are fitted that each have S and N poles arranged alternately in such a way that, between the two magnets 172 and 173, unlike poles face each other. When the refrigerator compartment door 102 is closed, the permanent magnets 172 and 173 attract each other by their magnetic force and thereby keep the refrigerator compartment air-tight.

When the refrigerator compartment door 102 starts being opened, as shown in FIG. 38B, like poles (i.e. S and S poles, or N and N poles) face each other between the two magnets 172 and 173, which thus repel each other magnetically. This makes it easy to open the door and guide the slide cam member 122 to the second lock position. Instead of the permanent magnets 172 and 173, it is also possible to use magnetism generating devices employing non-contact electric power supply devices or the like.

Figure 39:
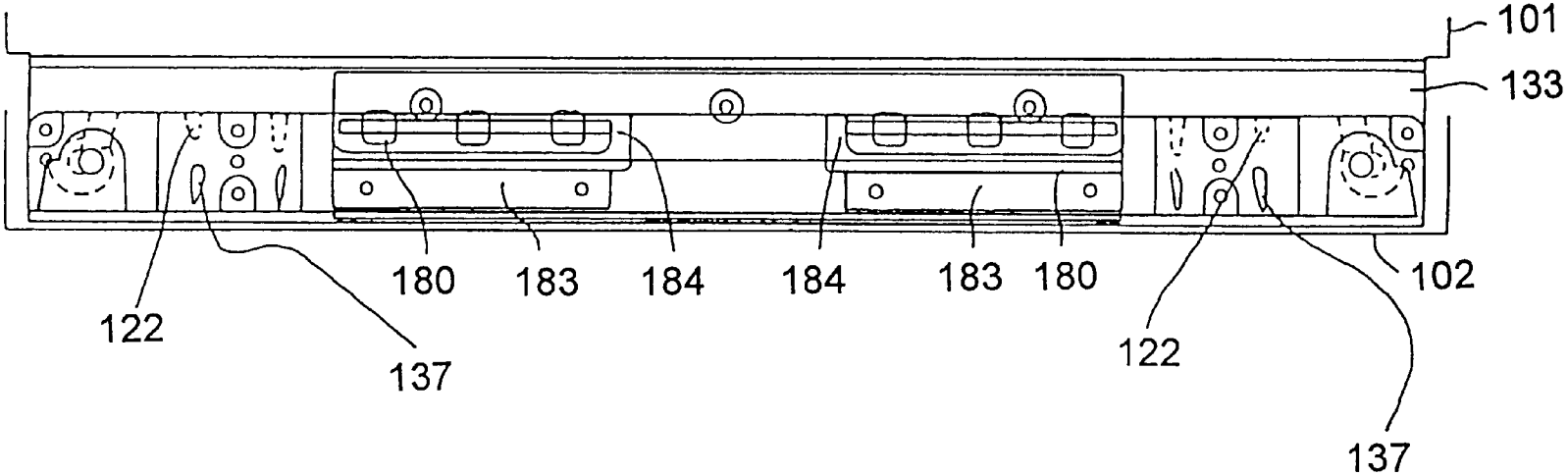
FIG. 39 is a plan view of the door opening/closing mechanism of the sixth embodiment, when it is fitted with guide rollers.
Figure 40:
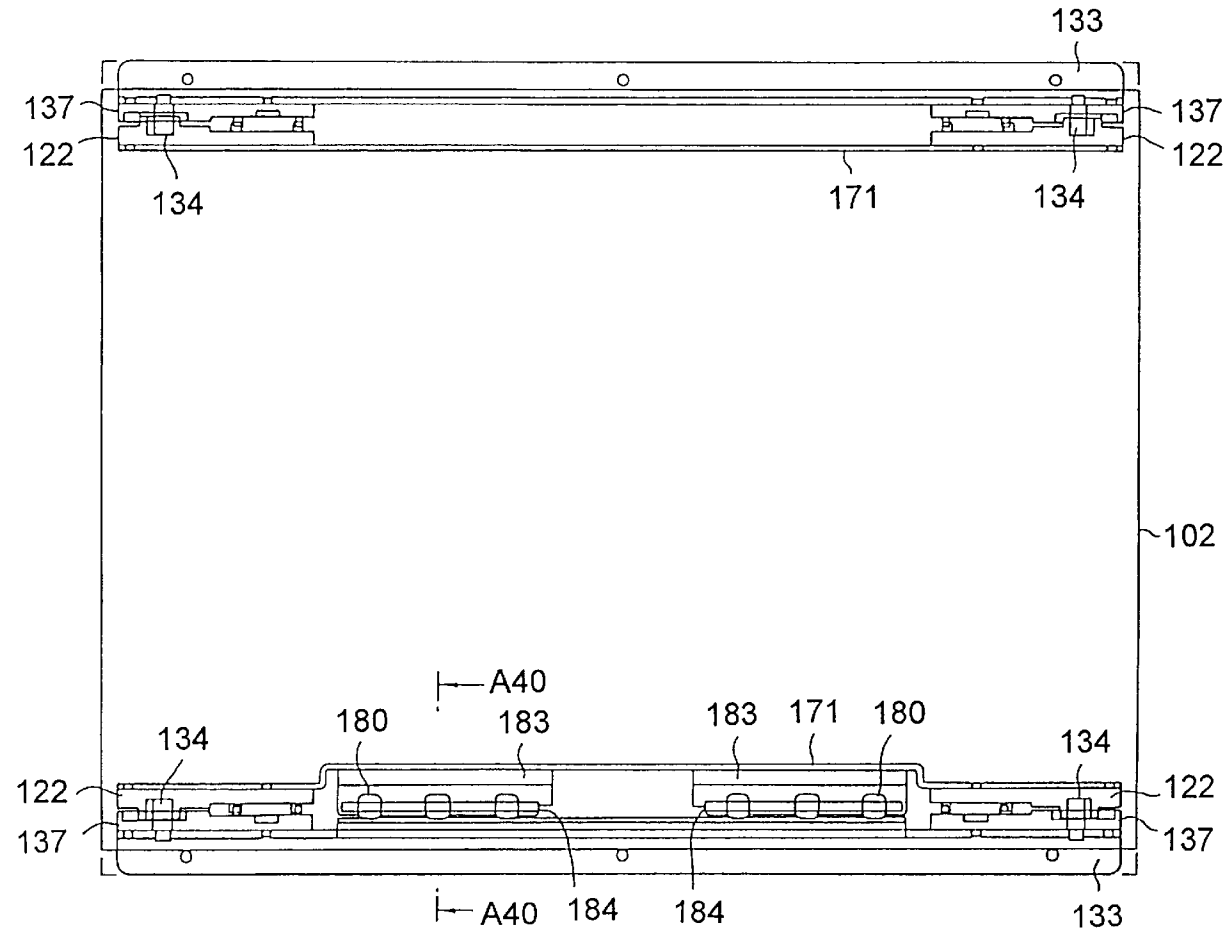
FIG. 40 is a front view of the door opening/closing mechanism of the sixth embodiment, when it is fitted with guide rollers.
Figure 41:
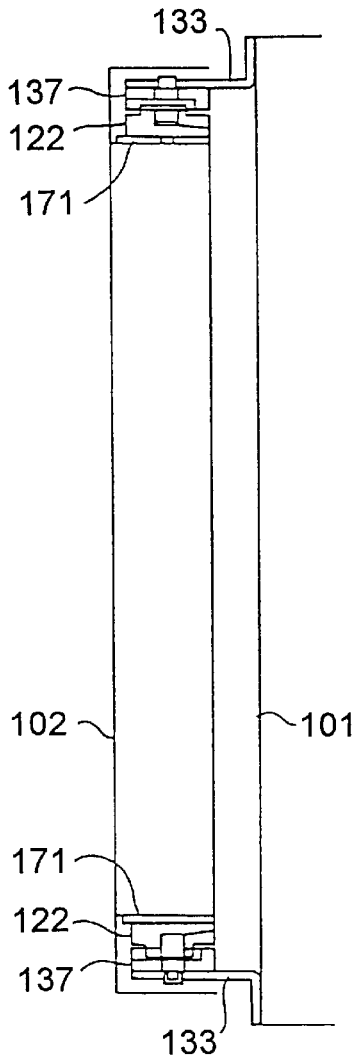
FIG. 41 is a side view of the door opening/closing mechanism of the sixth embodiment, when it is fitted with guide rollers.
Figure 42:
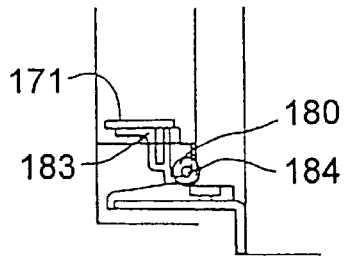
FIG. 42 is a sectional view taken along line A40—A40 of FIG. 40.

FIGS. 39 to 41 are a plan view, a front view, and a side view of the door opening/closing mechanism when it is additionally provided with a guide roller 180 that keeps the refrigerator compartment door 102 level. FIG. 42 is a sectional view along line A40—A40 of FIG. 40. In these figures, the slide cam members 122 are fitted on the door angles 171 that are fitted at the top and bottom of the refrigerator compartment door 102.

The lock cam members 137 are fitted on the hinge angles 133 that are fitted on the refrigerator body 101, on the top and bottom sides of the refrigerator chamber. On the hinge angles 133, the hinge pins 134 are fitted, and the hinge pins 134 penetrate the lock cam members 137 through the through holes 138 (see FIG. 33A) formed therein. On the lower door angle 171, a roller base 183 is fitted. Shaft pins 184 are fitted on the roller base 183, and a plurality of guide rollers 180 are fitted about the shaft pins 184.

In this construction, there are clearances between the hinge pins 134 and the slide cam members 122. Therefore, when the refrigerator compartment door 102 is opened, the weight of the refrigerator compartment door 102 itself and the weight of the articles stored in the refrigerator compartment door 102 cause the refrigerator compartment door 102 to lean slightly forward. The hinge angle 133 fitted on the bottom side of the refrigerator compartment of the refrigerator body 101 is fitted with a guide (not shown). When the refrigerator compartment door 102 is closed, this guide, together with the guide rollers 180 fitted on the refrigerator compartment door 102, helps restrict the inclination of the refrigerator compartment door 102 so as to keep it level. This makes it possible to make parallel, at the open side of the door, the line connecting the upper and lower slide cams 122 and the line connecting the upper and lower hinge pins 134.

Figure 43:
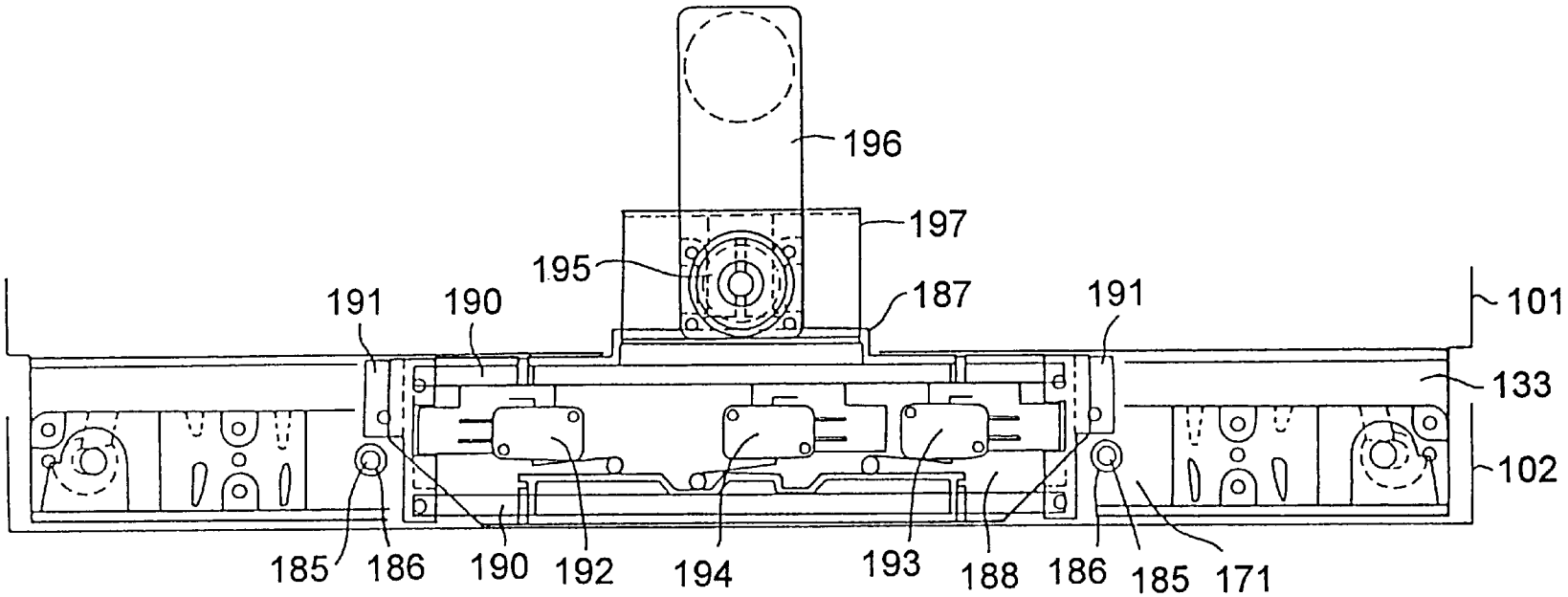
FIG. 43 is a plan view of the door opening/closing mechanism of the sixth embodiment, when it is fitted with an electric drive mechanism.
Figure 44:
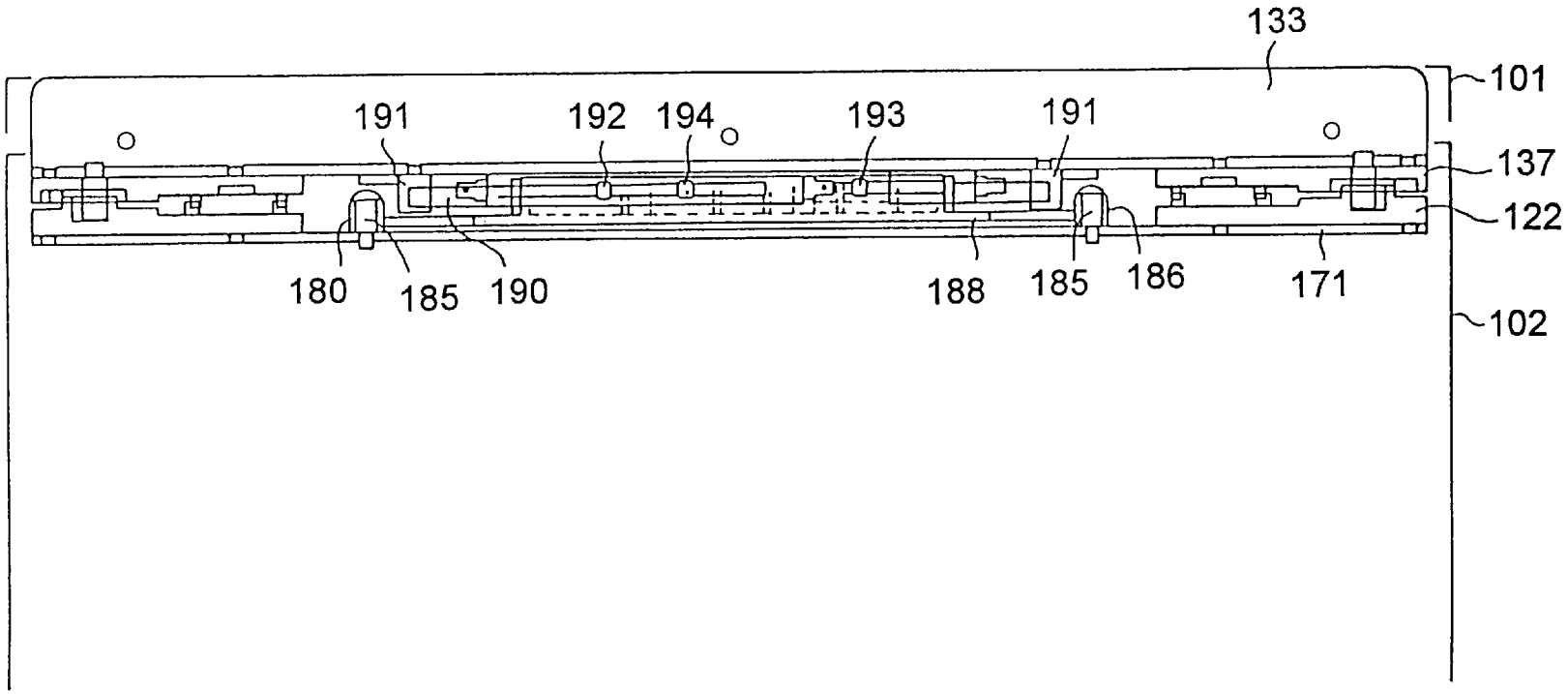
FIG. 44 is a front view of the door opening/closing mechanism of the sixth embodiment, when it is fitted with an electric drive mechanism.
Figure 45:
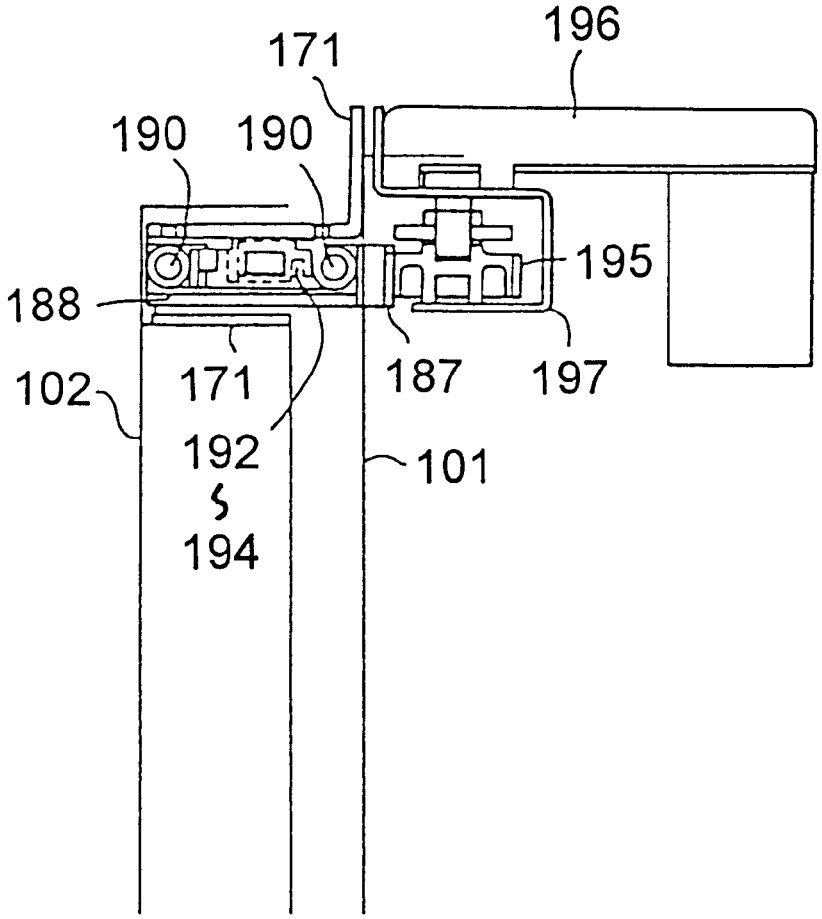
FIG. 45 is a side view of the door opening/closing mechanism of the sixth embodiment, when it is fitted with an electric drive mechanism.

FIGS. 43 to 45 are a plan view, a front view, and a side view of an electric drive mechanism that permits the refrigerator compartment door 102 to be opened automatically. In these diagrams, the hinge angle 133 fitted on the refrigerator body 101 is fitted with shaft bracket 191. On the shaft brackets 191, guide shafts 190 are fixed. A slide plate 188 having a rack 187 is guided by the guide shafts 190 so as to be sidable in the direction of the length thereof.

To detect the actuated positions of the slide plate 188, left-hand and right-hand detection switches 192 and 193 are fitted on the hinge angle 133. To detect the stand-by position of the slide plate 188, a stand-by switch 194 is fitted on the hinge angle 133. Moreover, on the door angle 171 fitted on the refrigerator compartment door 102, rollers 186 are rotatably fitted by fixing pins 185.

Moreover, a motor angle 197 is fitted on the refrigerator body 101, and a drive motor 196 is fitted on the motor angle 197. The drive motor 196 drives a pinion gear 195 to rotate, and the pinion gear 195, which meshes with the rack 187, converts the rotation into linear movement, which causes the slide plate 188 to slide.

Figure 46A:
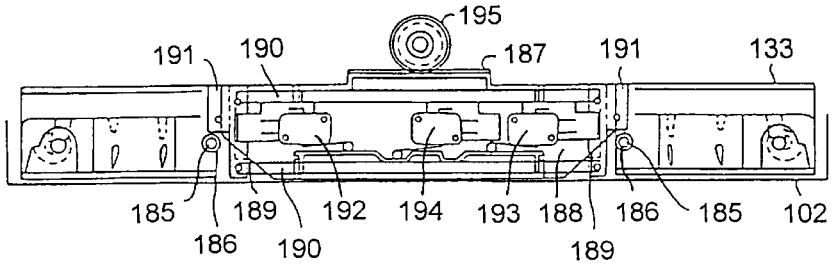
FIGS. 46A to 46C are diagrams illustrating the operation of the electric drive mechanism of the door opening/closing mechanism of the sixth embodiment.
Figure 46B:
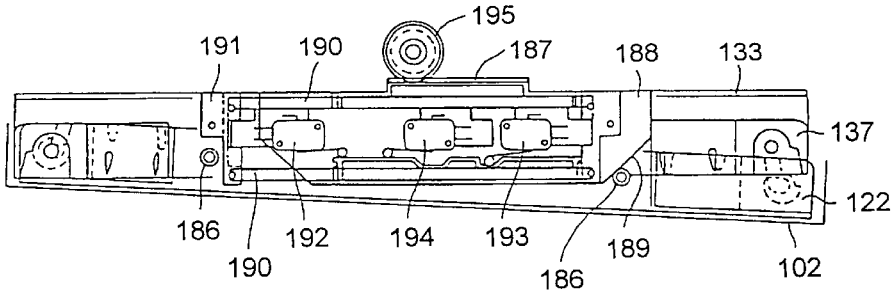
Figure 46C:
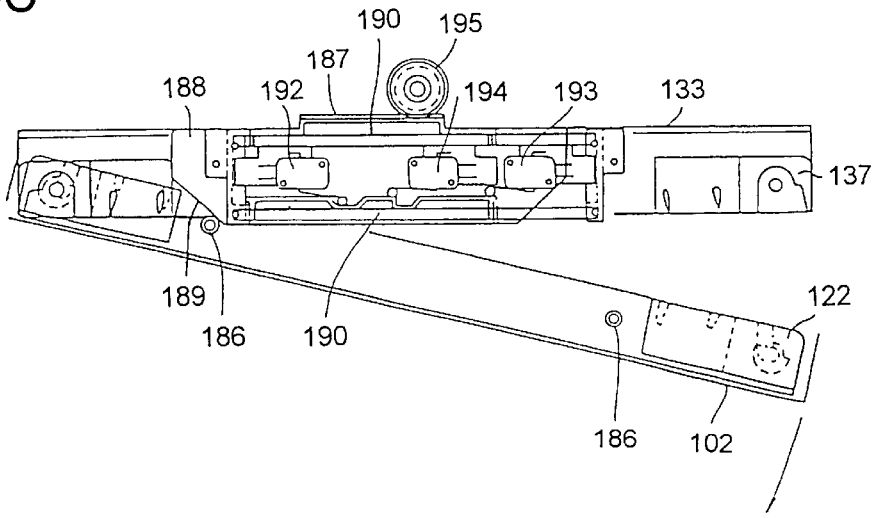

FIGS. 46A to 46C show the action of this electric drive mechanism. FIG. 46A shows the state observed when the refrigerator compartment door 102 is closed, i.e. a stand-by state. At this time, the stand-by switch 194 is off, and the detection switches 192 and 193 are on.

When the user operates a touch switch or the like (not shown) provided on the surface of the refrigerator compartment door 102 or of the refrigerator body 101 and thereby produces a signal that requests the refrigerator compartment door 102 to be opened at the right side, the drive motor 196 drives the pinion gear 195 to rotate counter-clockwise. Then, as shown in FIG. 46B, the rack 187 converts the rotation into linear movement, which causes the slide plate 188 to slide rightward as seen in the figure.

Then, a right-hand slide surface 189 formed in the slide plate 188 presses the right-hand roller 186 and thereby causes the refrigerator compartment door 102 to open slightly. At this time, the right-hand detection switch 193 is off, and the left-hand detection switch 192 and the stand-by switch 194 are on. Now, according to FIG. 57 described later, the electric drive mechanism returns to the state shown in FIG. 46A. However, in this embodiment, the electric drive mechanism operates further to open the door further automatically.

Specifically, as shown in FIG. 46C, the slide plate 188 is slid leftward as seen in the figure so that a left-hand slide surface 189 presses the left-hand roller 186. This causes the refrigerator compartment door 102 to open further. At this time, the left-hand detection switch 192 is off, and the right-hand detection switch 193 and the stand-by switch 194 are on. Then, the electric drive mechanism returns to the state shown in FIG. 46A.

Thereafter, the user opens the refrigerator compartment door 102 manually. When the refrigerator compartment door 102 is opened at the left side, it acts in a manner reversed left to right as compared with the action described above. The slide surface 189 has a sufficiently long inclined surface to absorb a variation in the outermost distance L (see FIG. 32A) between the second groove cams 142, and therefore, even if there is a variation there due to assembly errors and thermal expansion, it does not affect the opening action.

Figure 47A:
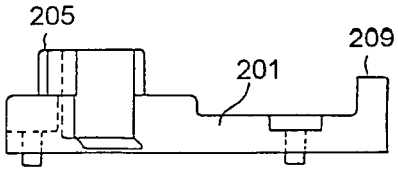
FIGS. 47A to 47F are diagrams showing the slide cam member of the door opening/closing mechanism of a seventh embodiment of the invention.
Figure 47B:
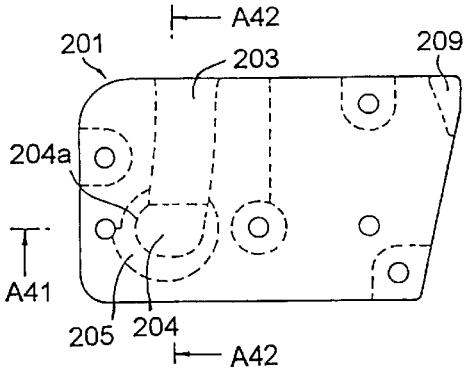
Figure 47E:
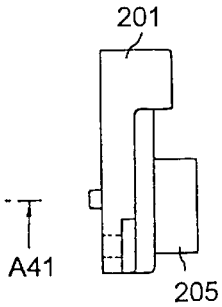
Figure 47F:
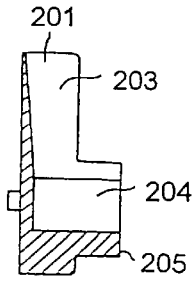
Figure 47C:
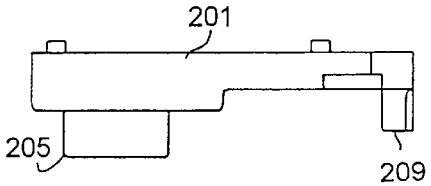
Figure 47D:
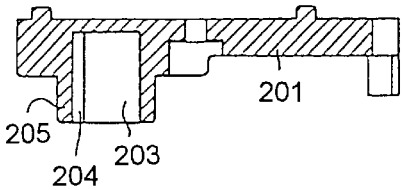
Figure 48A:
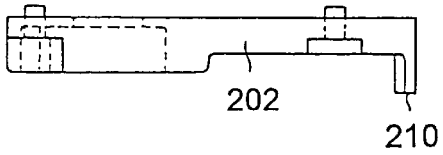
FIGS. 48A to 48F are diagrams showing the lock cam member of the door opening/closing mechanism of the seventh embodiment.
Figure 48B:
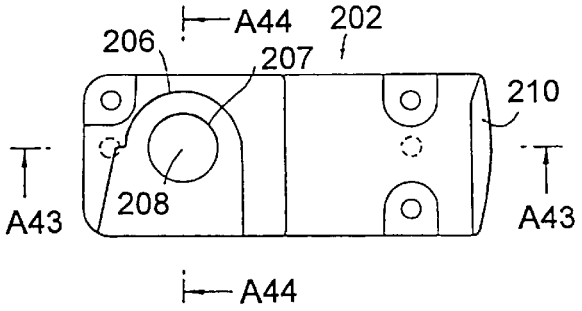
Figure 48E:
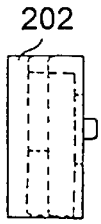
Figure 48F:
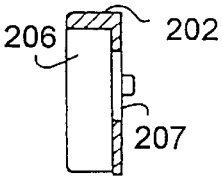
Figure 48C:
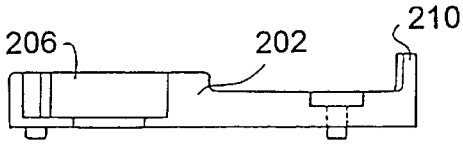
Figure 48D:
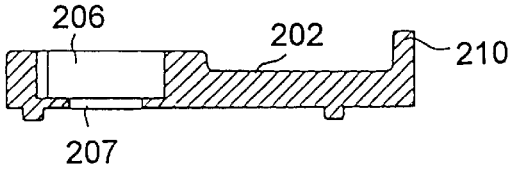

FIGS. 47A to 47F and FIGS. 48A to 48F are detail views of the slide cam member 201 and the lock cam member 202 of the door opening/closing mechanism of a seventh embodiment of the invention. FIGS. 47A and 48A are rear views, FIGS. 47B and 48B are plan views, and FIGS. 47C and 48C are front views. FIG. 47D is a sectional view along line XLVII D—XLV-IID of FIG. 47B. FIG. 48D is a sectional view along line XLVIII-D—XLVIII-D of FIG. 48B. FIGS. 47E and 48E are side views. FIG. 47F is a sectional view along line XLVII-F XLVII-F of FIG. 47B. FIG. 48F is a sectional view along line XLVIII-F—XLVIII-F of FIG. 48B.

In FIG. 48B, the hinge pin 134 (not shown) fitted on the body penetrates the lock cam member 202 through a through hole 207 formed therein so that the hinge pin 134 serves as a rotation axis 208 about which the door rotates.

In FIG. 47B, a first groove cam 203 formed in the slide cam member 201 is guided by the rotation axis 208. A second groove cam 204 has a circular portion 204*a* and serves to guide the slide cam member 201 to a position where it does not come off the rotation axis 208. As the door is opened, a first cam projection 205 formed on the slide cam member 201 is guided by a second cam projection 206 formed on the lock cam member 202 so that the former slides on the latter. This prevents the slide cam member 201 from coming off the rotation axis 208 and thereby prevents the door from coming off the body.

Furthermore, on the slide cam member 201, a slide outer cam 209 is formed that has both of its side walls so shaped as to have arc-shaped cross sections. Similarly, on the lock cam member 202, a lock outer cam 210 is formed that has both of their side walls so shaped as to have arc-shape cross sections. As the door is opened, the slide outer cam 209 is guided by the lock outer cam 210 so that the former slides along the latter. This makes it possible to guide the slide cam member 201 more securely to the position where it does not come off the rotation axis 208.

Figure 49A:
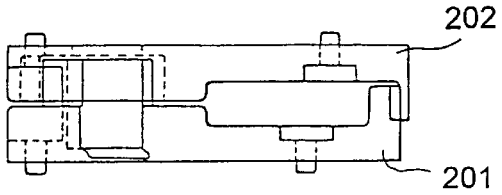
FIGS. 49A to 49F are diagrams showing the engagement between the slide cam member and the lock cam member of the door opening/closing mechanism of the seventh embodiment.
Figure 49B:
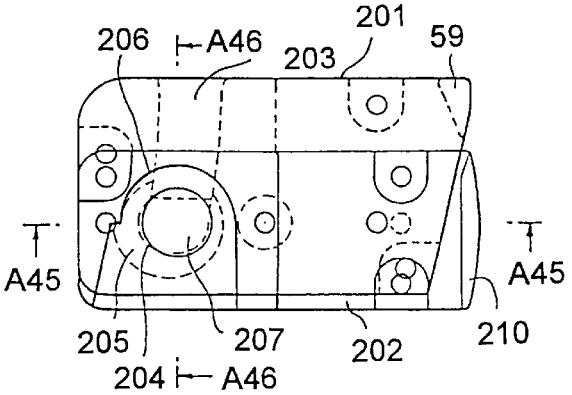
Figure 49E:
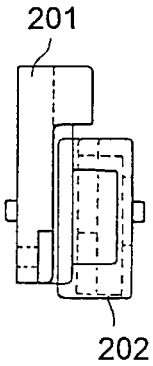
Figure 49F:
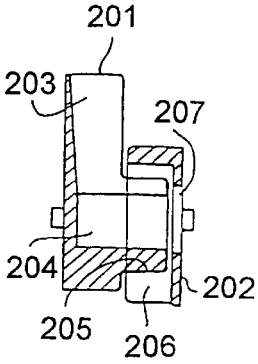
Figure 49C:
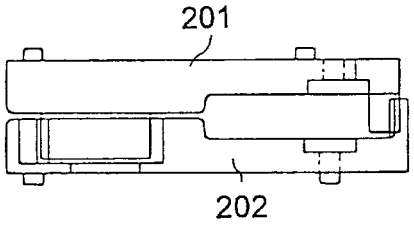
Figure 49D:
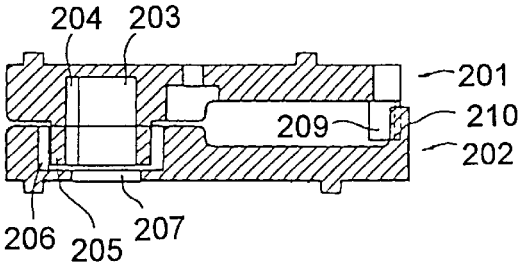

FIGS. 49A to 49F are diagrams showing the slide cam member 201 and the lock cam member 202 combined together. FIGS. 49A to 49C are a rear view, a plan view, and a front view, respectively. FIG. 49D is a sectional view along line XLIX-D—XLIX-D of FIG. 49B. FIG. 49E is a side view. FIG. 49F is a sectional view along line XLIX-F—XLIX-F of FIG. 49B. These figures show the positional relationship among the individual components as observed when the door is completely closed.

Figure 50A:
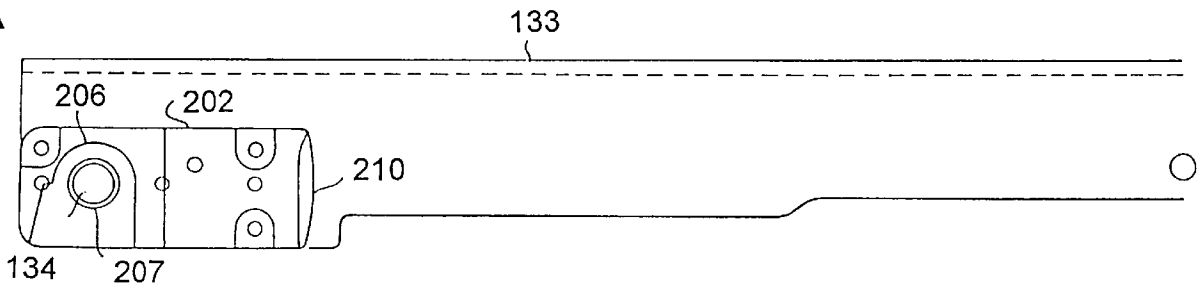
FIGS. 50A to 50D are diagrams showing how the slide cam member and the lock cam member are fitted in the door opening/closing mechanism of the seventh embodiment.
Figure 50B:
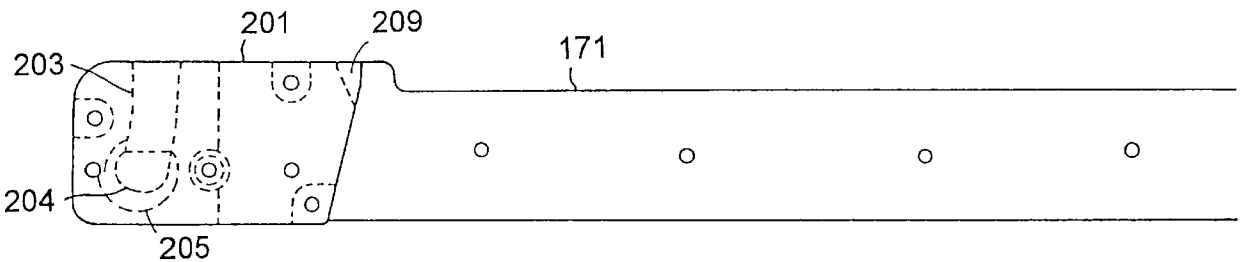
Figure 50C:
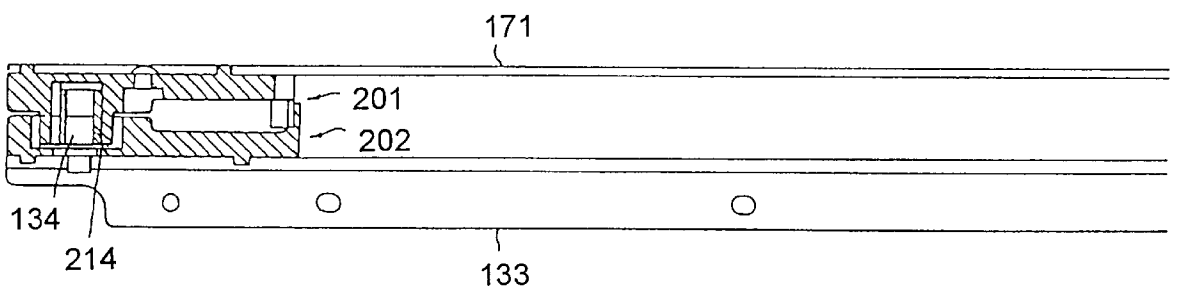
Figure 50D:
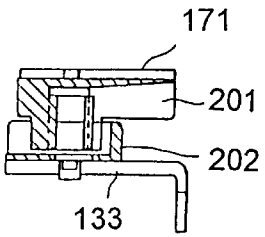

FIGS. 50A to 50D are diagrams showing how the slide cam member 201 and the lock cam member 202 are fitted. FIG. 50A is a plan view showing how the lock cam member 202 is fitted. FIG. 50B is a plan view showing how the slide cam member 201 is fitted. FIG. 50C is a front view, and FIG. 50D is a side view. A pair of slide cam members 201 shaped symmetrically with each other and a pair of lock cam members 202 shaped symmetrically with each other are arranged in symmetrical positions at the right and left sides of the door.

In these figures, the slide cam member 201 is fitted on a door angle 171 that is fitted on the door (not shown). The lock cam member 202 is fitted on a hinge angle 133 that is fitted on the body (not shown). On the hinge angle 133, a hinge pin 134 is firmly fitted. Moreover, around the hinge pin 134, a roller 214 is rotatably fitted. The hinge pin 134 and the roller 214 are fitted through the through hole 207 of the lock cam member 202.

In this embodiment, only one slide outer cam 209 and one lock outer cam 210 are formed on the slide cam member 201 and the lock cam member 202, respectively. This helps simplify the shapes of the components. Moreover, the provision of the roller 214 around the hinge pin 134 ensures smooth opening/closing of the door, and also reduces the friction noise that occurs when the door is opened/closed.

FIGS. 51A to 51G are plan views showing the action of the slide cam member 201 and the lock cam member 202 of the door opening/closing mechanism that permits the door to be opened at either the right or left side. These figures show a case where the door is opened at the right side.

Figure 51A:
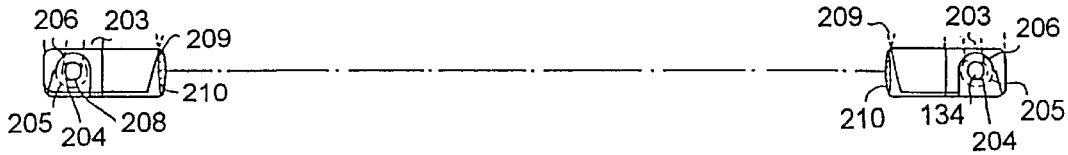
FIGS. 51A to 51G are plan views showing the relative positions of the lock cam member and the slide cam member of the door opening/closing mechanism of the seventh embodiment, when the door is opened.

FIG. 51A shows the state observed when the door is completely closed. Here, the cam mechanism is in a first lock position. The slide cam members 201 fitted on the door and the lock cam members 202 fitted on the body are combined together in symmetrical, right-hand and left-hand, positions. At this time, the first groove cams 203 formed in the right-hand and left-hand slide cam members 201 both point inward with respect to the door. The right-hand and left-hand first groove cams 203 are both kept in fixed positions by the hinge pins 134 and the rollers 214 (not shown), and therefore, even if the user pulls forward the door at both the right and left sides simultaneously, the door never comes off the body.

Figure 51B:
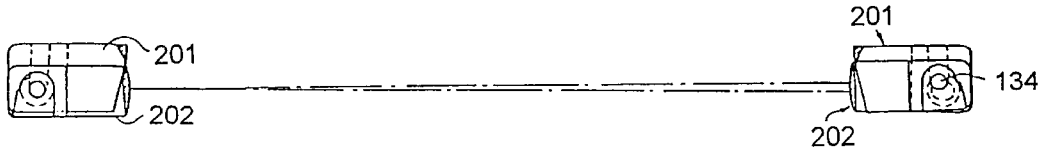
Figure 51C:
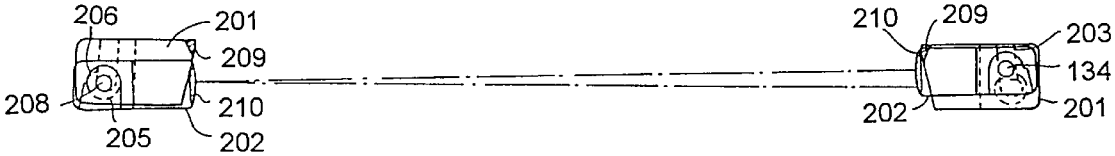

FIGS. 51B and 51C show a state observed when the door starts being opened at the right side. The first groove cam 203 formed in the right-hand slide cam member 201 is located in a position where it can be released from the first lock position. At this time, the first groove cam 203 is guided by the hinge pin 134 so that the door slides slightly rightward. Thus, the second groove cam 204 formed in the left-hand slide cam member 201 and the hinge pin 134 fitted through the through hole 207 formed in the left-hand lock cam member 202 are so located as to prevent the slide cam member 201 from coming off the left-hand rotation axis 208.

Figure 51D:
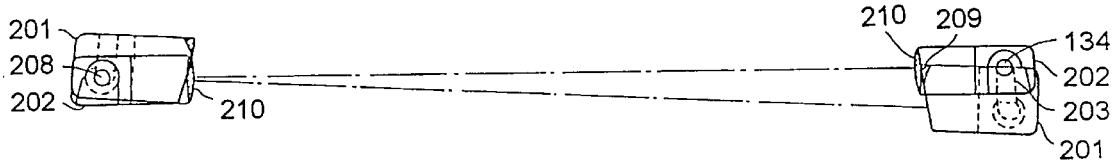

Furthermore, as shown in FIG. 51D, as the door rotates, the first cam projection 205 formed on the left-hand slide cam member 201 is guided by the second cam projection 206 formed on the left-hand lock cam member 202 so that the former slides on the latter. This prevents the slide cam member 201 from coming off the left-hand rotation axis 208 and thereby prevents the door from coming off so that the door can be opened and closed securely.

Moreover, engagement progresses between the slide outer cam 209 formed on the right-hand slide cam member 201 and the lock outer cam 210 formed on the right-hand lock cam member 202. The slide outer cam 209 formed on the left-hand slide cam member 201 starts engaging with the lock outer cam 210 formed on the left-hand lock cam member 202.

Figure 51E:
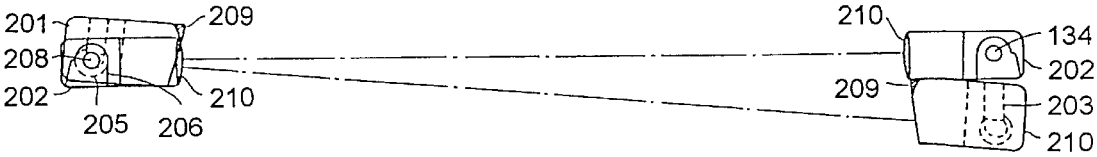

Then, as shown in FIG. 51E, as the door rotates further, the slide outer cam 209 formed on the right-hand slide cam member 201 disengages form the lock outer cam 210 formed on the right-hand lock cam member 202. Engagement progresses between the slide outer cam 209 formed on the left hand slide cam member 201 and the lock outer cam 210 formed on the left-hand lock cam member 202.

Figure 51F:
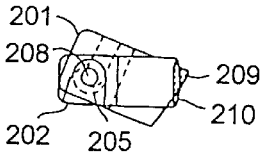
Figure 51G:
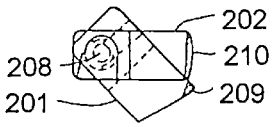

Then, in FIG. 51F, the slide outer cam 209 formed on the left-hand slide cam member 201 engages completely with the lock outer cam 210 formed on the left-hand lock cam member 202. At last when the door has rotated to the position shown in FIG. 51G, the slide outer cam 209 formed on the left-hand slide cam member 201 disengages from the lock outer cam 210 formed on the left-hand lock cam member 202.

The action described above prevents the door from coming off the body, and permits the door to be opened and closed securely. When the door is opened at the left side, it acts in a manner reversed left to right as compared with the action described above.

Figures 52A, 52B, 52C, 52D, 52E, 52F, 52G, 52H:
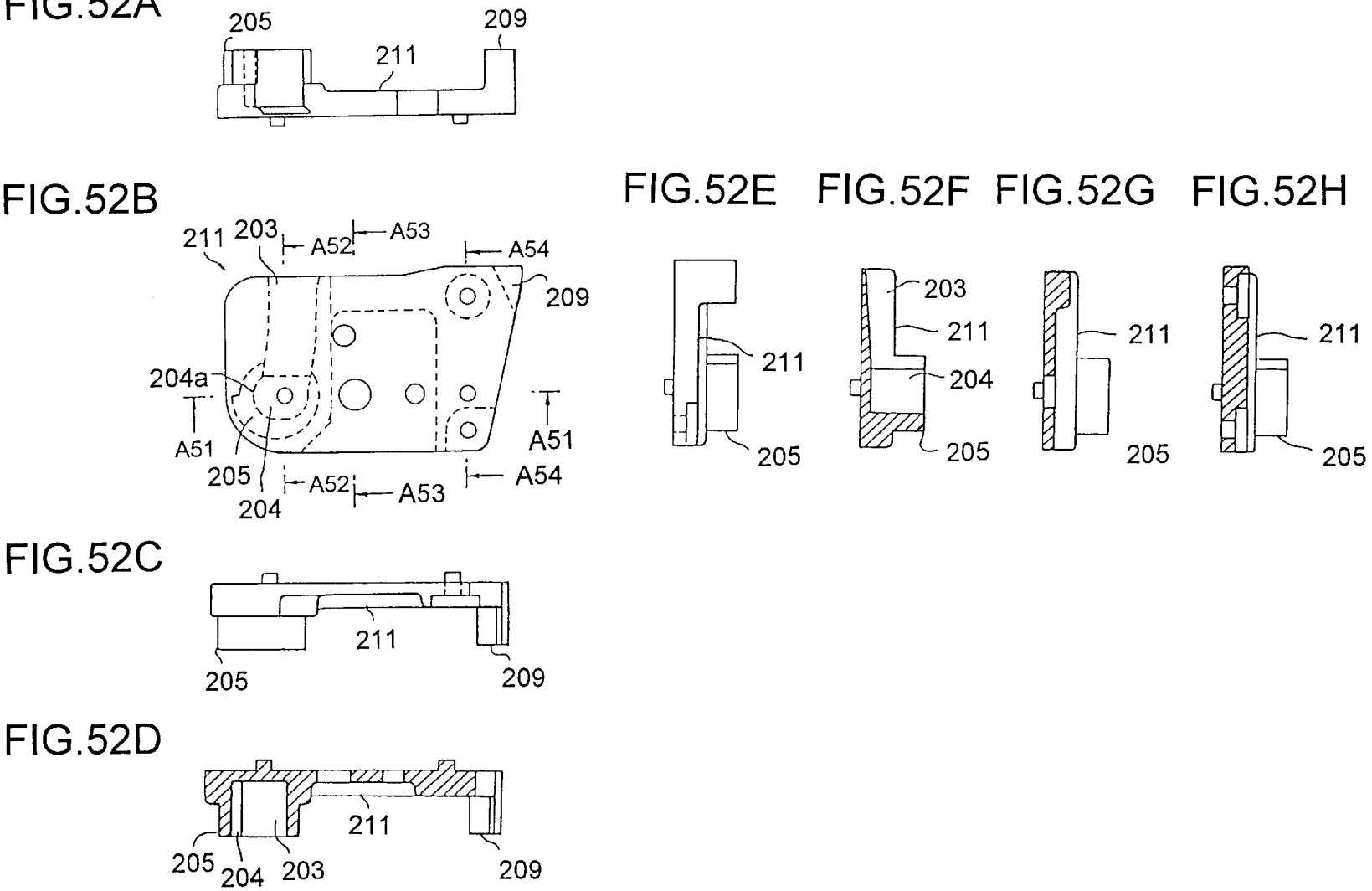
FIGS. 52A to 52H are diagrams showing the slide cam member of the door opening/closing mechanism of an eighth embodiment of the invention.

FIGS. 52A to 52H are detail views of the slide cam member 211 of the door opening/closing mechanism of an eighth embodiment of the invention. FIG. 52A is a rear view, FIG. 52B is a plan view, and FIG. 52C is a front view. FIG. 52D is a sectional view along line LII-D—LII-D of FIG. 52B. FIG. 52E is a side view. FIGS. 52F to 52H are sectional views along lines LII-F—LII-F, LII-G—LII-G, and LII-H—LII-H, respectively, of FIG. 52A.

Figures 53A, 53B, 53C, 53D, 53E, 53F, 53G, 53H, 53I, 53J:
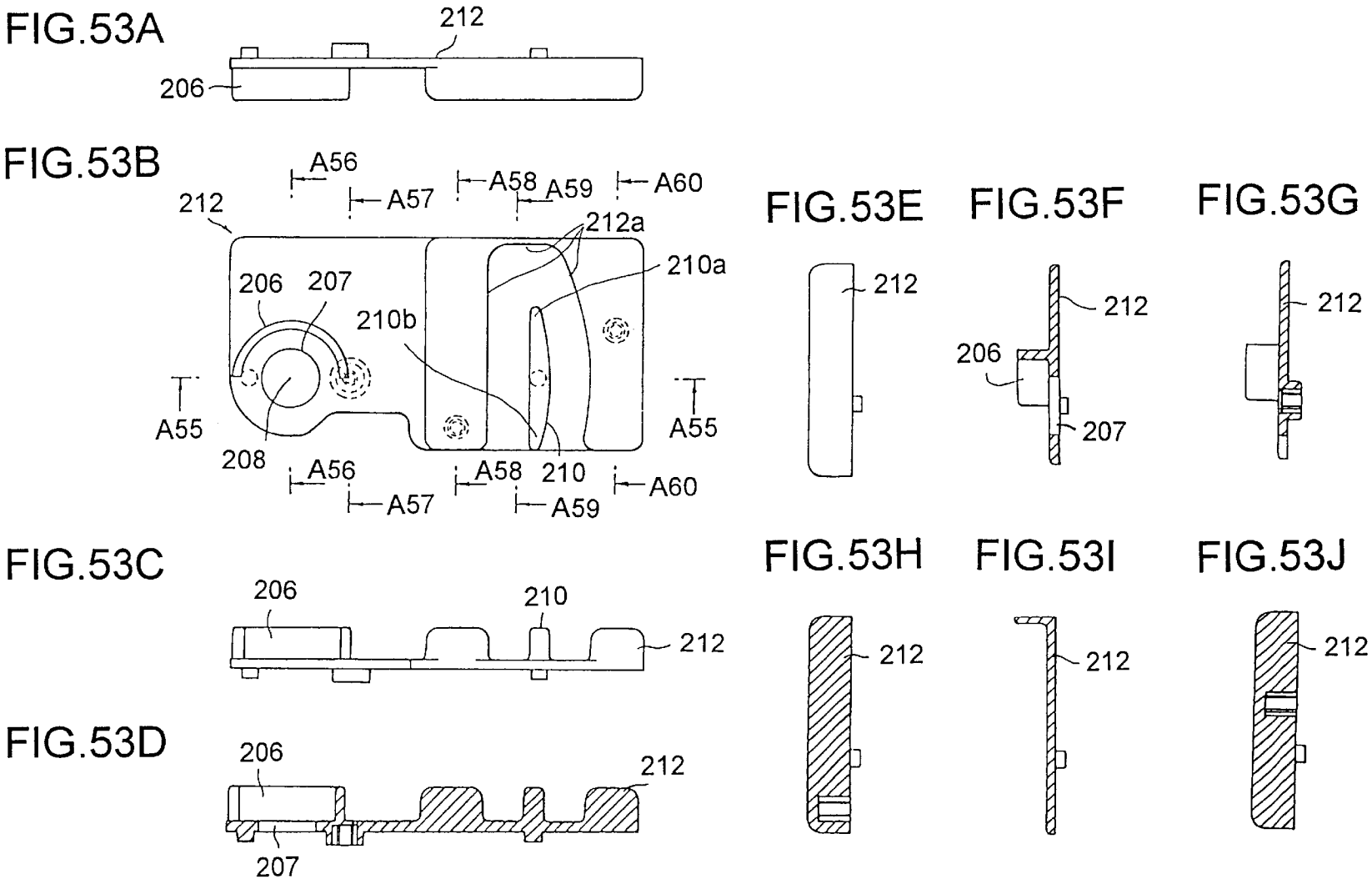
FIGS. 53A to 53J are diagrams showing the slide cam member of the door opening/closing mechanism of the eighth embodiment.

On the other hand, FIGS. 53A to 53J are detail views of the lock cam member 212. FIG. 53A is a rear view, FIG. 53B is a plan view, and FIG. 53C is a front view. FIG. 53D is a sectional view along line LIII-D—LIII-D of FIG. 53B. FIG. 53E is a side view. FIGS. 53F to 53J are sectional views along lines LIII-F—LIII-F, LIII-G—LIII-G, LIII-H—LIII-H, LIII-I—LIII-I, and LIII-J—LIII-J, respectively, of FIG. 53B.

In FIG. 53B, the hinge pin 134 (not shown) fitted on the body penetrates the lock cam member 212 through a through hole 207 formed therein so that the hinge pin 134 serves as a rotation axis 208 about which the door rotates.

In FIG. 52B, a first groove cam 203 formed in the slide cam member 211 is guided by the hinge pin 134. A second groove cam 204 has a circular portion 204*a* and serves to guide the slide cam member 211 to a position where it does not come off the rotation axis 208. As the door is opened, a first cam projection 205 formed on the slide cam member 211 is guided by a second cam projection 206 formed on the lock cam member 212 so that the former slides on the latter. This prevents the slide cam member 211 from coming off the rotation axis 208 and thereby prevents the door from coming off the body.

Furthermore, on the slide cam member 211, a slide outer cam 209 is formed that has both of its side walls so shaped as to have arc-shaped cross sections. Similarly, on the lock cam member 212, a lock outer cam 210 is formed that has both of their side walls so shaped as to have arc-shape cross sections. As the door is opened, the slide outer cam 209 is guided by the lock outer cam 210 so that the former slides along the latter. This makes it possible to guide the slide cam member 211 more securely to the position where it does not come off the rotation axis 208.

FIGS. 54A to 54G show a stopper 174. FIG. 54A is a left side view, FIG. 54B is a rear view, FIG. 54C is a plan view, and FIG. 54D is a front view. FIG. 54E is a sectional view along line LIV-E—LIV-E of FIG. 54C. FIG. 541F is a right side view. FIG. 54G is a sectional view along line LIV-G—

LIV-G of FIG. 54C. The stopper 174 is fitted on the slide cam member 211 and serves to restrict the maximum angle through which the door can be opened.

Figure 55A:
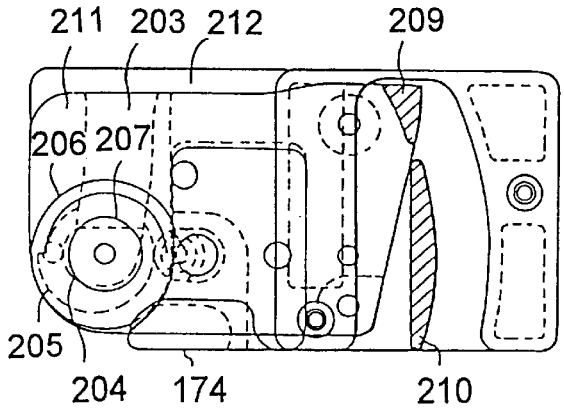
FIGS. 55A to 55C are diagrams showing the engagement between the slide cam member, the lock cam member, and the stopper of the door opening/closing mechanism of the eighth embodiment.
Figure 55B:
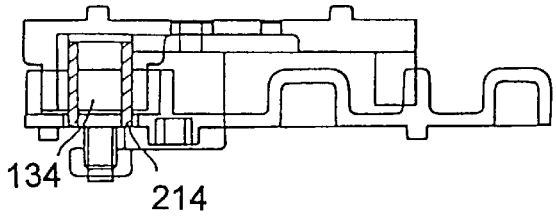
Figure 55C:
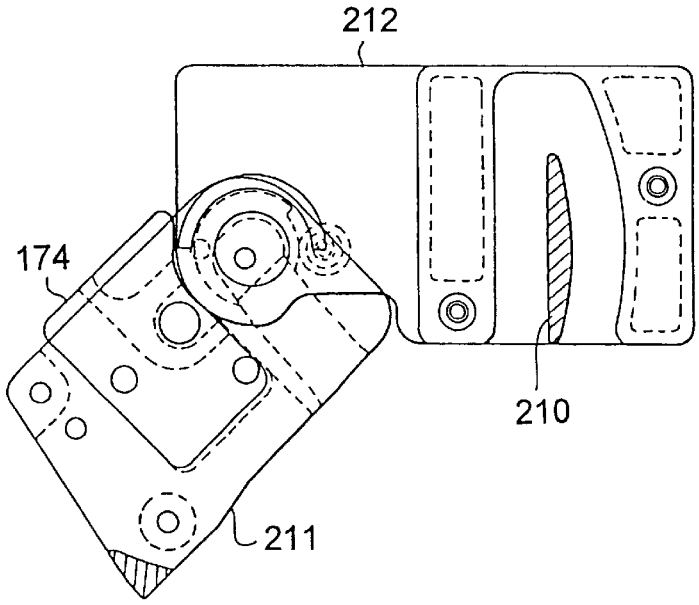

FIGS. 55A to 55C are diagrams showing the slide cam member 211, the lock cam member 212, and the stopper 174 combined together. FIGS. 55A and 55B are a plan view and a front view showing the positional relationship observed when the door is closed, and FIG. 55C is a plan view showing the positional relationship observed when the door is open.

In FIG. 55A, the slide cam member 211 is fitted on a door angle 171 (see FIG. 50B) that is fitted on the door. The lock cam member 212 is fitted on a hinge angle 133 (see FIG. 50A) that is fitted on the body. On the hinge angle 133, a hinge pin 134 is firmly fitted. Moreover, around the hinge pin 134, a roller 214 is rotatably fitted. The hinge pin 134 and the roller 214 are fitted through the through hole 207 of the lock cam member 202.

As shown in FIG. 55C, when the door is opened and rotated, for example, through 135°, the stopper 174 fitted on the slide cam member 211 strikes the side surface of the lock cam member 212. Thus, the door stops rotating in its widest open state. In this embodiment, as shown in FIG. 53B, the ends 210*a* and 210*b* of the lock outer cam 210 formed on the lock cam member 212 are formed into curved surfaces. Moreover, the lock outer cam 210 has walls 212*a* along three sides thereof. These not only prevent the user from being injured by touching the lock outer cam 210, but also prevent the lock outer cam 210 from being damaged by an external force.

Figure 56:
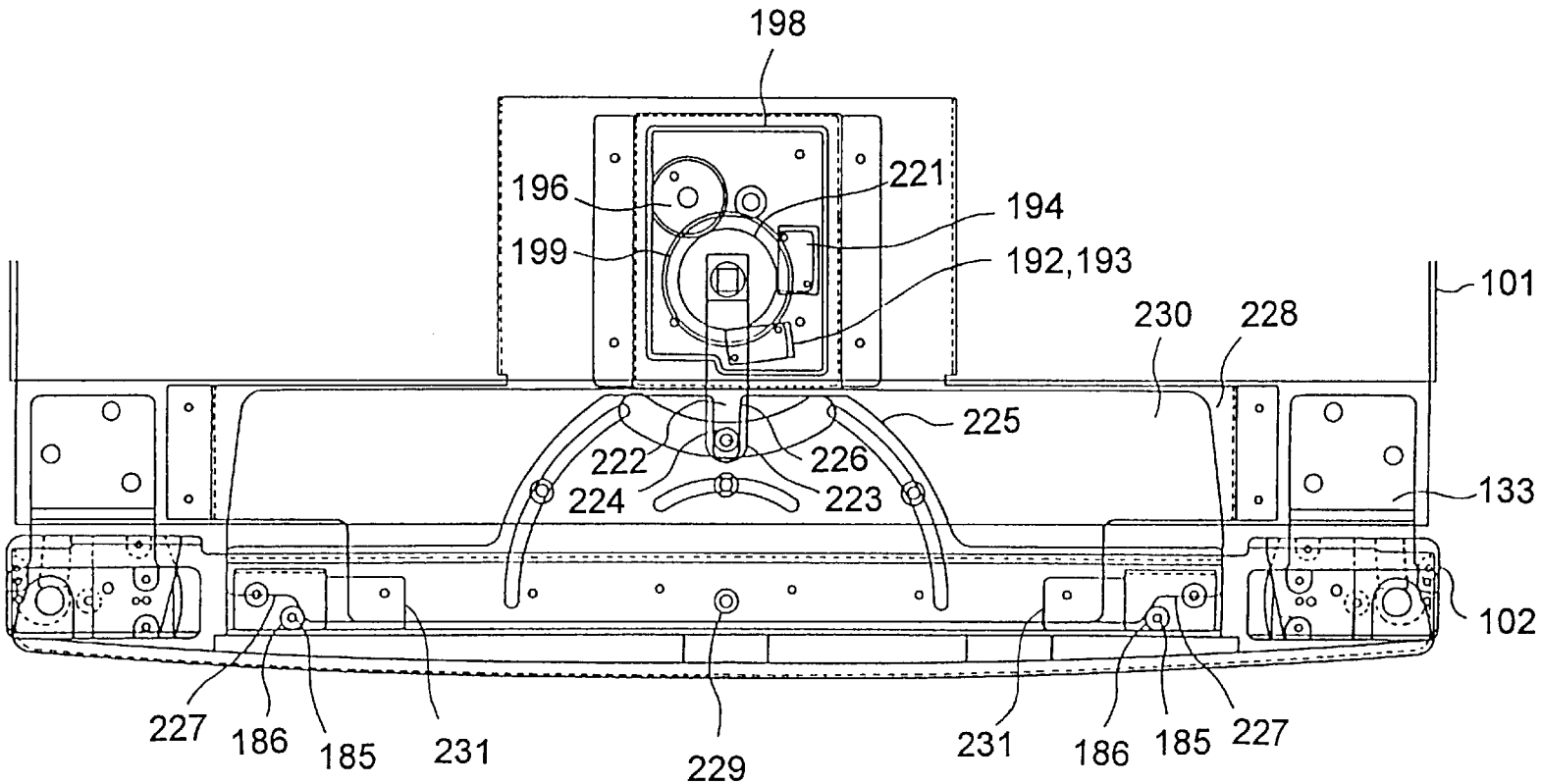
FIG. 56 is a plan view of the door opening/closing mechanism of the eighth embodiment, when it is fitted with an electric drive mechanism.
Figure 57:
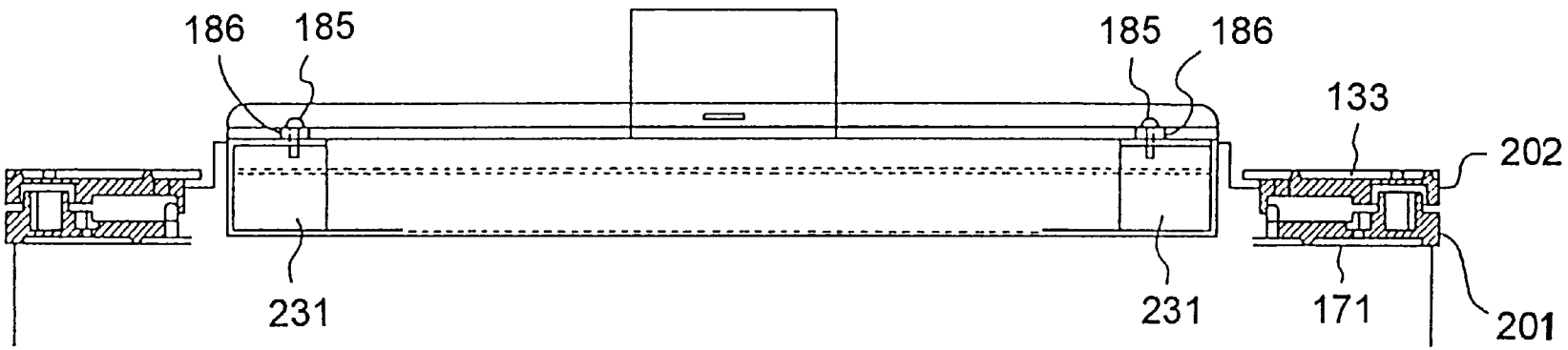
FIG. 57 is a front view of the door opening/closing mechanism of the eighth embodiment, when it is fitted with an electric drive mechanism.
Figure 58A:
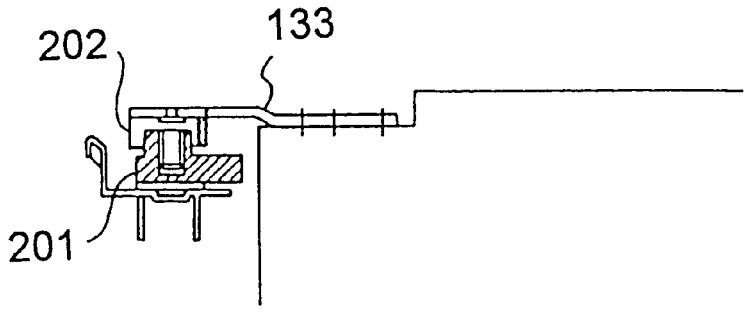
FIGS. 58A and 58B are side views of the door opening/closing mechanism of the eighth embodiment, when it is fitted with an electric drive mechanism.
Figure 58B:
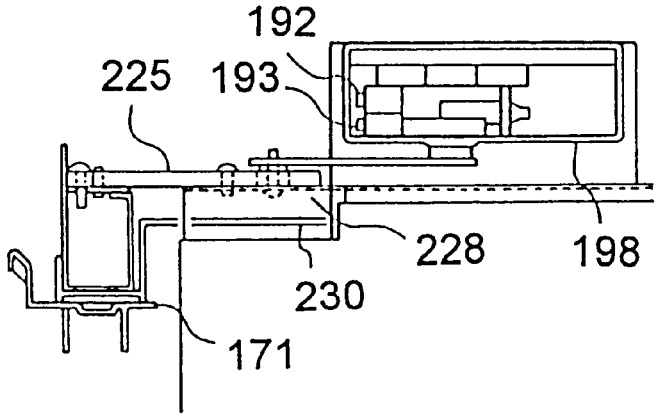

FIGS. 56 and 57 are a plan view and a front view showing the electric drive mechanism that permits the refrigerator compartment door 102 to be opened automatically in this embodiment, and FIGS. 58A and 58B are a sectional view as seen from the side and a side view thereof. This electric drive mechanism has a different construction from the one described previously and shown in FIGS. 43 to 45 and 46A to 46C. In these figures, on a chassis 228 fitted on the refrigerator body 101, a rotary plate 225 is fitted so as to be rotatable about a pivot 229. Moreover, inside a drive unit 198 fitted on the chassis 228, a drive motor 196 is fitted. The drive motor 196 drives a gear 199 to rotate, which in turn drives a lever 222 to rotate.

Inside the drive unit 198, detection switches 192 and 193 for detecting the actuated positions of the lever 222 and a stand-by switch for detecting the stand-by position of the lever 222 are fitted. The detection switches 192 and 193 and the stand-by switch 194 are turned on and off by cuts formed in a rotary cam 221 that is interlocked with the gear 199. Moreover, on brackets 231 fitted together with a cover 230 on the refrigerator compartment door 102, rollers 186 are rotatably fitted by fixing pins 185.

In FIG. 56, the refrigerator compartment door 102 is closed, and thus the electric drive mechanism is in a stand-by state. At this time, the stand-by switch 194 is off, and the detection switches 192 and 193 are on.

Figure 59:
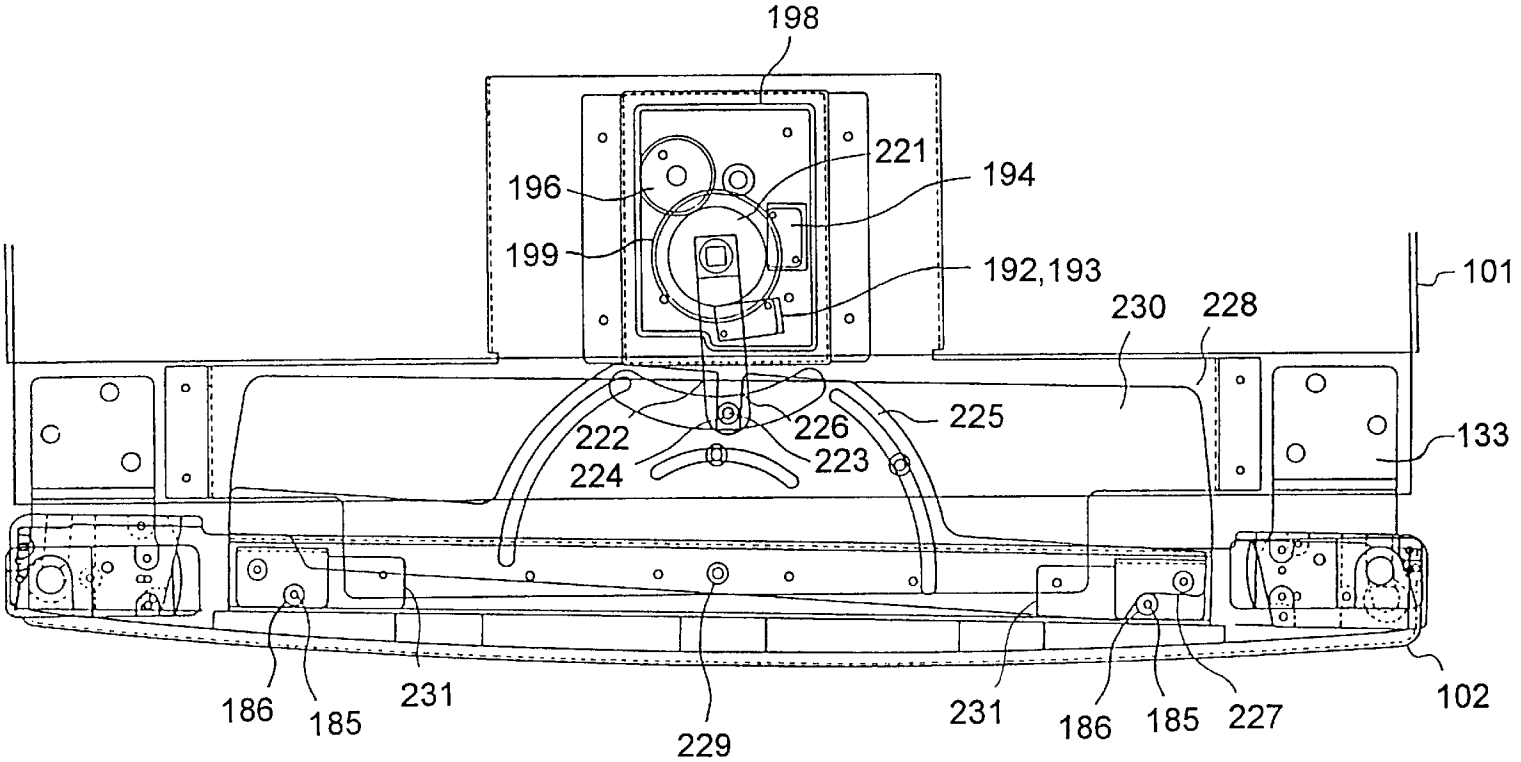
FIGS. 59 and 60 are diagrams illustrating the operation of the electric drive mechanism of the door opening/closing mechanism of the eighth embodiment.

When the user operates a touch switch or the like (not shown) provided on the surface of the refrigerator compartment door 102 or of the refrigerator body 101, a signal is issued that requests the refrigerator compartment door 102 to be opened at the right side. Then, as shown in FIG. 59, the drive motor 196 drives the gear 199 to rotate counter-clockwise, which in turn drives the lever 222 to rotate counter-clockwise. At the tip of the lever 222, a roller 224 is rotatably fitted by a fixing pin 223. As the lever 222 rotates, the roller 224 presses, a groove 226 formed in the rotary plate 225. This causes the rotary plate 225 to rotate clockwise about the pivot 229

Then, a right-hand slide surface 227 formed in the rotary plate 225 presses the right-hand roller 186 and thereby causes the refrigerator compartment door 102 to open slightly. At this time, the detection switch 192 and 193 and the stand-by switch 194 are all on.

Figure 60:
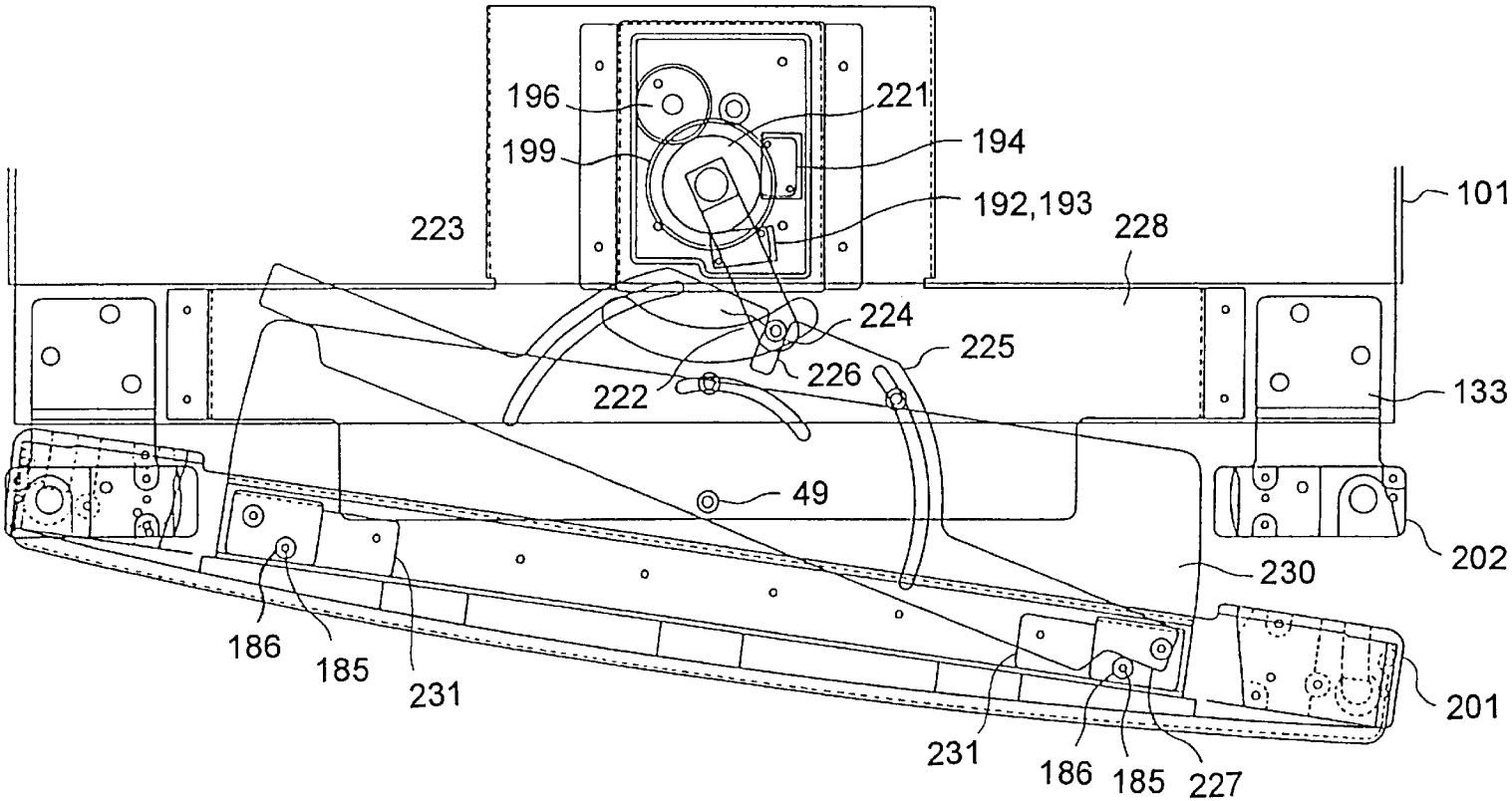

As shown in FIG. 60, as the lever 222 rotates further counter-clockwise and thus the rotary plate 225 rotates further clockwise, the refrigerator compartment door 102 is opened as much as can be achieved by this electric drive mechanism. At this time, the detection switch 193 is off, and the detection switch 192 and the stand-by switch 194 are on. Then, the electric drive mechanism returns to the state shown in FIG. 56. Thereafter, the user opens the refrigerator compartment door 102 manually. When the refrigerator compartment door 102 is opened at the left side, it acts in a manner reversed left to right as compared with the action described above.

Figure 61:
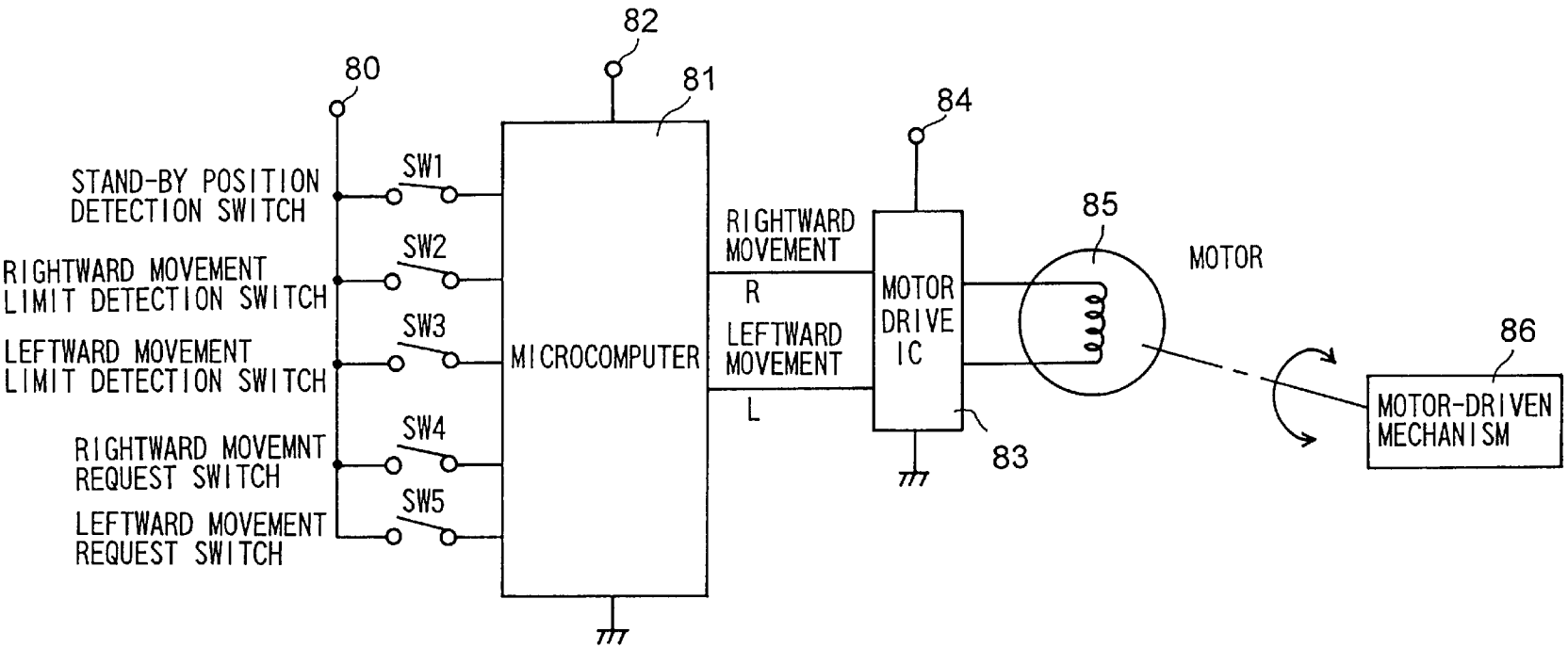
FIG. 61 is a circuit diagram of the electric drive mechanism of the door opening/closing mechanism of the eighth embodiment.

FIG. 61 shows the configuration of the electric circuit of this electric drive mechanism. Reference numeral 81 represents a microcomputer that operates in accordance with a program stored therein and the signals fed thereto from a stand-by position detection switch SW1, a rightward movement limit detection switch SW2, a leftward movement limit detection switch SW3, a rightward movement request switch SW4, a leftward movement request switch SW5, and others.

Reference numeral 83 represents a motor drive circuit, and reference numeral 85 represents a motor. Reference numeral 86 represents a mechanism driven by the motor. The motor 85, the motor-driven mechanism 86, the switches SW1, SW2, and SW3 correspond to the switches, motor, and others (although identified with different reference symbols) shown in FIGS. 43, 56, 57, 58A, and 58B. In FIG. 61, reference numerals 80, 82, and 84 represent terminals for electric power supply.

Figure 62:
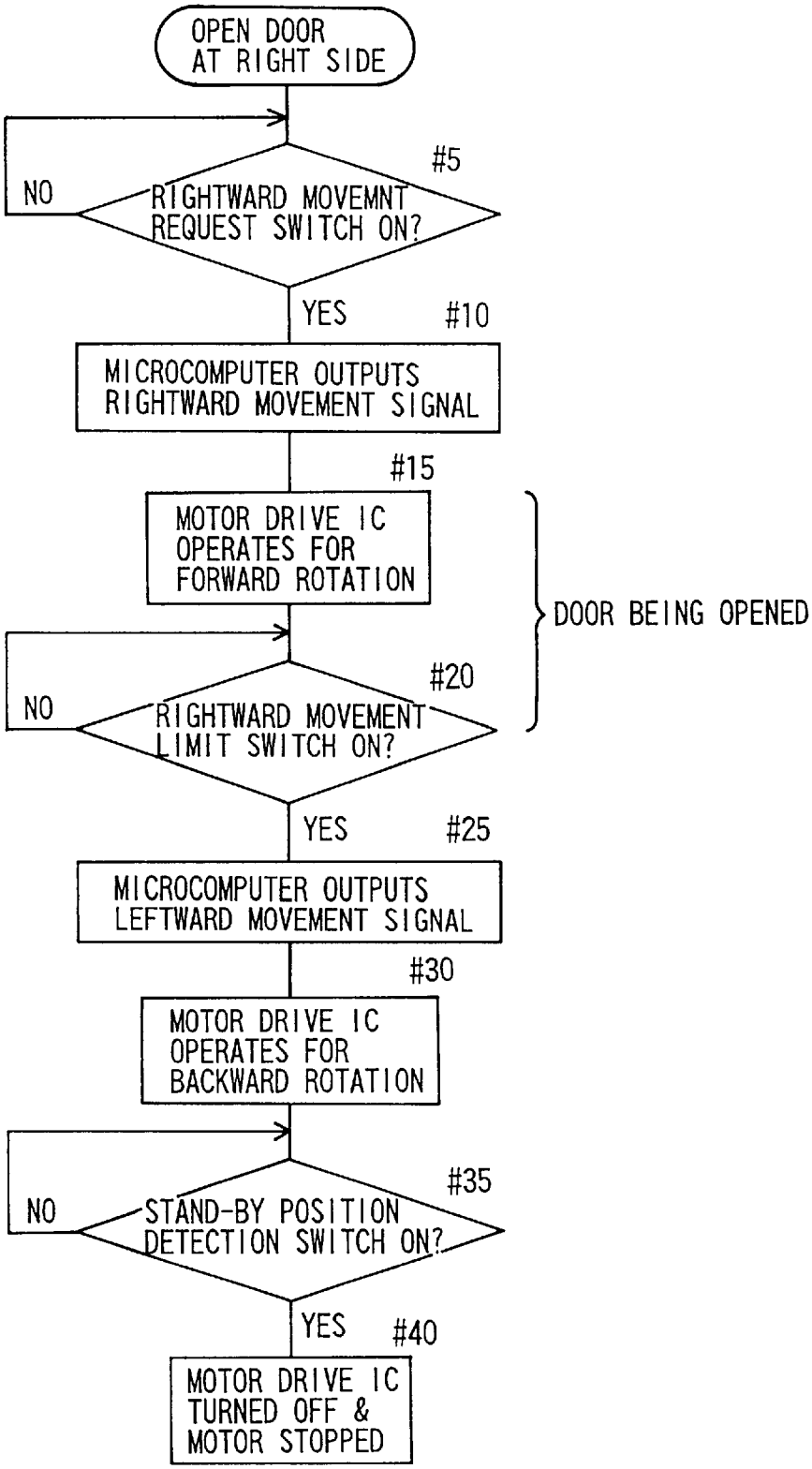
FIG. 62 is a flow chart showing the operation of the electric drive mechanism of the door opening/closing mechanism of the eighth embodiment.

FIG. 62 shows a flow chart of the procedure performed by the microcomputer when the door is opened at the right side. First, when, in step #5, the rightward movement request switch SW5 is turned on, then, in step #10, a rightward movement signal R is issued. As a result, the motor drive circuit 83 drives the motor 85 to rotate in the forward direction (#15). The motor 85 is kept driven until the rightward movement limit switch SW2 is turned off (#20).

The operations in these steps #15 and #20 cause the door to open at the right side. Next, in step #25, the microcomputer 81 issues a leftward movement signal L. As a result, the motor drive circuit 83 drives the motor 85 to rotate in the reverse direction. When, in step #35, the stand-by position detection switch SW1 is turned off, the motor 85 stops being driven (#40). When the door is opened at the left side, a similar sequence is performed.

Figure 63A:
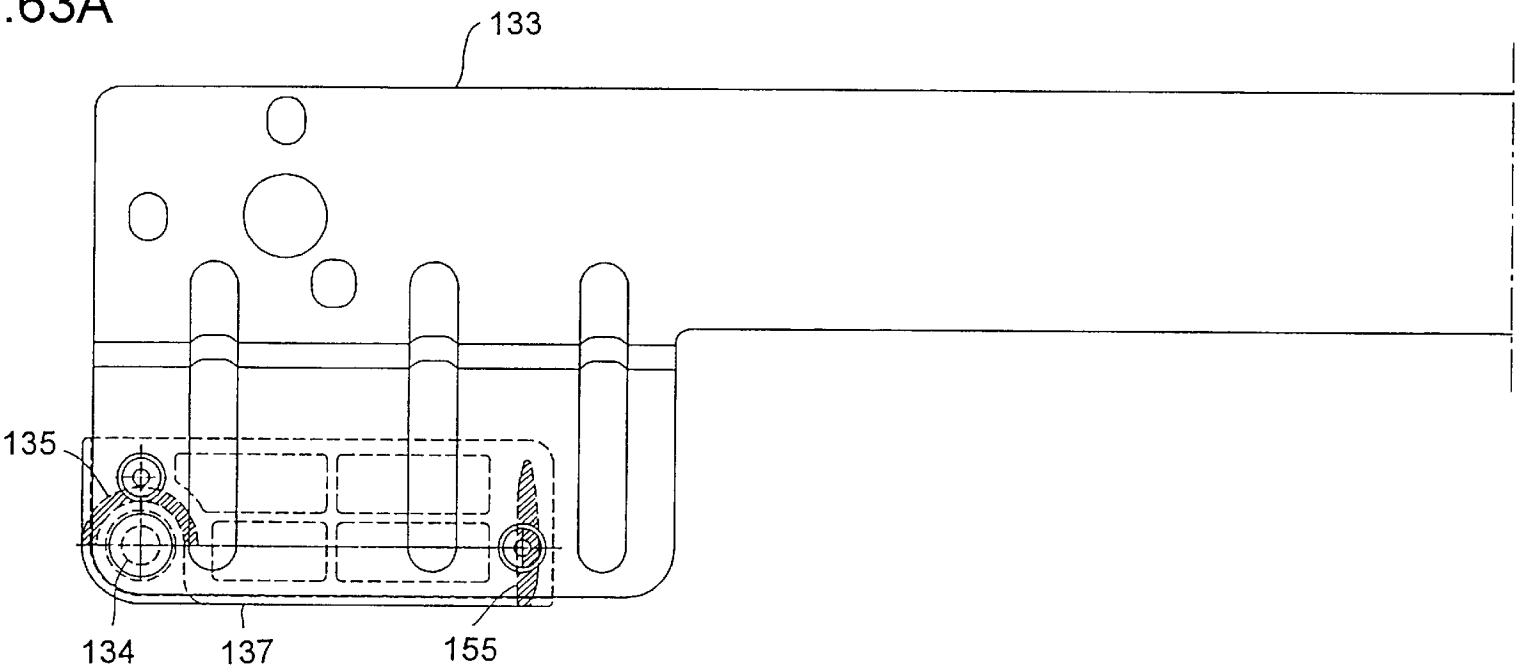
FIGS. 63A and 63B are diagrams showing the upper hinge angle of the door opening/closing mechanism of a ninth embodiment of the invention.
Figure 63B:
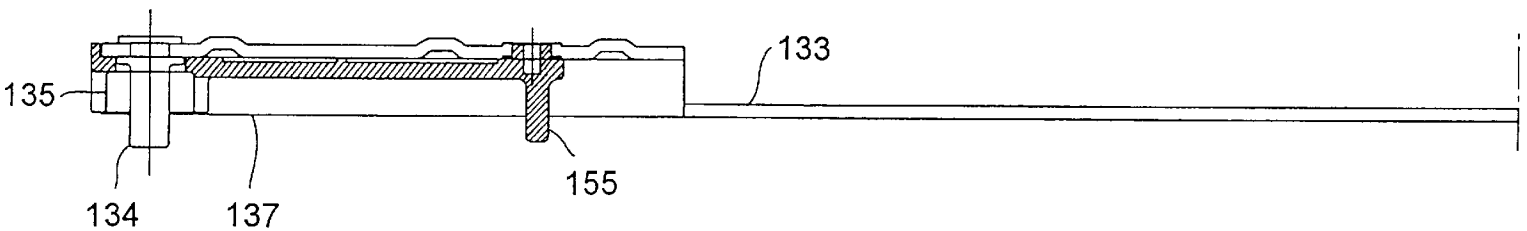

FIGS. 63A and 63B are a plan view and a sectional view as seen from the front of the left-hand half of the hinge angle 133 that is fitted on the body (not shown) above the door opening/closing mechanism of a ninth embodiment of the invention. This embodiment differs from the third embodiment described previously and shown in FIGS. 12 to 23C in that the lever mechanism is omitted. In other respects, this embodiment has substantially the same construction as the third embodiment.

The hinge angle 133 is made of a metal such as a stainless steel plate or galvanized iron plate and is formed so as to extend in the direction of the width of the body. The right-hand half of the hinge angle 133 has a shape reversed left to right as compared with the shape shown in these figures, so that the hinge angle 133 as a whole is shaped symmetrically. At both ends of the hinge angle 133, hinge pins 134, which serve as the rotation axes of the door (not shown), are formed so as to protrude downward. Moreover, at both ends of the hinge angle 133, lock cam members 137 molded out of a resin and shaped symmetrically with each other are arranged in symmetrical, right-hand and left-hand, positions.

Figure 64C:
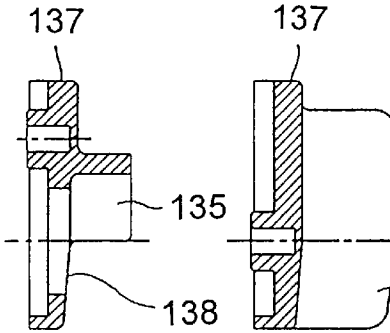
FIGS. 64A to 64D are diagrams showing the lock cam member of the door opening/closing mechanism of the ninth embodiment
Figure 64D:
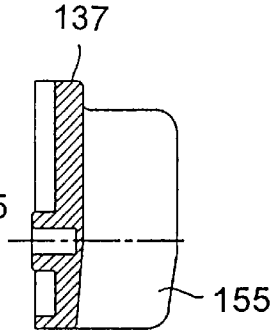
Figure 64A:
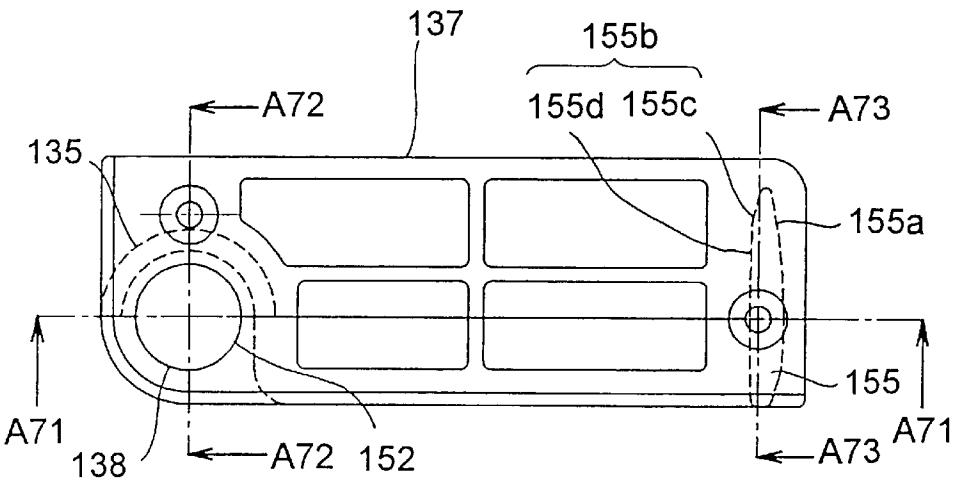
Figure 64B:
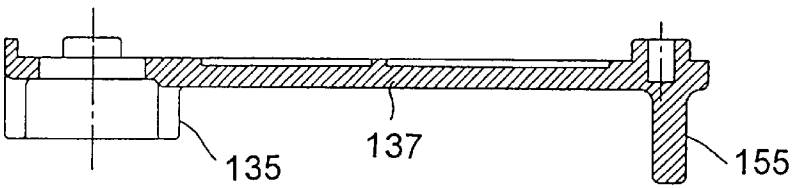

FIG. 64A is a plan view of the lock cam member 137 of this embedment, which has substantially the same shape as that of the third embodiment (see FIG. 19A). FIGS. 64B to 64D are sectional views along lines A71—A71, A72—A72, and A73—A73, respectively, of FIG. 64A. The lock cam member 137 is molded out of a resin. At one end of the lock cam member 137, a through hole 138 is formed through which the hinge pin 134 is fitted. The thus fitted hinge pin 134 serves as the rotation axis 152 of the door. Concentrically with the through hole 138, a second cam projection 135 is formed.

At the other end of the lock cam member 137, a lock outer cam 155 is formed integrally that has slide surfaces 155*a* and 155*b* on which a slide outer cam 153 (see FIG. 67A), described later, slides. The slide surface 155*b* consists of two slide surfaces 155*c* and 155*d*. The slide surfaces 155*a* and 155*d* are each so formed as to describe substantially an arc about one of the hinge pins 134 fitted at both sides of the door. Instead of forming these slide surfaces, as seen on a horizontal plane, into a shape describing substantially an arc, they may be shaped into a straight line approximating the arc determined on the basis of the gap between the slide outer cam 153 and the lock outer cam 155, or into a combination of straight and curved lines.

Figure 65C:
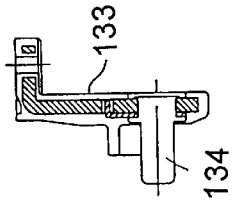
FIGS. 65A to 65D are diagrams showing the lower hinge angle of the door opening/closing mechanism of the ninth embodiment.
Figure 65D:
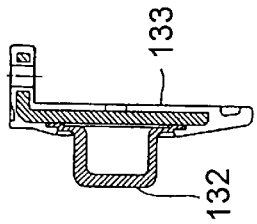
Figure 65A:
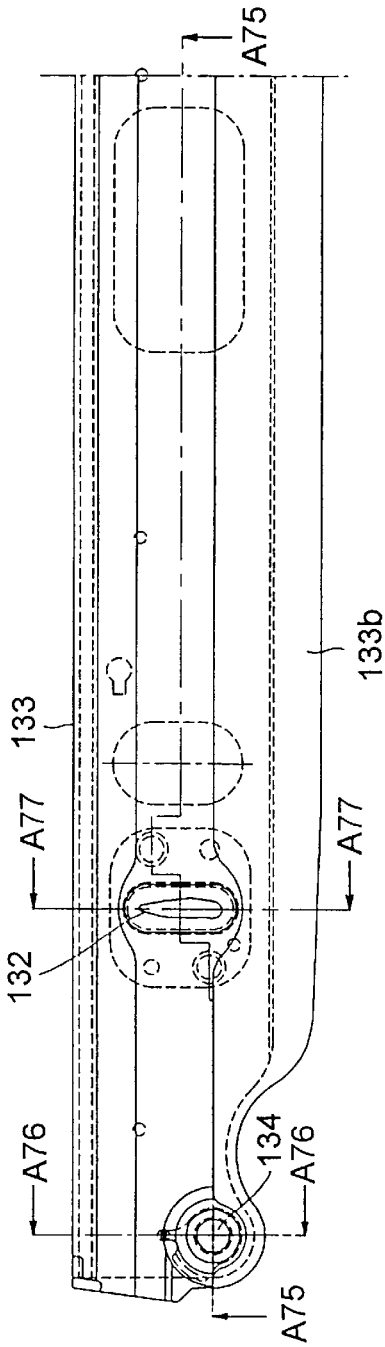
Figure 65B:
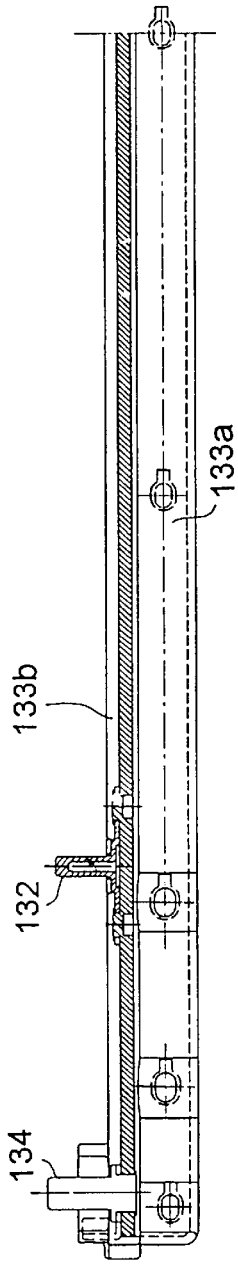

FIG. 65A is a plan view of the left-hand half of the hinge angle 133 fitted below the door. This hinge angle 133 has substantially the same shape as that of the third embodiment (see FIG. 18A). FIGS. 65B to 65D are sectional views along lines A75—A75, A76—A76, and A77—A77 of FIG. 65A. Since the weight of the door and others weighs downward, the lock outer cam 155 is made of a draw-forged stamped metal.

On an angle member 133*a* made of a metal, a hinge pin 134 and a lock outer cam 132, both made of a metal, are firmly fitted by swaging. Then, a hinge cover 133*b* is formed by insert molding. In this way, a lock cam member is formed integrally with the hinge angle 133.

Figures 66A, 66B, 66C:
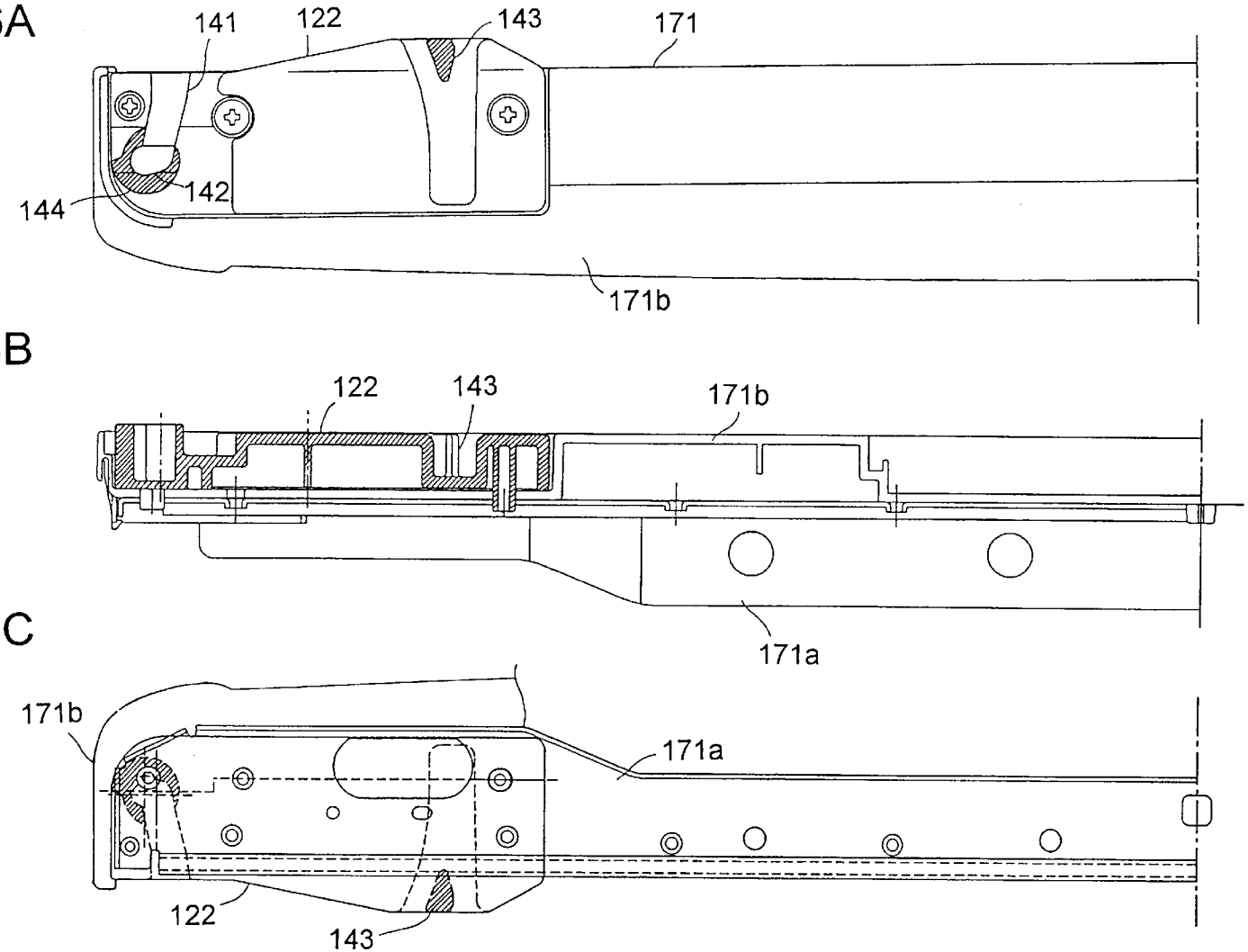
FIGS. 66A to 66C are diagrams showing the upper door angle of the door opening/closing mechanism of the ninth embodiment.

FIGS. 66A to 66C are a top view, a sectional view as seen from the front, and a bottom view, respectively, of the door angle 171 fitted at the top of the door. The door angle 171 is composed of an angle member 171*a* made of a stainless steel plate or galvanized iron plate and fitted on a door cap 171*b* molded out of a resin. At both ends of the door angle 171, slide cam members 122 molded out of a resin and shaped symmetrically with each other are arranged in symmetrical, right-hand and left-hand, positions and fixed to the angle members 171*a* with screws so as to sandwich the door cap 171*b*.

Figure 67A:
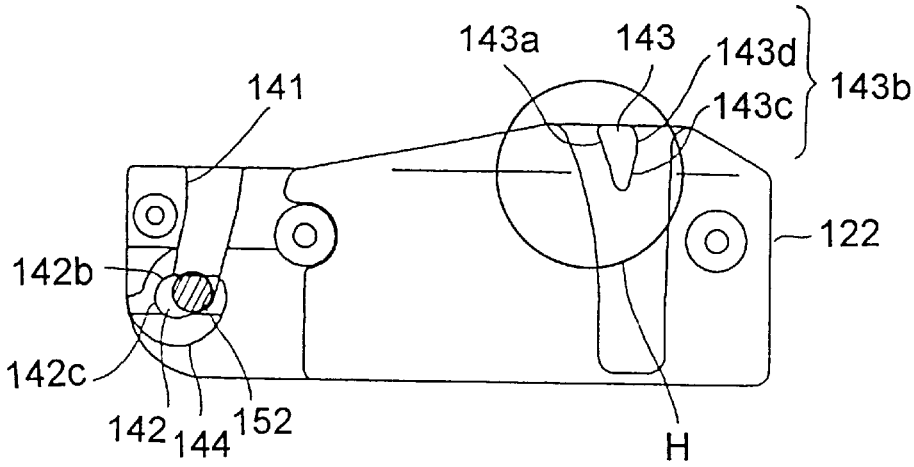
FIGS. 67A and 67B are diagrams showing the slide cam member of the door opening/closing mechanism of the ninth embodiment.
Figure 67B:
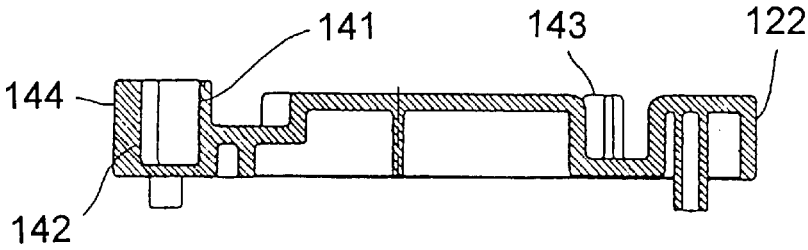

FIGS. 67A and 67B are a plan view and a sectional view as seen from the front of the slide cam member 122. In the slide cam member 122, a first groove cam 141 is formed for guiding the hinge pin 134 serving as the rotational axis 152 from the first lock position in a direction in which the hinge pin 134 is released. Also formed is a second groove cam 142 for guiding the hinge pin 134 from the first lock position to the second lock position where the hinge pin 134 serves as the rotational axis 152.

The second groove cam 142 has a linear portion 142*b* and a circular portion 142*c*. When the slide cam member 122 is guided from the first lock position to the second lock position, the linear position 142*b* moves while sliding on the hinge pin 134 at two points thereof, i.e. the rearmost and foremost points as seen on a horizontal plane.

When the hinge pin 134 serving as the rotation axis 152 is in the second lock position where it slides on the circular portion 142*c*, the door rotates. As will be described later, in cases where the slide cam member 122 can be guided to slide by a slide outer cam 143 and a lock outer cam 132, there is no need to form the linear portion 142*b*. In contrast to the seventh embodiment (see FIG. 47B), in this embodiment, the second groove cam 142 is so formed that the slide cam member 122 moves obliquely in the rearward direction.

On the slide cam member 122, a slide outer cam 143 is formed integrally that has slide surfaces 143*a* and 143*b* on which the slide surfaces 155*a* and 155*b* of the lock outer cam 155 (see FIG. 64A) slide. The slide surface 143*b* consists of slide surfaces 143*c* and 143*d*. The slide surfaces 143*a* and 143*d* are so formed as to have substantially arc-shaped cross sections common to the slide surfaces 155*a* and 155*d*, respectively, of the lock outer cam 155.

As the door rotates, the slide surface 155*a* or 155*b* of the lock outer cam 155 slides on the slide surface 143*a* or 143*b* of the slide outer cam 143 so as to guide the slide cam member 122. Instead of forming the above-mentioned slide surfaces, as seen on a horizontal plane, into a shape describing substantially an arc, they may be shaped into a straight line approximating the arc determined on the basis of the gap between the slide outer cam 143 and the lock outer cam 155, or into a combination of straight and curved lines.

Figure 68A:
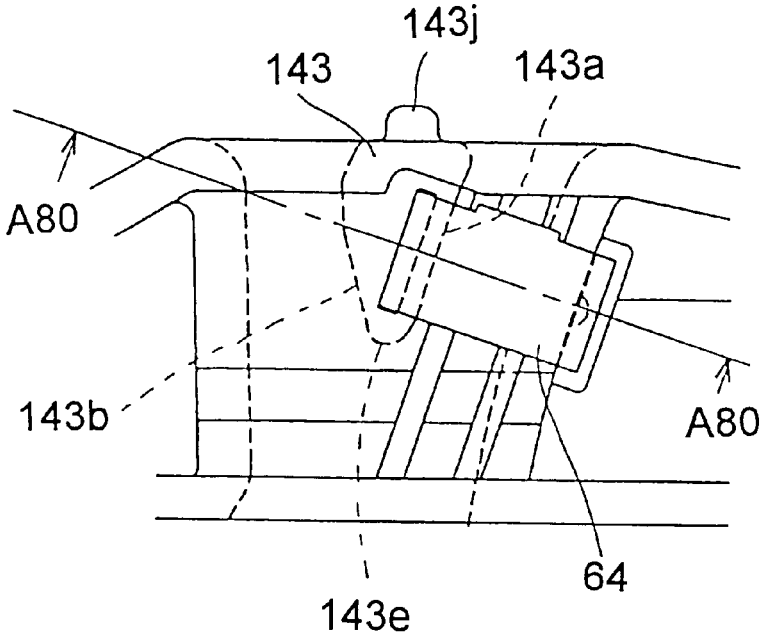
FIGS. 68A and 68B are enlarged views of the portion indicated as H in FIG. 67A.
Figure 68B:
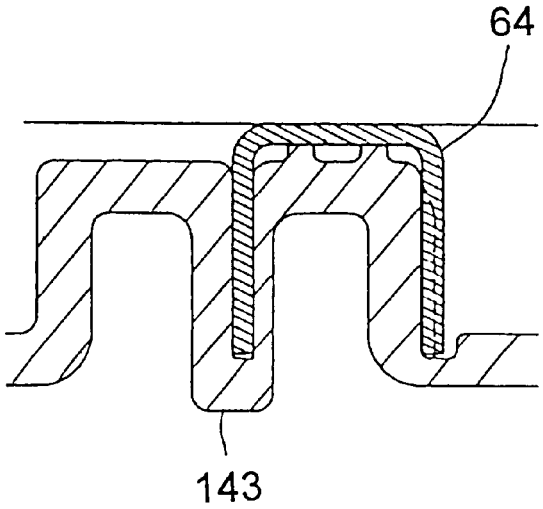

FIG. 68A is an enlarged view of the portion indicated as H in FIG. 67A, and FIG. 68B is a sectional view along line A80—A80 of FIG. 68A. In the slide outer cam 143, a reinforcing member 64 made of a metal is embedded. This helps reinforce the tip portion 143*e* of the slide outer cam 153 and thereby prevents it from being deformed when the lock outer cam 155 slides on the slide outer cam 143. Reference numeral 143*j* represents a spacer portion formed in the slide cam member 122. This prevents deformation of the gasket (not shown) that is fitted on the rear surface of the door to keep an appropriate gap between the door and the body, and also helps reinforce the slide outer cam 143.

Figure 69:
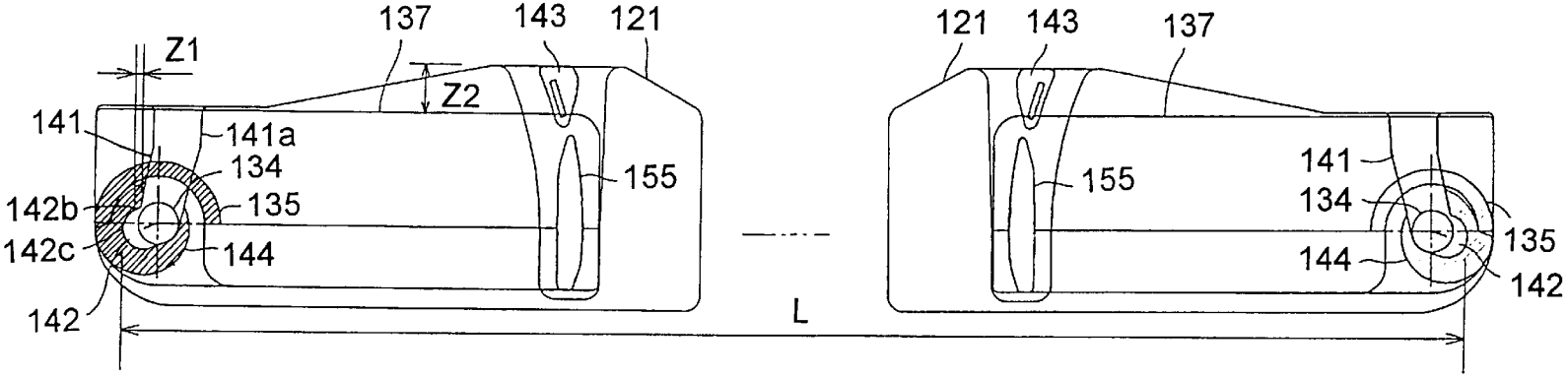
FIGS. 69 to 74 are plan views showing the relative positions of the lock cam member and the slide cam member of the door opening/closing mechanism of the ninth embodiment, when the door is opened.

FIGS. 69 to 74 are plan views showing the transition of the relative positions of the lock cam member 137 and the slide cam member 122 when the door is opened at the right side. In FIG. 69, the cam mechanism constituted by the lock cam member 137 and the slide cam member 122 is in the first lock position, and the door is completely closed.

At this time, the first groove cams 141 formed in the right-hand and left-hand slide cam members 122 point obliquely inward with respect to the door, and are both kept in fixed positions by the corresponding hinge pins 134. Therefore, even if the user pulls the door forward at both the right and left sides simultaneously, the door never comes off the body.

It is preferable that the gap between the wall surface, the one closer to the center, of the door of an inner most portion 141*a* of the first groove cam 141 and the hinge pin 134 be made substantially equal (for example, 1 mm) to the range of variations in the outermost distance L between the second groove cams 142 at both sides of the door. Then, even if there is a variation in the outermost distance L due to thermal expansion or the like, the wall surface, the one closer to the center of the door, of the innermost portion 141*a* at the side at which the door is opened strikes the hinge pin 134 and thereby prevents the door from being hindered from moving to the second lock position.

Figure 70:
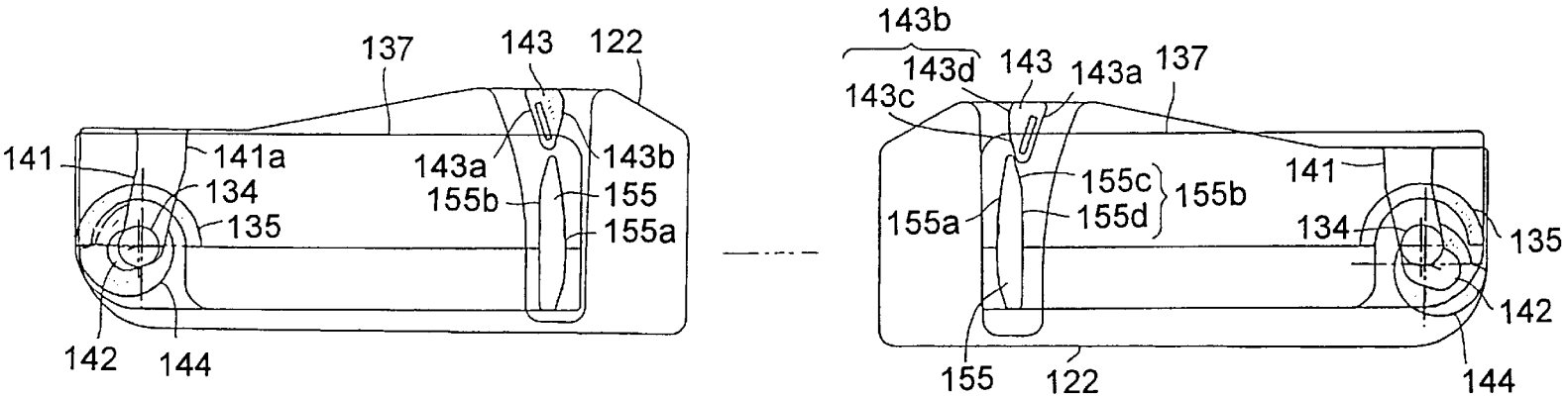
Figure 71:
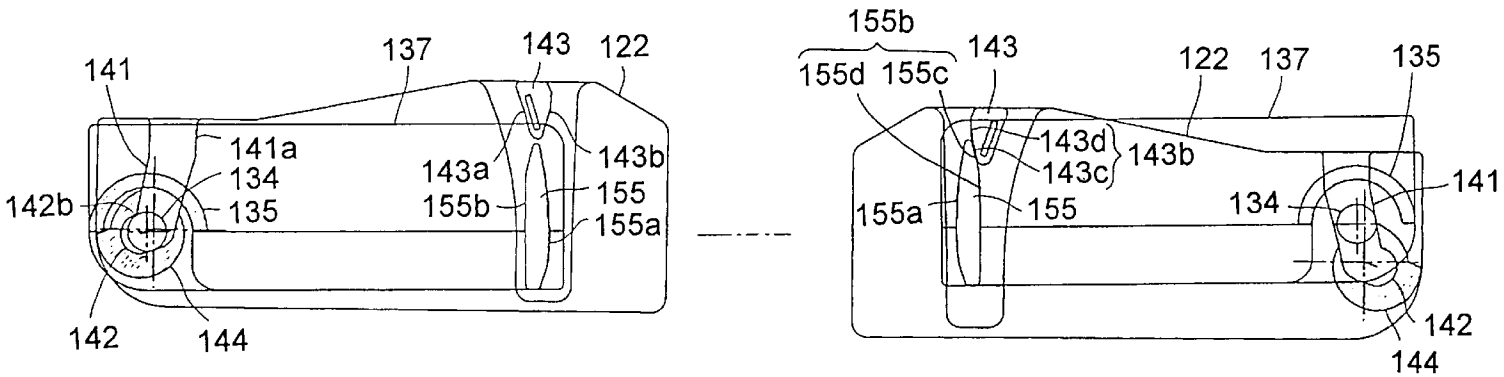

FIG. 70 shows the state observed when the door starts being opened at the right side. At this time, the first groove cam 141 formed in the right-hand slide cam member 122 is in a position where it can be released from the first lock position. FIG. 71 shows the state observed when the door is opened further at the right side. At this time, at the right side of the door, the slide surface 143*c* of the slide outer cam 143 slides on the slide surface 155*c* of the lock outer cam 155.

Moreover, the first groove cam 141 guided by the right-hand hinge pin 134 makes the door slide slightly rightward. Furthermore, at the left side of the door, the linear portion 142*b* of the second groove cam 142 is guided by the hinge pin 134 to slide on the hinge pin 134 at two points thereof, i.e. the rearmost and foremost points as seen on a horizontal plane. This causes the slide cam member 122 to slide slightly forward.

Figure 72:
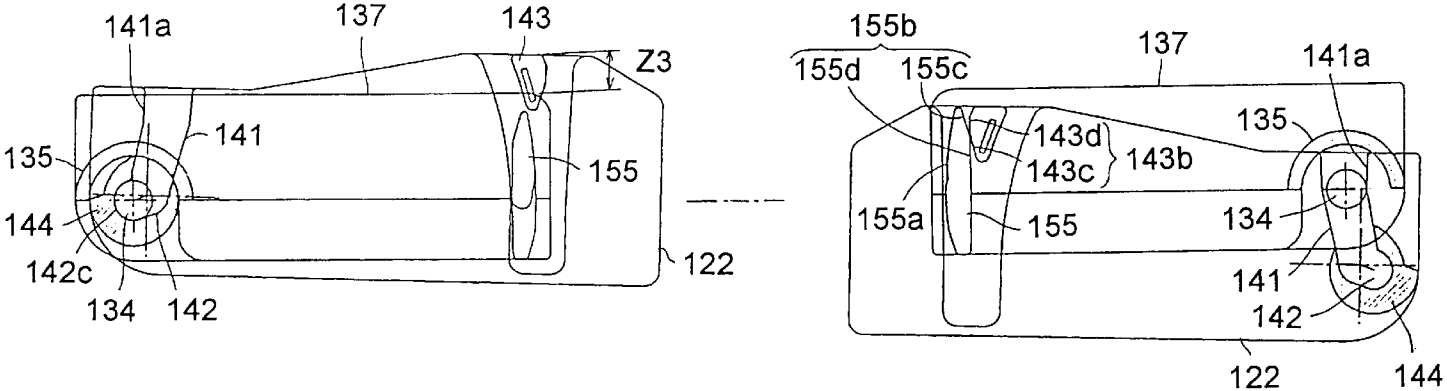

When the door is rotated further into the state shown in FIG. 72, at the left side of the door, the circular portion 142*c* of the second groove cam 142 is located in a position where it slides on the hinge pin 134, and thus the left-hand slide cam member 122 is located in the second lock position. The first cam projection 144 starts engaging with the second cam projection 135 so that the former is guided by the latter to slide along the latter. On the other hand, at the right side of the door, the slide surface 143*d* of the slide outer cam 143 slides along the slide surface 155*d* of the lock outer cam 155 and is thereby guided to move in such a way as to describe an arc about the left-hand hinge pin 134 serving as the rotation axis 152.

In this way, the slide cam member 122 is locked so as note to come off the left-hand hinge pin 134. This makes it possible to prevent the door from coming off the body and thereby ensure secure opening and closing of the door.

When the door is rotated further, the innermost portion 141*a* of the right-hand first groove cam 141 rotates about the left-hand hinge pin 134 while sliding on, or keeping a predetermined gap with, the right-hand hinge pin 134. Then, the hinge pin 134 disengages from the first groove cam 141. The innermost portion 141*a* of the first groove cam 141 assists the slide outer cam 143 and the lock outer cam 155 to guide the door when the slide outer cam 143 or the lock outer cam 155 is damaged or lost or when they are omitted. This makes it easy to engage together the left-hand first cam projection 144 and the second cam projection 135.

Figure 73:
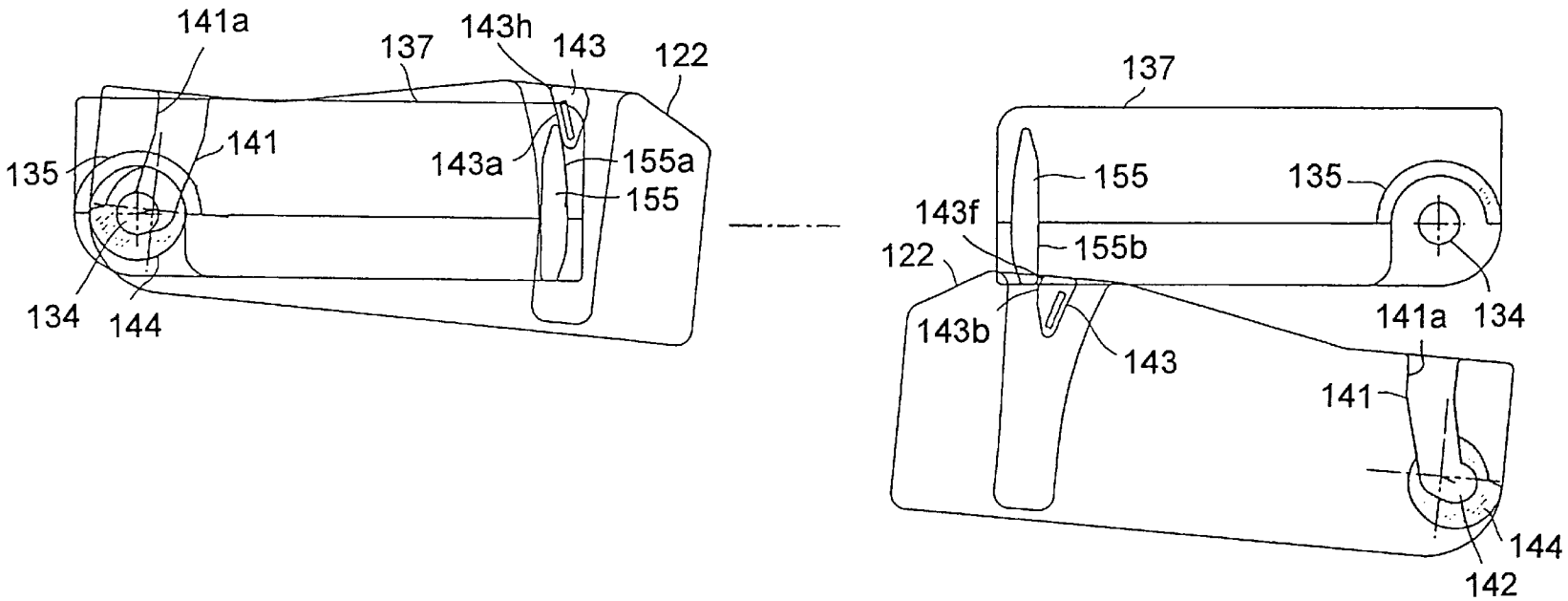
Figure 74:
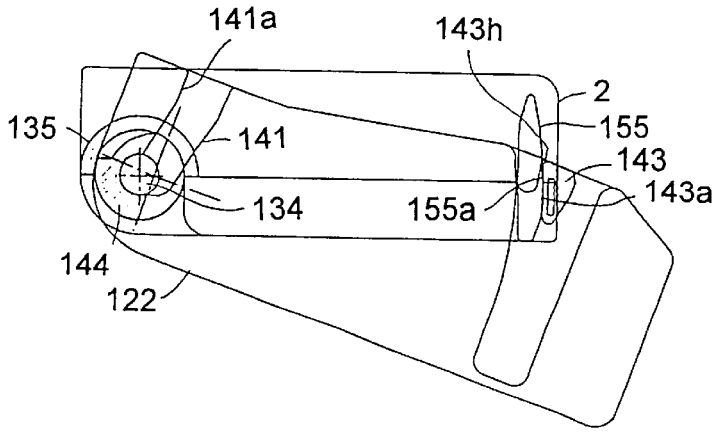

Then, as shown in FIGS. 73 and 74, the lock outer cam 155 and the slide outer cam 143 of the right-hand cam members disengage from each other, and thus the right-hand lock cam member 137 disengages from the right-hand slide cam member 122. At the left side of the door, the slide surfaces 143*a* and 155*a* slide along each other about the hinge pin 134 (rotation axis 152), and thus the slide outer cam 143 is guided by the lock outer cam 155 so that the former slides along the other. Thereafter, solely the engagement between the first cam projection 144 and the second cam projection 135 keeps the slide cam member 122 being guided by the lock cam member 137 and thereby permits the door to be opened.

The action described above permits the slide outer cam 143 and the lock outer cam 155 to slide along each other and thereby cause the door as a whole to slide rightward. Thus, the hinge pin 134 is held by the holding portion 143*c*, so that the cam mechanism securely maintains a locked state. This makes it possible to prevent the door from coming off the body and thereby permit the door to be opened and closed securely.

In FIG. 73, the slide surface 143*b* of the slide outer cam 143 has an upper end thereof, as seen in the figure, chamfered so as to form a chamfered portion 143*f*. This permits the slide outer cam 143 to be guided smoothly along the lock outer cam 155 when the door is closed. Another chamfered portion 143*h* is formed for the same purpose.

Moreover, if, for example, the interval between the right-hand and left-hand second groove cams 142 is greater than designed due to assembly errors or the like, there is a possibility that the slide cam member 122 dotes not reach the position where it permits the hinge pin 134 to slide on the circular portion 142*c*. Even in that case, since the second groove cam 142 has the linear portion 142*b*, the hinge pin 134 can be held in the linear portion 142*b*. This prevents the hinge pin 134 at the pivoted side of the door from being guided into the first groove cam 141 to move relative thereto, and thus helps stabilize the position of the rotation axis of the door. Moreover, it is also possible to prevent the hinge pin 134 from being guided into the first groove cam 141 to cause the door to come off.

Here, as shown in FIG. 69 described previously, by making the length Z1 of the linear portion 142*b* in the direction of the width of the door greater than the range of variations in the outermost distance L between the second groove cams at both ends of the door, it is possible to hold the hinge pin 134 securely in the second groove cam 142, and thus open the door with a minimum load due to friction and thus with a weak force. That is, a variation in the outermost distance L is absorbed by varying the position of the second groove cam 142 with respect to the left-hand hinge pin 134. This prevents the wall surfaces of the right-hand first groove cam 141 from being pressed onto the hinge pin 134, and thereby keeps the sliding friction low. At this time, the left-hand hinge pin 134 does not slide on the circular portion 142*c* but is held in the linear portion 142*b*.

The range of variations is determined on the basis of the fitting errors of the slide cam member 122 and the machining errors of the door angle 171 (see FIG. 66A) that is used to fit the slide cam member 122, and also, in cases where the door has a foamed heat insulator, on the basis of the variation of ambient temperature and of foaming scale in the foaming process. Moreover, the range of variations is determined also on the basis of the thermal expansion of the individual members constituting the door that accompanies a variation in thermal conditions such as a rise in ambient temperature.

The results of tests conducted on a refrigerator incorporating the door opening/closing mechanism of this embodiment to measure dimensional variations accompanying variations in temperature are as follows. When the outermost distance L between the second groove cams 142 at both sides of the door was 650 mm, a variation of 30 degrees Celsius in ambient temperature caused a variation of 1 mm in the outermost distance L. The slide cam member 122 was made of polyacetal, and the door cap 171*b* was made of an ABS resin. The angle member 171*a* of the door angle 171 is made of a galvanized iron plate, 1.2 mm thick. The door had a heat insulator made of urethane foam, with a foaming density of 35 kg/m$^3$.

On the other hand, when the outermost distance between the hinge pins 134 of the lower hinge angle 133 was 554.3 mm, a variation of 30 degrees Celsius in ambient temperature caused a variation of 0.2 mm in the outermost distance. Here, the lower hinge angle 133 is composed of an angle member (made of a galvanized iron plate, 3.2 mm thick) that has its outer surfaces coated with an ABS resin by insert molding.

Considering these results and in addition the variations due to the machining errors of the door angle 171 and the fitting errors of the slide cam member 122 leads to the following conclusion. In the example described above, by making the linear portion 142*b* of the second groove cam 142 longer than 1.3 mm (0.2% of the outermost distance L), it is possible to permit the slide cam member 122 to hold securely the hinge pin 134 even if there is a variation in the outermost distance L. The linear portion 142*b* may be so curved, as seen on a horizontal plane, as to make contact with the hinge pin 134 at two points.

Since the hinge pins 134 are firmly fitted on the hinge angle 133 made of a metal, a dimensional variation in the distance between the two, hinge pins 134 due to a variation in temperature is so small that it can be ignored (for example, in the above example, 0.2 mm for a variation of 30 degrees Celsius) as compared with the variation in the distance between the slide cam members 122. Moreover, since the hinge angle 133 is made of a metal, its machining and fitting errors are so small that they can usually be ignored.

Figure 75:
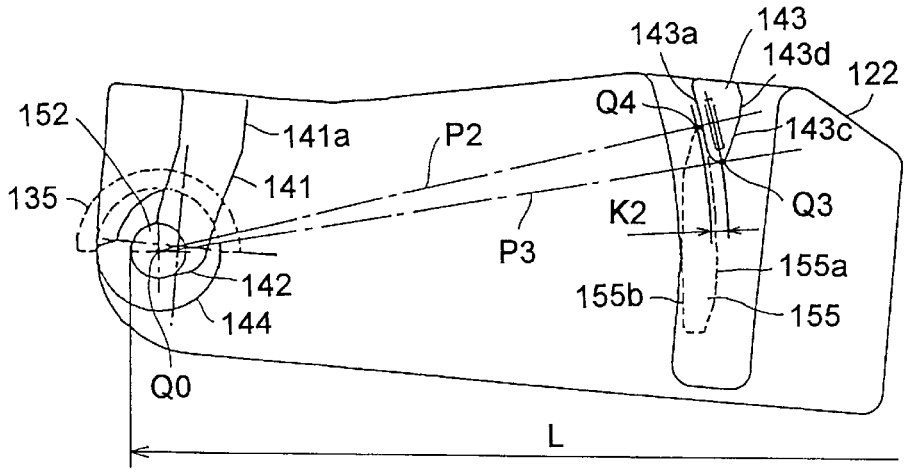
FIG. 75 is a detail view of FIG. 73.

FIG. 75 is a detail view of FIG. 73 described previously. In this figure, assuming that the slide outer cam 143 is sliding along the lock outer cam 155, the point of contact between a center line P2 through the center Q0 of the rotation axis 152 and the lock outer cam 155 is represented by Q4, and the point of contact between a center line P3 through the center Q0 and the slide outer cam 143 is represented by Q3. The distance between the points of contact Q3 and Q4 in the radial direction is represented by K2.

Here, the distance K2 is made greater than the range of variations in the outermost distance L (see FIG. 69); specifically, the distance K2 is made greater than 0.2% of the outermost distance L. By forming the slide outer cam 143 and the lock outer cam 155 in this way, it is possible to permit the slide cam member 122 to hold securely the hinge pin 134 even if there is a variation in the outermost distance L. How this is achieved will be described in detail below, taking up the embodiment under discussion as an example, although the same principle applies also in the other embodiments.

As described earlier, if the interval between the first groove cams 141, or the second grove cams 142, at both sides of the door is greater than designed due to assembly errors or the like, the slide distance of the slide cam member 122 in the width direction is shorter. Specifically, for example, when the door is opened at the right side, the right-hand first groove cam 141 slides on part of the outer circumference of the hinge pin 134 so that the door as a whole moves a predetermined distance rightward. At this time, the outermost distance L between the right-hand and left-hand first groove cams 141 is greater than the design value by an amount equal to the variation.

Thus, the distance through which the left-hand slide cam member 122 moves in the direction of the width of the door is shorter than a predetermined distance by an amount equal to the variation. As a result, there is a risk that, when the lock outer cam 155 starts sliding on the slide outer cam 143, the slide outer cam 143 collides with the lock outer cam 155.

Figure 76:
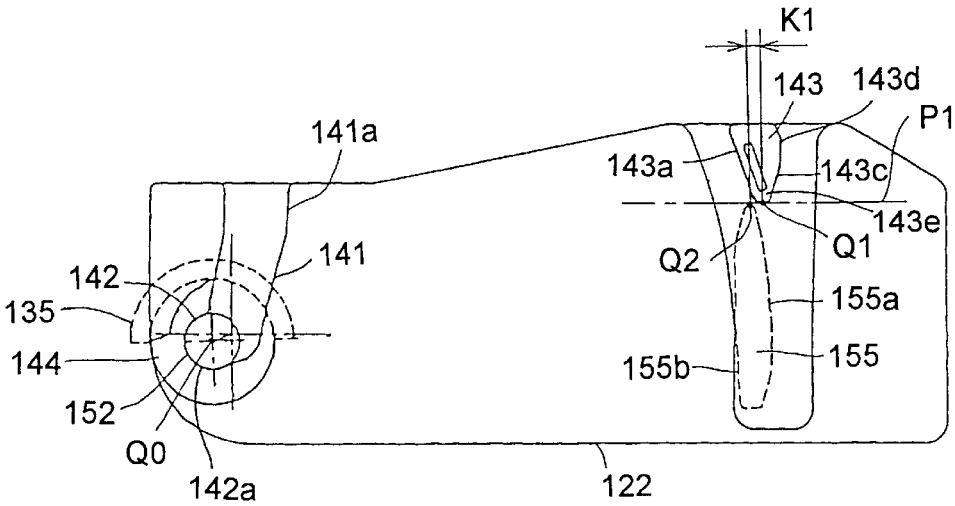
FIG. 76 is a diagram showing the state in which the tip of the lock outer cam and the tip of the slide outer cam are located on a line in the door opening/closing mechanism of the ninth embodiment.

Specifically, as shown in FIG. 76, when the slide outer cam 143 is about to engage with the lock outer cam 155 with the tip Q1 of the former and the tip Q2 of the latter lying on a line P1 parallel to the direction of the width of the door, if the tip Q1 of the slide outer cam 143 is located on the right of the tip Q2 of the lock outer cam 155 as seen in the figure, the slide surface 143*a* is guided onto the slide surface 155*a*. Then, the slide cam member 122 is slid rightward in the direction of the width of the door.

Here, at either side of the door, the distance between the slide outer cam 143 and the second groove cam 142 is sufficiently smaller than the outermost distance L, and therefore an error in that distance can safely be ignored. Similarly, an error in the distance between the lock outer cam 155 and the hinge pin 134 also can safely be ignored.

These errors can be ignored more safely respectively if the slide cam member 122 and the slide outer cam 143 are made of the same material and if the lock cam member 137 and the lock outer cam 155 are made of the same material. Thus, as the slide surfaces 143*a* and 155*a* slide along each other, the door rotates normally with the hinge pin 134 (rotation axis 152) sliding on the circular portion 142*c* of the second groove cam 142.

Therefore, by making the distance K2, or the distance K1 described later, greater than the range of variations in the outermost distance L between the second groove cams 142 at both sides of the door, it is possible, when the slide outer cam 143 starts engaging with the lock outer cam 155, to locate the tip Q1 on the right of the tip Q2 without fail. Thus, it is possible, even when there is a variation in the outermost distance L, to prevent the slide outer cam 143 from colliding with the lock outer cam 155. Obviously, forming in the first cam projection 144 of this embodiment a chamfered portion similar to the chamfered portion 144*b* formed in the first cam projection 144 shown in FIG. 25B ensures smoother opening of the door.

In the example described above, even if no linear portion 142*b* (sliding portion) is formed in the second groove cam 142, the slide outer cam 143 slides securely along the lock outer cam 155. Thus, in the second lock position, the hinge pin 134 securely reaches the circular portion 142*c* of the second groove cam 142, and thus keeps the rotation axis of the door in a fixed position and thereby ensures smooth opening of the door at all times. This eliminates the need for adjustment of the fitting position of the slide cam member 122 or replacement of components, and thus helps improve production efficiency and component yields.

The slide cam member 122 and the lock cam member 137 are fitted on the door angle 171 (see FIG. 66C) and the hinge angle 133 (see FIG. 63A) with fitting pins (not shown) fitted through a plurality of through holes. As described earlier, the machining errors in the distances between the slide outer cam 143 and the second groove cam 142 and between the lock outer cam 155 and the hinge pin 134 are sufficiently smaller than a variation in the outermost distance L.

Even then, it is preferable to form the above-mentioned though holes, formed for the fitting of the slide cam member 122 and the lock cam member 137, in such a manner that one of them is a circular hole and the others are elongated circular holes. This makes their fitting easy even when there are errors as described above. In the lock cam member 137, the through hole 138 is used as the reference for positioning. On the slide cam member 122, a positioning pin is fitted on the back surface thereof, at the back of the center of the rotation axis 152 or in the vicinity thereof, i.e. at the back of the second groove cam 142. Forming in an angle member 171*a* an engagement hole into which this positioning pin is fitted ensures more accurate positioning of the slide cam member 122.

Here, the distance K2 between the points of contact Q3 and Q4 in the radial direction is approximately equal to the distance K1 between the tips Q1 and Q2. Accordingly, it is preferable to set the design value of the distance K1 to be greater than the range of variations in the outermost distance L (see FIG. 69) between the second groove cams 142, specifically greater than 0.2% of the outermost distance L.

Figure 77A:
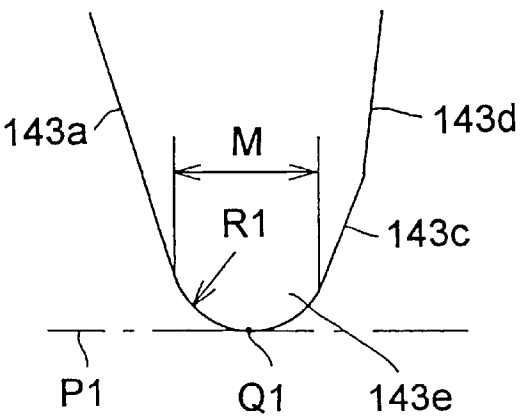
FIGS. 77A to 77C are diagrams showing the tip portion of the lock outer cam of the door opening/closing mechanism of the ninth embodiment.

FIG. 77A is an enlarged view of the tip portion 143*e* of the slide outer cam 143 shown in FIG. 76. By forming the tip portion 143*e* out of a cylindrical surface having a uniform radius of curvature R1 and tangent to the slide surfaces 143*a* and 143*c*, it is possible to locate the tip Q1 on the right of the slide surface 143*a* as seen in the figure.

Figure 77B:
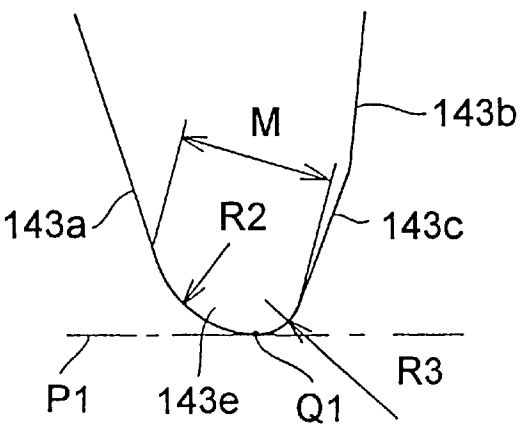

It is also possible, as shown in FIG. 77B, to form the tip portion 143*e* out of two cylindrical surfaces having different radii of curvature R2 and R3 in such a way that the radius of curvature R2 closer to the lock outer cam 155 is greater than the radius of curvature R3 farther away therefrom. This makes it possible to shift the tip Q1 farther away from the lock outer cam 155 as compared with the case shown in FIG. 77A where the tip portion 143*e* has a uniform radius of curvature R1. Thus, it is possible to increase the distance K2 (see FIG. 75).

Figure 77C:
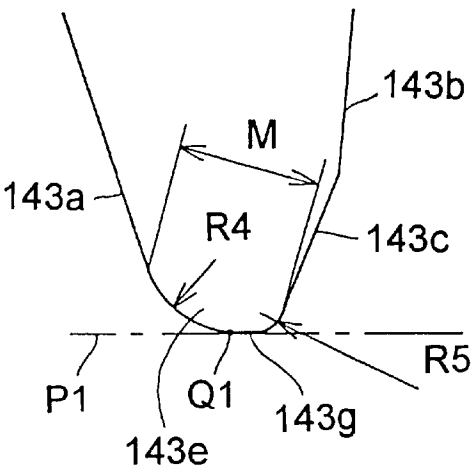

Alternatively, it is also possible, as shown in FIG. 77C, to form the tip portion 143*e* out of two cylindrical surfaces having different radii of curvature R4 and R5 and a substantially flat surface 143*g*. On the other hand, the tip portion of the lock outer cam 155 may be so formed as to have a radius (or radii) of curvature reversed left to right as compared with the tip portion 143*e* of the slide outer cam 143.

As shown in FIGS. 69 to 74 described previously, when the door is opened at the right side, the right-hand and left-hand slide outer cams 143 first slides rightward and then slides on the lock outer cams 155. Similarly, when the door is opened at the left side, the right-hand and left-hand slide outer cams 143 first slides leftward and then slides on the lock outer cams 155.

Therefore, by increasing the slide distance, it is possible to increase the interval between the slide surfaces 143*a* and 143*b* of the slide outer cam 143. In this embodiment, the slide distance through which the door slides in the direction of the width thereof is set to be 2.5 mm or more. This makes it possible to locate the tip Q1 (see FIG. 76) away from the lock outer cam 155. Accordingly, it is possible to open the door with a minimum slide distance and thus smoothly at all times.

There is a risk of collision similar to that described above due to a dimensional variation between the slide outer cam 143 and the lock outer cam 155 also when the door is closed. This problem, due to the dimensional variation, can be avoided by forming the chamfered portions 143*f* and 143*h* (see FIG. 73) described above and forming chamfered portions or the like in the portions of the lock outer cam 155 facing those chamfered portions 143*f* and 143*h*.

In FIGS. 77A to 77C, it is preferable that the distance M from the point of contact between the tip portion 143*e* and the slide surface 143*a* to the point of contact between the tip portion 143*e* and the slide surface 143*c* be made 1.8 mm or longer. This makes it possible to fit the reinforcement member 64 (see FIG. 68) in such a way as to cover also the tip of the slide outer cam 143. Thus, it is possible to improve the mechanical strength of the slide outer cam 143 and maintain the shape of its tip for a long period.

In this embodiment, as described previously, the second groove cam 142 is so formed that, at the side opposite to the side at which the door is opened, the door slides not only in the direction of the width thereof but also obliquely in the rearward direction. In FIGS. 69 and 72 described previously, in the first lock position, the end surface of the slide outer cam 153 is a distance 22 away from the lock cam member 137.

As the door rotates, the slide cam member 122 moves in the rearward direction and reaches the second lock position. At this time, the slide outer cam 143 moves simultaneously forward by rotating about the hinge pin 134 and in the rearward direction as a result of the second groove cam 142 sliding on the hinge pin 134. As a result, as shown in FIG. 72, when the slide outer cam 143 starts engaging with the lock outer cam 155, the end surface of the slide outer cam 143 is located at a distance 23 away from the lock cam member 137.

That is, as the left-hand slide outer cam 143 rotates, the more it approaches the lock cam member 137, the more it moves in a rearward direction. Here, the distance 23 is set to be shorter than the distance 22 so that the refrigerator compartment door 102 does not touch the refrigerator body 101 (see FIG. 12).

This makes it possible to make the slide outer cam 143 longer in the rearward direction without the risk of collision with the lock cam member 137 when rotated. Thus, it is possible to keep the slide outer cam 143 engaged with the lock outer cam 155 over a larger proportion of the angle through which the door can be rotated, and thereby achieve stable rotation.

Figure 78A:
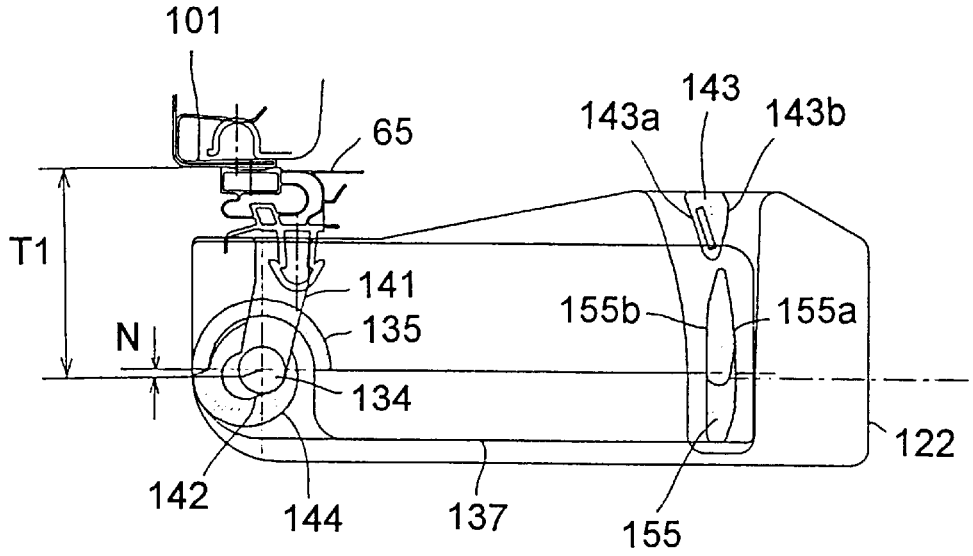
FIGS. 78A and 78B are diagrams illustrating how the gasket is fitted in the door opening/closing mechanism of the ninth embodiment.
Figure 78B:
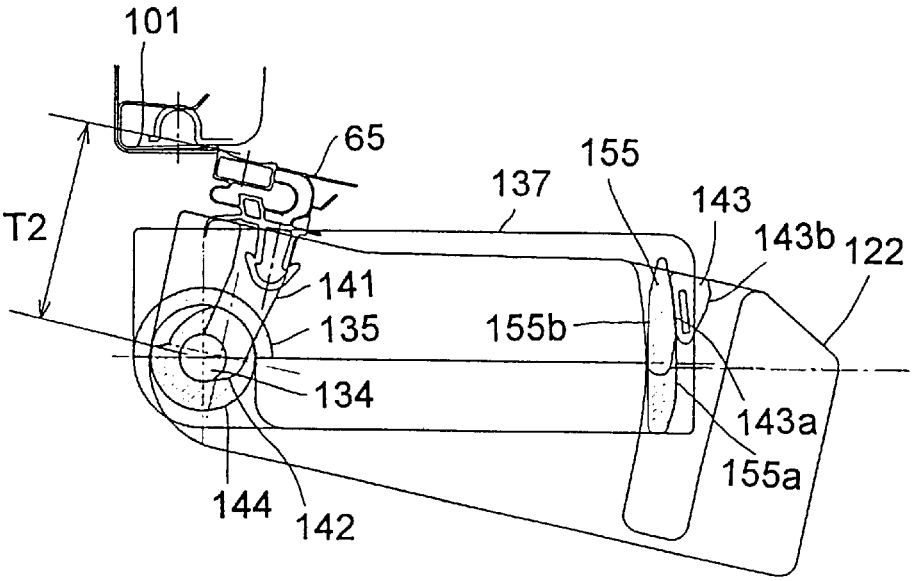
Figure 79:
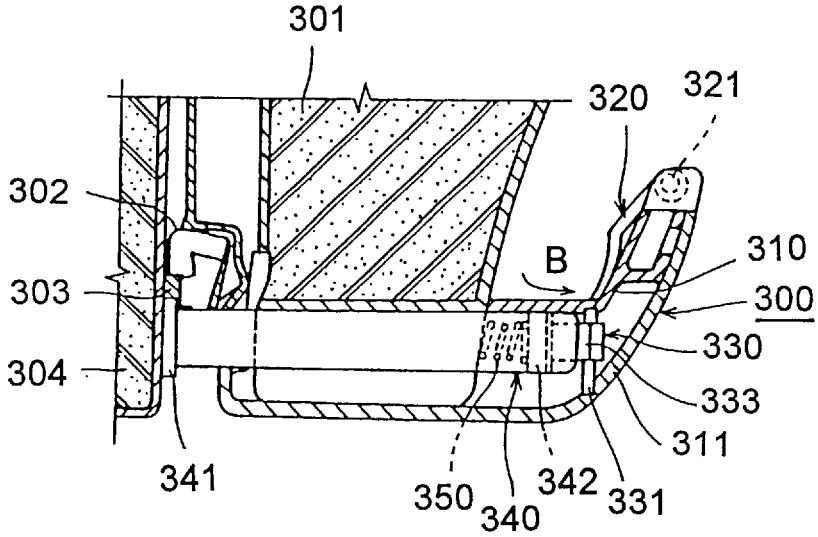
FIG.79 PRIOR ART
FIGS. 79 and 80 are diagrams illustrating the workings of a conventional door opening/closing mechanism.
Figure 80:
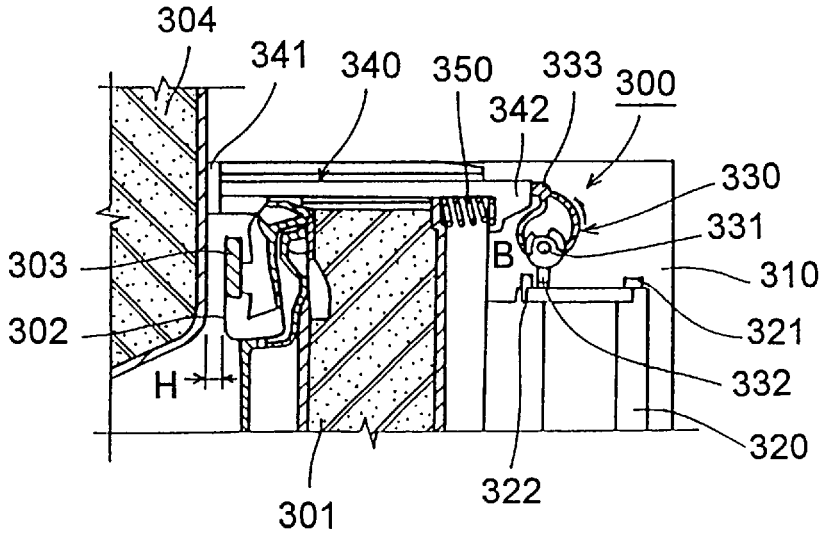
FIG.80 PRIOR ART
Figure 81A:
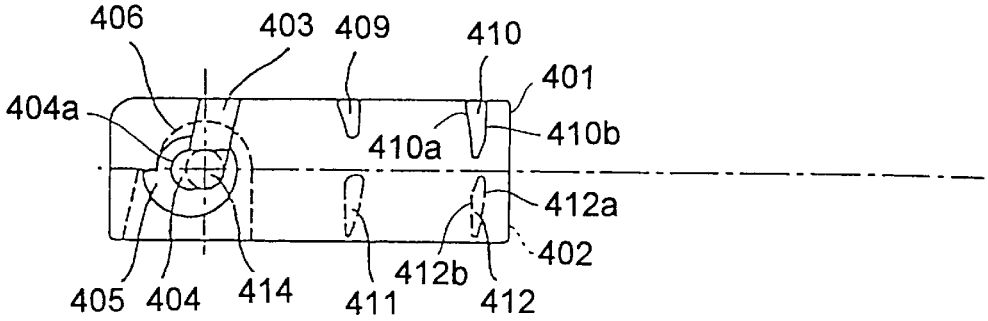
FIG.81A PRIOR ART
FIGS. 81A to 81C are diagrams illustrating the workings of another conventional door opening/closing mechanism
Figure 81B:
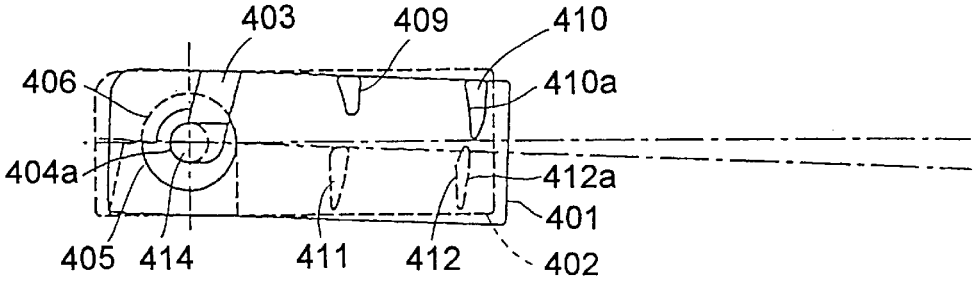
FIG.81B PRIOR ART
Figure 81C:
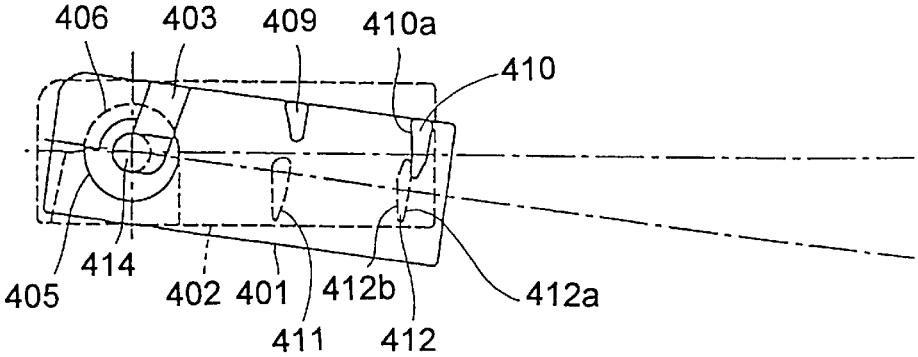
FIG.81C PRIOR ART

FIGS. 78A and 78B are plan views of the door fitted with a gasket 65 on the rear surface thereof. As the door slides in the rearward direction as described above, the gasket 65 is pressed onto the refrigerator body 101. The gasket 65 is made of a flexible resin (for example, a soft polyethylene resin or soft vinyl chloride resin) and thus has enough elasticity to absorb the sliding movement of the door in the rearward direction.

It is preferable that the slide distance N in the rearward direction be set to be 4% or less of the distance T1 from the rotation center of the door, as it is when the door is closed, to the rear surface of the gasket 65 that is kept in close contact with the body, because then the pressing force can be absorbed by the elasticity of the gasket 65. This helps prevent inconveniences such as the gasket 65 curling up when the door is opened or closed or a gap being left when the door is closed. The center, in the direction of the width of the door, of the portion of the gasket 65 that is kept in close contact with the body is located close to the rotation center of the door in the direction of the width of the door.

It is preferable that the slide distance N in set to be 2.3% or more of the distance T1, because then it is possible to maximize the length of the slide outer cam 143 in the rearward direction. When the distance T1 from the rotation center of the door, as it is when the door is closed, to the rear surface of the gasket 65 that is kept in close contact with the body is 36 mm, by setting the slide distance N in the rearward direction to be 1 mm (2.8% of the distance T1), the door can be opened and closed without the risk of the gasket 65 curling up and thus without an unduly strong force. As a result, it is possible to make the slide outer cam 143 longer in the rearward direction by about 1 mm than in conventional designs.

Even when the distance T1 is equal to the distance T2 from the rotation center of the door, as it is when the door is open, to the rear surface of the gasket 65, the effect described above can be achieved with satisfactory results. However, the distance 71 may be set to be greater than the distance T2 (for example, T1−T2=0.5 to 1.5 mm). By embedding a magnet in the gasket 65, it is possible to exploit the attraction of the magnet to cause the gasket 65 to plunge into close contact with the body when the door is closed. This reduces the risk of the gasket 65 curling up, and thus ensures better opening and closing action of the door.

Although the descriptions heretofore deal solely with cases in which the slide cam member is fitted on the door and the lock cam member is fitted on the body, it is also possible to fit the slide cam member on the body and fit the lock cam member on the door.

What is claimed is:

1. A door opening and closing mechanism fitted on a door that closes and opens an opening formed in a body of an apparatus by being brought into and out of contact with a rim of the opening, comprising:

cam mechanisms that permit the door to engage with and disengage from the body at either one of right and left sides of the door, each of the cam mechanisms being movable between a first lock position and a second lock position, the cam mechanisms, each being disposed at a respective one of said sides and including:

a groove cam guided by a rotating member in a direction generally perpendicular to a longitudinal axis of the rotating member;

a lock outer cam having a slide surface; and a slide outer cam, wherein, when the door is closed, the cam mechanisms at both of said sides are kept in the first lock position and, when the door is opened at one of said sides, the other side of the door slides obliquely in a rearward direction toward the body of the apparatus and thereby causes the cam mechanism at the other side to be brought into the second lock position so as to be rotatably locked in the second lock position which allows the door to pivot about the cam mechanism at the other side of the door, and wherein, when the door is opened at said one side, at the other side, a vertex of the slide outer cam and a vertex of the lock outer cam are displaced from each other in a radial direction with respect to the rotating member, a distance, as much as at least 0.2% of a maximum distance between the groove cams.

2. A door opening and closing mechanism as claimed in claim 1, wherein the door has a gasket fitted on a rear surface thereof, and a slide distance of the door in the rearward direction when the door is opened at said one side is set to be 2.3% to 4% of a distance between a rear surface of the gasket and the rotational center of the door at the other side.

3. A door opening and closing mechanism as claimed in claim 1, wherein a slide distance of the door in a direction of a width thereof is set to be at least 2.5 mm.

4. A door opening and closing mechanism as claimed in claim 1, wherein each slide outer cam has at least one curved surface or a combination of said at least one curved surface and at least one flat surface, and has a tip portion including the vertex.

5. A door opening and closing mechanism as claimed in claim 1, wherein for each cam mechanism, a tip portion of the slide outer cam has a plurality of radii of curvature in such a way as to have increasingly greater radii of curvature toward the lock outer cam.

* * * * *